US008610586B2

(12) United States Patent
Shimada et al.

(10) Patent No.: US 8,610,586 B2
(45) Date of Patent: Dec. 17, 2013

(54) SENSOR

(75) Inventors: Yoshitake Shimada, Hirakata (JP); Mikio Komatsu, Izumi (JP); Koji Sakamoto, Nishinomiya (JP); Hirohisa Okuno, Osaka (JP); Akiko Honda, Kadoma (JP); Koji Yamato, Osaka (JP)

(73) Assignee: Panasonic Corporation, Osaka (JP)

( * ) Notice: Subject to any disclaimer, the term of this patent is extended or adjusted under 35 U.S.C. 154(b) by 528 days.

(21) Appl. No.: 12/736,233

(22) PCT Filed: Mar. 18, 2009

(86) PCT No.: PCT/JP2009/055273

§ 371 (c)(1), (2), (4) Date: Oct. 25, 2010

(87) PCT Pub. No.: WO2009/119402

PCT Pub. Date: Oct. 1, 2009

(65) Prior Publication Data

US 2011/0068936 A1 Mar. 24, 2011

(30) Foreign Application Priority Data

| | | |
|---|---|---|
| Mar. 24, 2008 | (JP) | 2008-076408 |
| Mar. 25, 2008 | (JP) | 2008-077739 |
| Aug. 7, 2008 | (JP) | 2008-204547 |
| Aug. 7, 2008 | (JP) | 2008-204548 |
| Nov. 10, 2008 | (JP) | 2008-287877 |

(51) Int. Cl.
*G08B 21/00* (2006.01)

(52) U.S. Cl.
USPC ..... 340/627; 340/618; 340/628

(58) Field of Classification Search
USPC ..... 340/628, 630, 632, 584, 618, 627; 356/338, 342, 438, 439; 250/381, 573, 250/574, 575
See application file for complete search history.

(56) References Cited

U.S. PATENT DOCUMENTS

| | | | | |
|---|---|---|---|---|
| 4,035,788 | A * | 7/1977 | Barr | 340/627 |
| 4,099,065 | A * | 7/1978 | Malinowski | 250/574 |
| 5,751,218 | A * | 5/1998 | Winterble et al. | 340/693.6 |
| 6,300,876 | B1 * | 10/2001 | Sakurai et al. | 340/630 |
| 6,876,305 | B2 * | 4/2005 | Kadwell et al. | 340/630 |
| 7,167,099 | B2 * | 1/2007 | Kadwell et al. | 340/630 |
| 7,616,126 | B2 * | 11/2009 | Kadwell et al. | 340/630 |

FOREIGN PATENT DOCUMENTS

| | | |
|---|---|---|
| GB | 2 251 067 A | 6/1992 |
| JP | S55-57995 | 4/1980 |
| JP | S55-144527 | 11/1980 |
| JP | S56-140893 | 10/1981 |

(Continued)

*Primary Examiner* — Van T. Trieu
(74) *Attorney, Agent, or Firm* — DLA Piper LLP (US)

(57) ABSTRACT

A sensor having a detecting part for detecting an environmental value representing change in physical amount of circumference environment by a fluid flowing into externally and a controlling part for discriminating abnormality in circumference environment based on the environmental value detected by the detecting part. A separating plate is provided inside a housing so as to separate two spaces in the height direction. A detection unit is provided in one space and a sounding body is provided in the other space. Apertures are provided in a side wall, thereby opening one space to the outside environment and letting the fluid to be measured flow into the space. Then, a flow path is formed inside the space in the housing, from the side wall forming the housing toward the detection unit, thereby proactively channeling the fluid to the detection unit.

27 Claims, 33 Drawing Sheets

(56) References Cited

FOREIGN PATENT DOCUMENTS

| | | |
|---|---|---|
| JP | H08-263766 | 10/1996 |
| JP | H09-44769 | 2/1997 |
| JP | H10-241074 A | 9/1998 |
| JP | H11-51864 | 2/1999 |
| JP | 2002-352345 | 12/2002 |
| JP | 2002-352347 | 12/2002 |
| JP | 2003-281641 | 10/2003 |
| JP | 2005-352932 | 12/2005 |
| JP | 2007-264996 | 10/2007 |

* cited by examiner

SENSOR

TECHNICAL FIELD

The present invention relates to a sensor measuring an environmental value representing environmental change from fluid flowing into a detecting part, and more specifically to a sensor having a detecting part in a housing.

BACKGROUND ART

A fire alarm informing a fire generally includes a heat detecting type fire alarm having a heat detecting element for detecting room temperature (refer to the Patent Citation 1), a smoke detecting type fire alarm having a smoke detector (refer to the Patent Citation 2), and a fire alarm having both types (refer to the Patent Citation 3 and the Patent Citation 4). The heat detecting type fire alarm determines fire generation when the temperature detected by the heat detecting element becomes high and announces an alarm as disclosed in the Patent Citation 1. On the other hand, the smoke detecting type fire alarm determines fire generation when the smoke amount detected by the smoke detector becomes large and announces an alarm as disclosed in the Patent Citation 2.

These types of fire alarms are constituted as a sensor for detecting the change in the circumference environment from fluid, the sensor having a detecting chamber constituting a detecting part measuring the temperature or the smoke amount for detecting fire. A gas alarm for executing gas detection is also constituted as a sensor for detecting the change in the circumference environment from fluid. Such a sensor measuring the environmental value by fluid is required to have a structure for guiding the fluid to be measured into the detecting part in order to accurately detect the change in the circumference environment. For this purpose, many conventional sensors have such a structure that the detecting chamber constituted as the detecting part is projected out of the housing and heated fluid or smoke to be measured is positively flown in the detecting chamber as disclosed in the Patent Citations 1 to 4.

The sensor represented in the Patent Citations 1 to 4 is constituted such that the detecting part is projected out of the housing accommodating and protecting circuit members and the like therein, whereby the detecting part is deemed to be provided in the outer environment (circumference environment to be measured). An optical type sensor for detecting smoke comprising a heat detecting element such as a thermistor, a light emitting element, or a light receiving element provided in the detecting part can execute measurement of the fluid in a condition close to the outer environment.

The conventional sensor represented by the Patent Citations 1 to 4 is explained referring to FIG. 47. FIG. 47 is a diagrammatic view showing the positional relation of the housing constituting the sensor and the detecting part for detecting the environmental value and other members are not detailed. The sensor shown in FIG. 47 is designed such that a detecting part 201 is projected out of a housing 200. A protective cover 202 covers a projected part which is the back side of the housing 200 and is opposite to the attachment portion. Namely, the detection part 201 is provided at the projected tip part covered with the protective cover 202, so that the detecting part 201 is positioned at a place closer to the circumference environment to be measured.

According to thus structured conventional sensor in FIG. 47, the detecting part 201 is provided so as to be projected out of the housing 200, so that fluid can easily flow in the detecting part 201. However, such a sensor having the projected detecting part 201 is provided in a room, it is not suitable for room design and it causes disfigurement of the room. For its purpose, a sensor has been required in these days to be smaller and thinner for improving the design appearance in the room provided with a sensor.

In order to achieve the smaller and thinner sensor, a sensor having a detecting chamber in a housing, without projecting the detecting chamber in the outer environment, is proposed like a scattered light type smoke sensor which is different from the sensor in FIG. 47 as disclosed in The Patent Citation 5. In the scattered light type smoke sensor of the Patent Citation 5, a space constituting a detecting chamber and a space for providing circuit members are divided in a housing in order to prevent incident of light into a light receiving element constituting a detection sensor.

CITATION LIST

Patent Citation 1: JP-09-044769-A
Patent Citation 2: JP-2005-352932-A
Patent Citation 3: JP-2002-352347-A
Patent Citation 4: JP-2007-264996-A
Patent Citation 5: JP-08-263766-A

SUMMARY OF INVENTION

Technical Problem

However, when a sensor is designed as disclosed in the Patent Citation 5, the sensor can be made smaller and thinner. However, the detecting part is arranged in the housing, so that fluid has difficulty to flow in the detecting part comparing to the sensor having a detecting part projected out of the housing shown in FIG. 47. The housing includes a control part for detecting the change in the outer environment based on the environmental value obtained in the detecting part, and a battery or an electric circuit to supply electricity to each part. Accordingly, when the detecting part is provided out of the housing, the members other than the detecting part become obstacle and fluid has further difficulty to flow in the detecting part. In addition, even when fluid to be detected in the detecting part flows in the housing, the air which has already remained in the housing becomes obstacle and rapid flow of the objective fluid is prevented from entering in the detecting part, thereby delaying detection by the detecting part.

According to the sensor having at the outer circumference of the housing an opening for flowing fluid into the housing from outside, a support member like a bar for compensating the strength degradation caused by forming the opening is provided in the opening area formed by the opening. The support member can reinforce the opening, on the other hand it narrows the flow entrance of the opening and disturbs fluid flow via the opening.

Further, when the sensor is constituted as a fire alarm, a sounding body for triggering alarm is provided. When the detecting part and the sounding body are provided in the same space, the detecting operation of the detecting part is to be affected by the air vibration from the sounding body. The influence by the sounding body on the detecting part particularly becomes large when the sensor is made smaller or thinner. In addition, the space of an air chamber where the sounding body is provided is made smaller when the sensor is made smaller or thinner, so that the air resistance becomes large in the air chamber, thereby reducing the output sound volume of the sounding body.

Still further, contamination of foreign matter like dust largely affects measurement of environmental value in the sensor of which measurement object is fluid, so that it is preferable to prevent contamination of foreign matter in the detecting chamber. When the detecting chamber is provided in the sensor, an insect screen is provided so as to cover the detecting chamber constituting the detecting part, however, minute foreign matter like dust is apt to encroach in the detecting chamber through the mesh of the insect screen. For this purpose, when the detecting chamber is provided in the alarm, it is preferable that the space where the detecting chamber is provided in the alarm is designed to inhibit contamination of foreign matter like dust.

Means to Solve the Problem

In view of the above-mentioned problems, the present invention has an objet to suggest a sensor which can encourage fluid flow into a detecting part provided in a housing in order to make the sensor smaller and thinner. In addition, the present invention has an object to design a sensor so as to reduce the air resistance in the space where a sounding body is provided and to inhibit the vibration influence of the sounding body on the detecting part, thereby providing a smaller and thinner sensor. Further, the present invention has an object to propose an alarm in which a shielding cover is provided for shielding the space including the detecting part to reduce contamination of foreign matter into the space having the detecting part.

The sensor of the present invention having a detecting part for detecting an environmental value representing change in physical amount of circumference environment by a fluid flowing into externally and a controlling part for discriminating abnormality in circumference environment based on the environmental value detected by the detecting part comprises a housing in which the detecting part and the controlling part are disposed, an opening formed on an outer circumferential face of the housing, and a guide member extending from the opening to the detecting part and constituting a guide path for guiding the fluid from the opening to the detecting part.

Further, the sensor of the present invention having a detecting part for detecting an environmental value representing change in physical amount of circumference environment by a fluid flowing into externally and a controlling part for discriminating abnormality in circumference environment based on the environmental value detected by the detecting part comprises a housing in which the detecting part and the controlling part are disposed, an opening for opening an outer circumferential wall of the housing, a guide member extending from the opening to the detecting part and constituting a guide path for guiding the fluid from the opening to the detecting part, and a component provided in a space in which the opening of the housing and the detecting part are disposed on coplanar surface and is disposed around the detecting part, the component constituting a part of the guide member.

Further, the sensor of the present invention having a detecting part for detecting an environmental value representing change in physical amount of circumference environment by a fluid flowing into externally and a controlling part for discriminating abnormality in circumference environment based on the environmental value detected by the detecting part comprises a housing in which the detecting part and the controlling part are disposed, an opening formed on an outer circumferential face of the housing, a plurality of guide members extending from the opening to the detecting part and constituting a plurality of guide paths for guiding the fluid from the opening to the detecting part, and a bypass provided on at least one of the guide members, wherein the two guide paths are defined by the guide member formed with the bypass and other two guide members adjoin the guide members formed with the bypass, with the guide member formed with the bypass disposed as a boundary between the two guide paths.

Still further, the sensor of the present invention having a detecting part for detecting an environmental value representing change in physical amount of circumference environment by a fluid flowing into externally, a controlling part for discriminating abnormality in the circumference environment based on the environmental value detected by the detecting part, a sounding body for alarming based on the abnormality discrimination by the controlling part, and a housing in which the detecting part, the controlling part and the sounding body are contained comprises a separating plate by which the housing is defined as two divided spaces of a first space and a second space up and down along its height direction, a first opening for leaving open the first space, formed corresponding to the first space on the side face of the housing, and a sound aperture penetrating into the second space in an area which is parallel to the attachment surface of the sensor and is opposite to the sounding body at the end face of the housing covering the second space, wherein the detecting part is provided in the first space whereas the sounding body is provided in the second space.

Further, the sensor of the present invention having a detecting part for detecting an environmental value representing change in physical amount of circumference environment by a fluid flowing into externally and a controlling part for discriminating abnormality in circumference environment based on the environmental value detected by the detecting part comprises a housing in which the detecting part and the controlling part are disposed, an opening formed on an outer circumferential wall of the housing for flowing the outside fluid into the housing, a guide part formed in the space between the opening of the housing and the detecting part for guiding the outside fluid from the opening to the detecting part, and a shielding cover constituting an independent space by a component part comprised of the detecting part and the guide part in the housing.

Effect of the Invention

According to the present invention, the sensor can be made smaller and thinner by providing the detecting part in the housing. The guide member constituting the flow path dividing the space including the detecting part and extending from the opening to the detecting part is provided, so that the fluid flown from the opening can be guided to the detecting part, thereby preventing deterioration of detection ability in the detecting part.

Further, the constituting member which has been obstacle to guiding the fluid from the opening to the detecting part can be used as a part of the guide member, thereby reducing obstacle factor for guiding the fluid in the guide path from the opening to the detecting part. The constituting member required for the sensor is used as the guide member, so that useless guide member is not required to be provided. When the bar is provided for securing the strength of the housing, the bar is connected to the end part of the guide member, thereby controlling by the guide member reduction of guide ability based on the change in the pressure distribution by the bar. In addition, when the bypass of fluid between the guide paths is provided, the fluid to be detected can be rapidly guided to the detecting part. Accordingly, much fluid to be detected rapidly flows in the detecting part to enhance the responsiveness on detection of the environmental value by the detecting part.

Still further, when the separating plate is provided in the housing, the second space having the sounding body and the fist space having the detecting part can be separated. Accordingly, the affect on the fluid to be flown in the detecting part based on the alarm operation of the sounding body can be reduced and the affect thereof on the measuring operation in the detecting part can be inhibited. In addition, the second space is formed by the separating plate so as to provide the sounding body, the air resistance in the second space can be prevented when the sounding body triggers alarm. When the second opening is provided so as to open the second space having the sounding body into the space outside of the housing, the air resistance in the second space can be further reduced, and as the result, the external sound volume of the alarm can be large.

Still further, when the shielding cover is provided in the housing including the detecting part, the space comprised of the detecting part and the guide part can be constituted as an independent space in the housing so that foreign matter can be prevented from entering in the guide part provided in the housing together with the detecting part. The shielding cover blocks the guide part from another space in the housing and an operator is prevented from getting in touch with the structure guiding the fluid to be detected into the detecting part. In addition, the space where the guide part is provided is constituted as an open space with the opening, thereby preventing air flow other than the fluid flow from the opening to the detecting part by the guide part. Further, an operator is prevented from contacting the guide member by means of the shielding cover during setting operation of the alarm or exchanging operation of battery.

EXPLANATION OF REFERENCE NUMERAL

Figure 1:
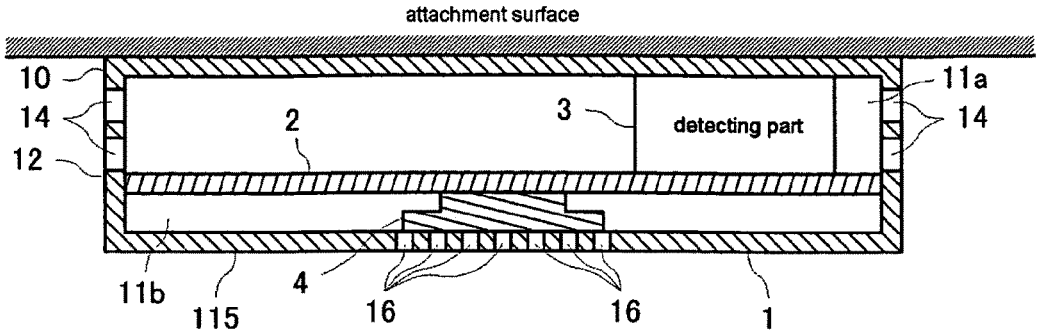
FIG. 1 is a diagrammatic sectional view showing the structure of a sensor according to the first embodiment of the present invention.

1 housing
2 separating plate
3 detecting part
4 sounding body
9 structure
11*a* first space
11*b* second space
11 base
12 side wall
13 top panel
14 opening
15 opening
16 sound aperture
51 guide wall
51*a*-51*c* guide wall
18 opening
19 groove member
30 smoke detecting part
33 thermistor
50 battery
301 bottom plate
302 labyrinth wall
303 light emitting part
304 light receiving part
305 insect screen
L light emitting diode
PD photo diode

PREFERRED EMBODIMENTS TO EXECUTE THE INVENTION

The preferred embodiments of a sensor of the present invention are explained hereinafter. In each embodiment, a sensor of the present invention is exemplified as a sensor applied to a fire alarm whose object to be measured is a smoke flow or a thermal flow.

First Embodiment

A sensor according to the first embodiment of the present invention is explained referring to the drawings. FIG. 1 is a diagrammatic sectional view of a sensor of the present embodiment.

The sensor of the present embodiment has a housing 1 which is attached on the attachment surface such as a ceiling face or a wall face and covers the entire apparatus, a separating plate 2 separating a space in the housing 1 in the height direction, a detecting part 3 for measuring the environmental value by the fluid flown in the housing 1 from the outer environment, and a sounding body 4 for announcing alarm by means of voice or a buzzer as shown in FIG. 1. The space in the housing 1 is divided by the separating plate 2 attached in parallel to the attachment surface into the first space 11*a* and the second space 11*b*. The detecting part 3 is provided in the first space 11*a* and the sounding body 4 is provided in the second space 11*b*.

The housing 1 has a base part 10 to be provided on the attachment surface, a ring-like side wall 12 projected out of the outer circumference of the base part 10 into the direction apart from the attachment surface, and a disk-like top panel 115 covering the end opposite to the end of the side wall 12 covered with the base part 10. When the outer circumferential edge of the separating plate 2 is connected to the inner circumferential face of the side wall 12, the first space 11*a* and the second space 11*b* are formed in the housing 1. An opening 14 is provided in the area of the side wall 12 covering the first space 11*a* and a plurality of sound apertures 16 are provided in the area corresponding to the area where the sounding body 4 is provided. Namely, the first space 11*a* is opened to the outer environment of the housing 1 by the opening 14, on the other hand, the second space 11*b* is opened to the outer environment of the housing 1 by the sound apertures 16.

Accordingly, the fluid from outer environment is introduced in the housing 1 via the opening 14 to be supplied to the detecting part 3. On the other hand, when the section of the second space 11*b* formed with the separating plate 2, the section being parallel to the attachment surface, is the same size of the section of the side wall 12, the second space 11*b* can obtain enough volume. And the air resistance in a rear air chamber having the sounding body 4 can be reduced and the sound of the alarm of the sounding body 4 can be prevented from being deteriorated.

The opening 14 may be provided all around the circumference of the side wall 12 or may be provided at a part of the side wall 12 in the circumferential direction. When it is provided on a part of the side wall 12 in the circumferential direction, if the opening 14 is provided at the place where the side wall 12 prevents the fluid flow in the outer environment, the fluid can be supplied in the housing 1 without interrupting the fluid flow in the outer environment.

When the sounding body 4 is a thin speaker such as a dynamic speaker or a piezoelectric speaker, the second space 11*b* can be made lower to make the housing 1 thinner. The separating plate 2 is provided and the first space 11*a* and the second space 11*b* are closed, so that the air vibration in the second space 11*b* is prevented from transmitting to the air in the first space 11*a*. Therefore, even when an alarm is announced by the sounding body 4, the vibration applied to the fluid flown in the detecting part 3 is prevented, thereby reducing the effect on the measuring operation in the detecting part 3 caused by the alarm operation of the sounding body 4.

Further, the sounding body 4 is provided at the center of the separating plate 2 relative to the direction parallel to the attachment surface and the detecting part 3 is provided at the place which is outer circumferential side from the sounding body 4 and does not overlap the sounding body 4. Accordingly, comparing to the case in which the detecting part 3 is provided on the back of the separating plate 2 where the sounding body 4 is provided, the vibration from the sounding body 4 to be transmitted to the detecting part 3 via the separating plate 2 can be reduced and the effect on the measuring operation of the detection part 3 is refrained.

Figure 2:
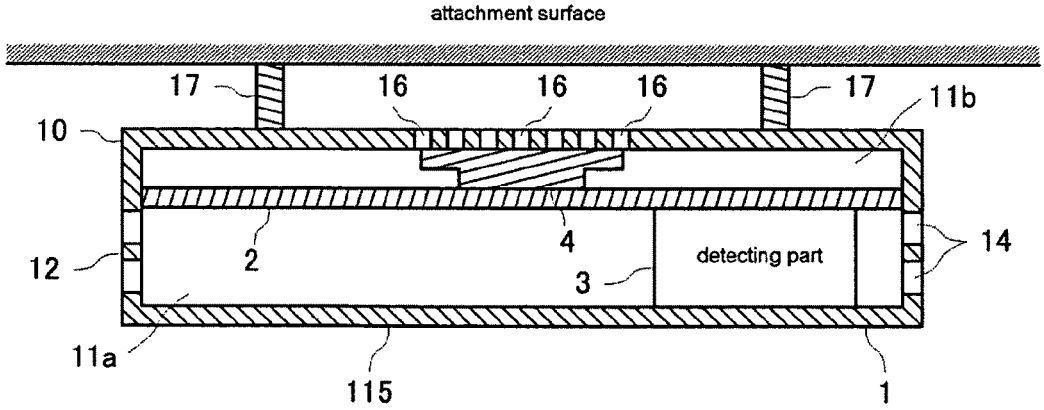
FIG. 2 is a diagrammatic sectional view showing another structure of a sensor according to the first embodiment of the present invention.

The first space 11*a* is provided on the attachment surface side (at the base part 10 side of the housing 1) in the present embodiment as shown in FIG. 1, however, the second space 11*b* may be provided on the attachment surface side (at the base part 10 side of the housing 1) as shown in FIG. 2. In this case, a support member 17 projected out of the housing 1 into the attachment surface is provided along the end face of the base part 10 opposing the attachment surface. The sensor is provided such that the support member 17 is connected to the attachment surface, and the base part 10 is provided apart from the attachment surface. The opening 14 is provided at the top panel 115 side of the side wall 12.

The second space 11*b* is formed at the base part 10 side of the housing 1 and the sounding body 4 is provided therein, so that the sound aperture 16 is to be provided at the base part 10 instead of the top panel 115. Further, a plurality of support members 17 are provided with a space along the circumferential side of the area where a sound aperture is provided (area corresponding to the sounding body 4) on the end face opposite to the attachment surface of the base part 10. Thus, the space between the attachment surface and the end face of the base part 10 becomes open because of the space of the support members 17 and the alarm sound outputted from the sound aperture 16 reflects between the attachment surface and the end face of the base part 10 and can be outputted outside from the spaces of the support members 17.

Second Embodiment

Figure 3:
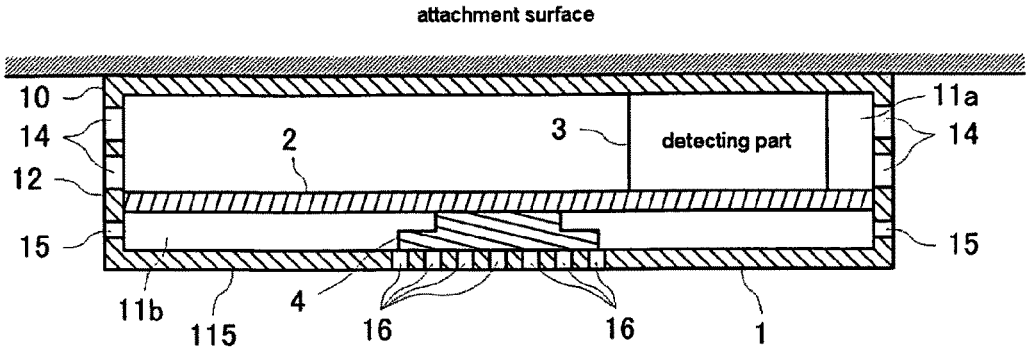
FIG. 3 is a diagrammatic sectional view showing the structure of a sensor according to the second embodiment of the present invention.
Figure 4:
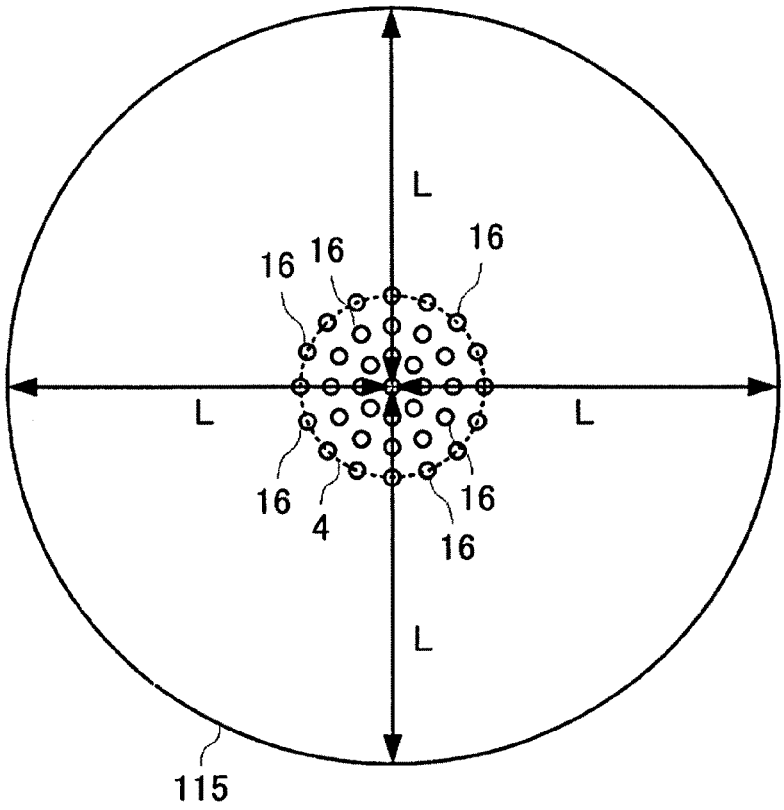
FIG. 4 is a top view of a top panel showing where sound apertures and a speaker of the sensor shown in FIG. 3 are provided.

A sensor according to the second embodiment of the present invention is explained referring to the drawings. FIG. 3 is a diagrammatic sectional view showing the structure of the sensor according to the present embodiment. FIG. 4 is a diagrammatic plan view of the sensor in FIG. 3 seen from the top panel. In FIG. 3 the same members as those in FIG. 1 are allotted with the same reference numerals and their explanation is omitted.

As shown in FIG. 3, the sensor of the present embodiment is different from the sensor in the first embodiment (FIG. 1) in that an opening 15 is provided at the area covering the second space 11*b* of the side wall 12. Namely, the first space 11*a* is opened to the outer environment of the housing 1 by means of the opening 14, on the other hand, the second space 11*b* is opened to the outer environment of the housing 1 by means of the opening 15 and the sound aperture 16. Other structures are same as those in the first embodiment, their explanation is to be referred to that of the first embodiment and their explanation is omitted here.

According to such a structure, the air resistance in the rear chamber having the sounding body 4 can be reduced by the opening 15 and the sound aperture 16. Namely, the resistance relative to the front face of the sounding body 4 (opposite face to the top panel 115) is reduced by the sound aperture 16, on the other hand, the air resistance in the second space 11*b* when the air other than the front face of the sounding body 4 in the second space 11*b* is vibrated can be reduced. Therefore, the sound volume of the alarm by the sounding body 4 is prevented from being deteriorated.

The opening 15 may be provided all around the side wall 12 or may be partially provided in the circumferential direction of the side wall 12 like the opening 14. The opening 15 is preferably sized so as not to reduce sound volume of the alarm of the sounding body 4 and preferably has an enough opening area in order to control the resistance of alarming. Further, the opening 15 may not be provided at the place where fluid easily flows in by the opening 14 along the circumference of the side wall 12 in order to reduce the effect of vibration by the alarm sound from the sounding body 4 on the fluid to be supplied to the detecting part 3.

When the sounding body 4 is designed to be a thin speaker to make the volume in the second space 11*b* small, it would appear that the area parallel to the attachment surface is enlarged in order to reduce the air resistance of alarming, however, in this embodiment, the opening 15 is provided in order to open the second space 11*b*. Accordingly, the air resistance in the second space 11*b* when the sounding body 4 outputs an alarm can be reduced and the area is not required to be enlarged. Namely, the area of the top plate 115 can be made small and as the result the housing 1 can be downsized.

As shown in FIG. 4, a plurality of sound apertures 16 are provided at the center of the top panel 115 and the sounding body 4 is provided so as to correspond to the sound aperture 16. Namely, the sounding body 4 is provided at the center of the face of the housing 1 parallel to the attachment surface. Therefore, the distance between the center of the sounding body 4 and the outer circumference of the top panel 115 becomes a constant distance L and the distance between the center of the sounding body 4 and the aperture 15 always becomes a constant distance L relative to the circumferential direction of the sounding body 4.

Where the main frequency (specific frequency) of the alarm sound from the sounding body 4 is set as F and the sonic speed is set as C, it is preferable that the distance L from the sounding body 4 to the opening 15 nearly becomes the value of the distance LX (=(n+1/2)×C/F). Wherein "n" is the integer number equal to or larger than "0". The effect when the distance L from the sounding body 4 to the opening 15 is the distance LX (=(n+1/2)×C/F) is briefly explained referring to FIG. 5.

Figure 5:
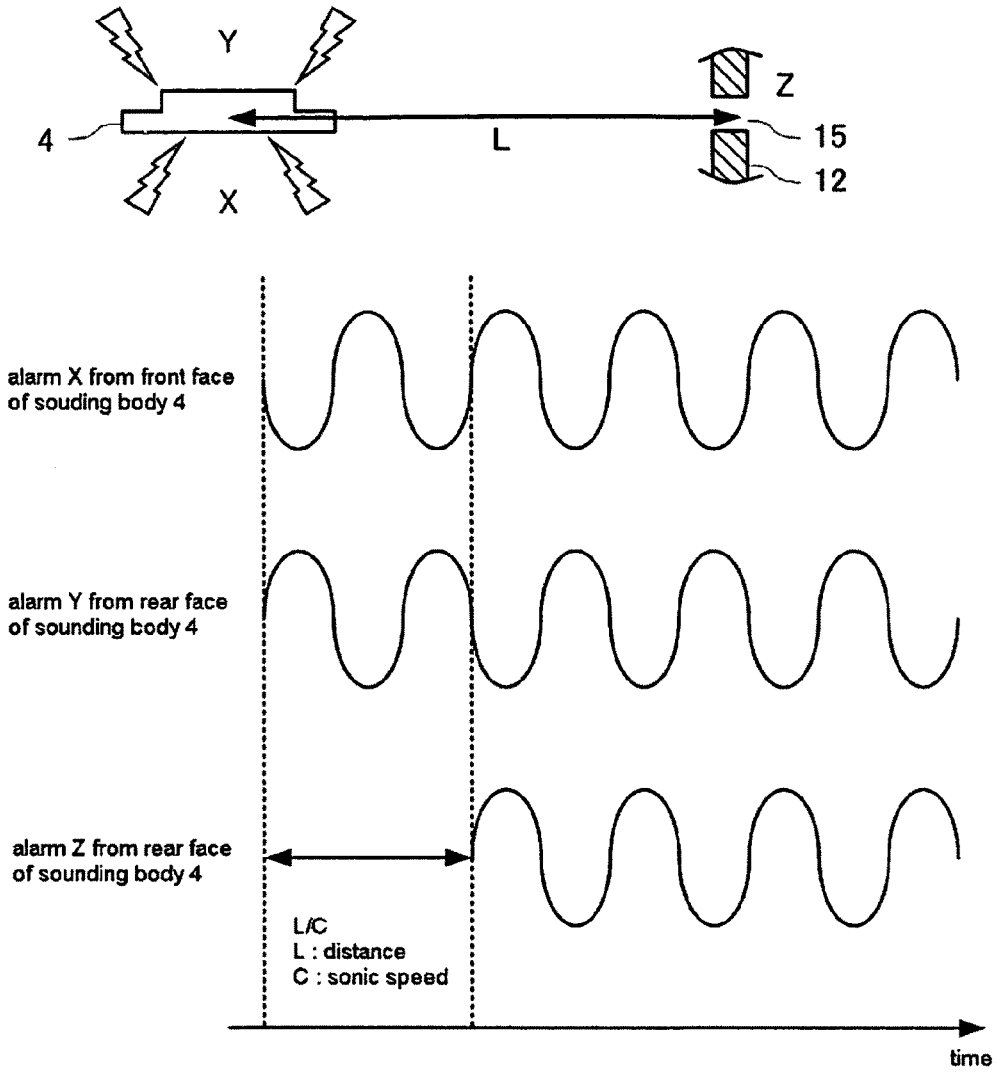
FIG. 5 is a diagrammatic view showing the relation of the distance between a speaker and an opening and the phase of the sound outputted from the speaker.

As shown in FIG. 5, the alarm sound Y at the back of the sounding body 4 becomes a sound of which phase is reversed relative to the alarm sound X at the front position of the sounding body 4. In other words, the alarm sound Y becomes a sound of which frequency is moved over in a half cycle comparing to the alarm sound X. The alarm sound X reaches the area covering the top panel 115 of the housing 1 and the second space 11*b* of the side wall 12. Therefore, the alarm sound X from the front face of the sounding body 4 reaches around the opening 15 which is apart from the sounding body 4 at the distance L via the top panel 115 and side wall 12, so that it has the same phase as that at the front face of the sounding body 4.

On the other hand, the alarm sound Y from the rear face of the sounding body 4 is transmitted around the opening 15 by the air in the second space 11*b* and it becomes an alarm sound Z of which phase is displaced at F×L/C. Namely, when the alarm sound Y from the rear face of the sounding body 4 reaches around the opening 15, the distance L becomes LX (=(n+1/2)×C/F) and it becomes the alarm sound Z of which frequency is moved over at a frequency of (=n+1/2).

Accordingly, because the phase of the alarm sound Y which is an original one of the alarm sound Z is moved over at a half cycle relative to the alarm sound X, the alarm sound X and the alarm sound Z having the frequency moved over at the integer number relative to the alarm sound X are given to the opening 15. Therefore, the alarm sounds X and Z having the same phase appear at the opening 15, so that they are enhanced each other and the alarm sound 4 around the opening 15 results in large volume.

When the specific frequency F of the alarm sound from the sounding body 4 is for example 3 kHz, the distance L between the sounding body 4 and the opening 15 is set at around 60 mm, the alarm sounds from the front face and the rear face of the sounding body 4 having the specific frequency 3 kHz are enlarged with each other. Accordingly, the alarm sound from the rear face of the sounding body 4 can be effectively utilized and the volume of the alarm sound from the sounding body 4 can be increased.

Third Embodiment

Figure 6:
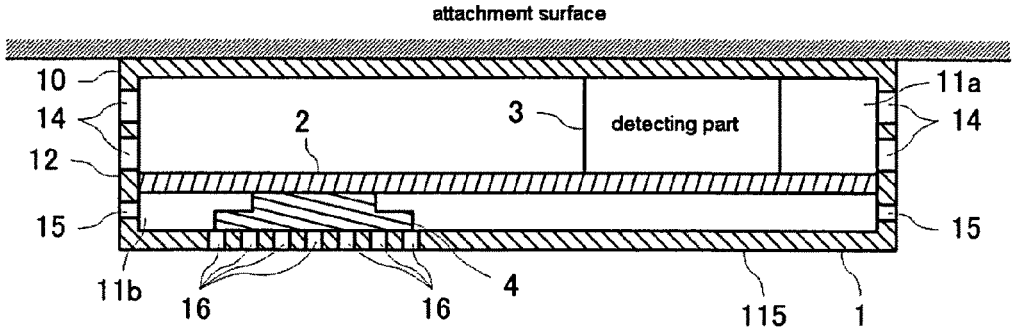
FIG. 6 is a diagrammatic sectional view showing the structure of a sensor according to the third embodiment of the present invention.
Figure 7:
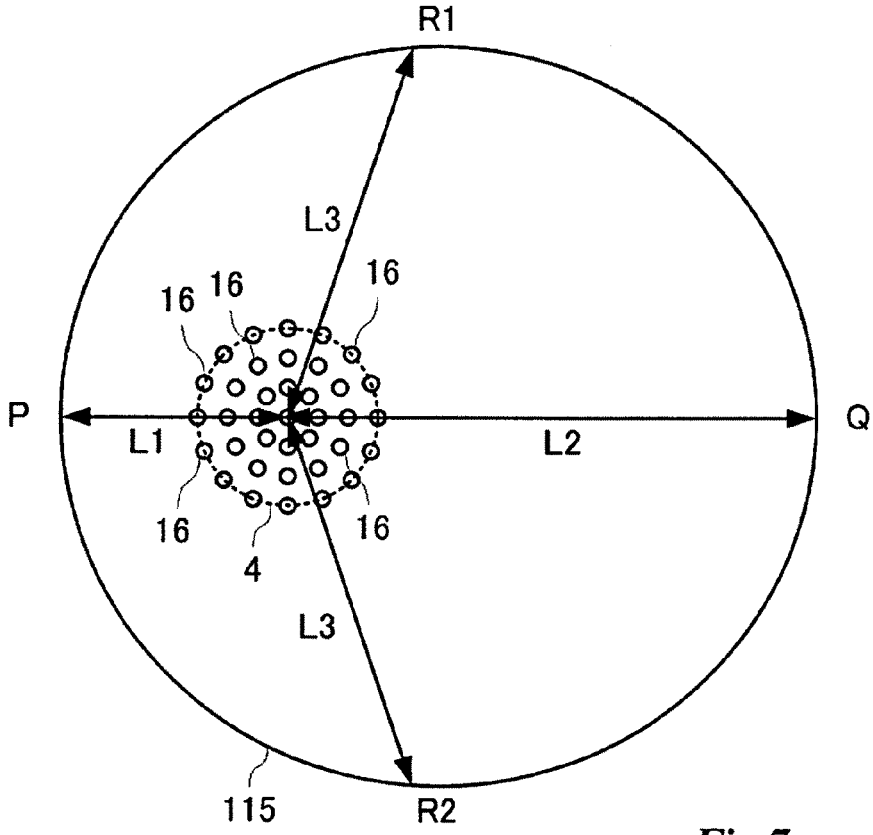
FIG. 7 is a top view of a top panel showing where sound apertures and a speaker of the sensor shown in FIG. 6 is provided.

A sensor according to the third embodiment of the present invention is explained referring to the drawings. FIG. 6 is a diagrammatic sectional view showing the structure of a sensor according to this embodiment. FIG. 7 is a diagrammatic plan view of the sensor in FIG. 6 seen from the top panel. In FIG. 6 and FIG. 7 the same members as those in FIG. 3 and FIG. 4 are allotted with the same reference numerals and their explanation is omitted.

The sensor of the present embodiment is different from the sensor of the second embodiment (FIG. 3 and FIG. 4) in that the sounding body 4 is provided on the outer circumference side of the separating plate 2 apart from the detecting part 3 in a direction parallel to the attachment surface as shown in FIG. 6 and FIG. 7. Namely, the sounding body 4 is provided at an eccentric position from the center of the top panel 115 and a plurality of sound apertures 16 are provided at an area eccentric to the center corresponding to the setting position of the sounding body 4. Other structures are same as those in the second embodiment, and their explanation is to be referred to that of the second embodiment and is omitted here.

According to such a structure, the distance between the sounding body 4 and the outer circumference of the top panel 115 with respect to a straight line direction connecting the center of the sounding body 4 and the center of the top panel 115 becomes the shortest distance L1 or the longest distance L2. Namely, when the radius of the top panel 115 is R and the distance between the center of the sounding body 4 and the top panel 115 is LR, the shortest distance L1 between the sounding body 4 and the outer circumference of the top panel 115 becomes (R−LR) and the longest distance L2 thereof becomes (R+LR).

Thus, at the opening 15 provided at a position P apart from the sounding body 4 with the shortest distance L1 (=R−LR), the alarm sound having frequency of F1 (=(n+1/2)×C/L1) among the alarm sounds outputted from the front face of the sounding body 4 and the rear face thereof is enhanced each other. On the other hand, at the opening 15 provided at a position Q apart from the sounding body 4 with the longest distance L2 (=R+LR), the alarm sound having frequency of F2 (=(n+1/2)×C/L2) among the alarm sounds outputted from the front face of the sounding body 4 and the rear face thereof is enhanced each other.

Namely, the present embodiment is different from the second embodiment in that the sounding body 4 is provided eccentrically from the center of the top panel 115 and the alarm sounds having different frequency are enhanced each other at each position along the circumference of the top panel 115 and the volume of the alarm sound in a wide frequency zone from F2 to F1 can be controlled. In addition, the opening area by the opening 15 can be set per each frequency of the alarm sound from the sounding body 4, so that flexible design is possible comparing to the second embodiment in which the sounding body 4 is provided at the center of the top panel 115.

Accordingly, where the position of the outer circumference of the top panel 115 apart from the center of the sounding body 4 with the distance L3 (L1<L3<L2) is set at R1, R2 as shown in FIG. 7 and the opening area by the opening 15 is provided along the circumferential direction connecting the positions R1, P, R2, the volume of the alarm sound at the frequency zone of F3 (=n+1/2×C/L3) to F1 (=n+1/2×C/L1) can be designed to be large. On the contrary, the opening area by the opening 15 is provided along the circumferential direction connecting the positions R1, Q, R2, the volume of the alarm sound at the frequency zone of F2 (=n+1/2×C/L2) to F3 (=n+1/2×C/L3) can be designed to be large.

Further, each frequency of the alarm sound to be increased is distributed along the circumferential direction of the top panel 115, so that the directionality of the alarm sound at each frequency is to be distributed along the circumferential direction of the top panel 115. The alarm sound at the frequency F1 has the directionality from the sounding body 4 to the position P, the alarm sound at the frequency F2 has the directionality from the sounding body 4 to the position Q, and the alarm sound at the frequency F3 has the directionality from the sounding body 4 to the position R1 or R2.

Accordingly, when the open area by the opening 15 is directed to the outputting direction of the alarm sound from the sounding body 4, the alarm from the sounding body 4 can be easily heard and the reminder effect by the alarm of the sensor can be improved. Specifically, when the opening area by the opening 15 corresponding to the frequency of the main alarm is rendered in a direction to output the alarm sound from the sounding body 4, the reminder effect by the alarm sound is more improved.

In this embodiment, the detecting part 3 may be provided at the center of the separating plate 2 as far as the detecting part 3 does not overlap the sounding body 4 in a direction parallel to the attachment surface (at the position where they do not exist on the same position at the back and the front of the separating plate 2). Accordingly, the detecting part 3 is also positioned where the distance with each area of the opening 14 in the circumferential direction is same, so that similar measuring effect can be achieved for the fluid flown from each area in the circumferential direction of the opening 14. Therefore, this embodiment is designed in a manner that the setting position of the sensor is not limited in the circumferential direction.

Further, when the detecting part 3 is provided on the outer circumferential side of the separating plate 2, the detecting part 3 can be positioned at the closest area to a part of the opening 14, so that the area of the opening 14 where the detecting part 3 is positioned closer is directed to the upstream side of the fluid flow, thereby accelerating the fluid flow into the detecting part 3. Still further, the distance between the detecting part 3 and the sounding body 4 can be made longer, thereby inhibiting vibration effect of the alarm of sounding body 4 on the detecting part 3.

When the detecting part 3 is provided at a position corresponding to the area which is not opened by the opening 15 along the circumferential direction of the side wall 12, the vibration effect by the alarm of the sounding body 4 can be further refrained. In addition, when the detecting part 3 is provided around a position where the alarm sound from the front face of the sounding body 4 and the back face 5 thereof are weakened with each other in the circumferential direction of the side wall 12, the vibration effect by the alarm of the sounding body 4 can be further refrained.

Further according to the present embodiment in which the sounding body 4 is positioned eccentric to the center of the top panel 115 in the direction parallel to the attachment surface, the opening 15 may not be provided at the area corresponding to the second space 11*b* of the side wall 12, like the first embodiment. Accordingly, the sound outputted from the opening 15 can be prevented from giving vibration on the air in the first space 11*a* via the opening 14, thereby further refraining vibration effect of the alarm of the sounding body 4.

Fourth Embodiment

Figure 8:
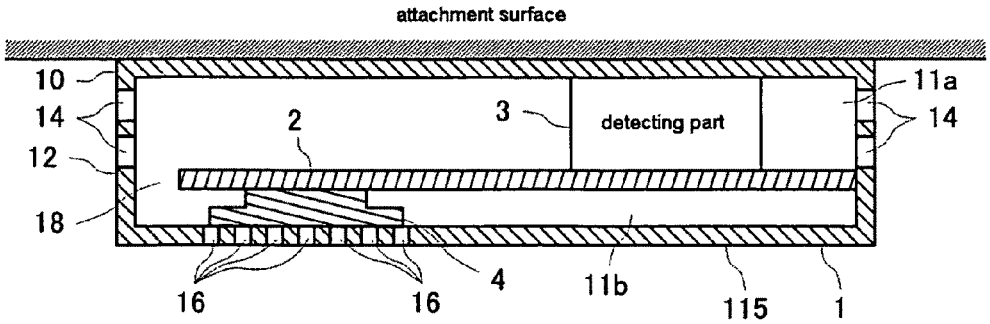
FIG. 8 is a diagrammatic sectional view showing the structure of a sensor according to the fourth embodiment of the present invention.

A sensor according to the fourth embodiment of the present invention is explained referring to the drawings. FIG. 8 is a diagrammatic sectional view showing the structure of a sensor according to this embodiment. In FIG. 8 the same members as those in FIG. 6 are allotted with the same reference numerals and their explanation is omitted.

The sensor of this embodiment has an opening 18 at a part of the connecting part of the separating plate 2 and the side wall 12 as shown in FIG. 8 instead of the opening 15 provided for the side wall 12 as shown in the sensor of the third embodiment (FIG. 6). Other structures are same as those in the third embodiment, and their explanation is to be referred to that of the first embodiment or the third embodiment and is omitted here.

Thus constructed sensor of this embodiment is different from the third embodiment in that the second space 11*b* enclosed with the side wall 12 and the top panel 115 is opened to outer circumferential area of the first space 11*a* by the opening 18. The outer circumferential area of the first space 11*a* is thus opened to the outer environment by the opening 14, as the result, the second space 11*b* is to be opened to the outer environment via the openings 14, 18.

Accordingly, when the second space 11*b* is opened to the outer environment via the openings 14, 18, the air resistance in the second space 11*b* which is a rear air chamber of the sounding body 4 can be reduced when the sounding body 4 is operated to output alarm. When the opening 14 is set at a position corresponding to the opening 18 in the circumferential direction of the side wall 12, the distance between the second opening and the opening 14 can be made shortest, thereby enhancing the opening effect of the second space 11*b* into the outer environment.

When the opening 18 is provided apart from the detecting part 3, the effect of air vibration caused by alarming the sounding body 4 on the detecting part 3 can be reduced. In addition, the flow speed of vibrating air by the alarm of the vibration body 4 can be limited by enlarging the opening area of the opening 18. Accordingly, the air vibration transmitted to the detecting part 3 in the first space 11*a* can be refrained and the effect of the air vibration caused by alarming the sounding body 4 on the detecting part 3 can be reduced.

Further, when the opening 18 is located at the place where the distance from the sounding body 4 corresponds to the frequency zone of the alarm sound outputted from the sounding body 4 like the third embodiment, the volume of the alarm sound outputted through the openings 14, 18 can be amplified. When the detecting part 3 is provided around the outer circumferential end of the separating plate 2 connected to the inner wall side of the side wall 12 without having the opening 18, the effect of the alarm of the sounding body 4 on the detecting part 3 can be limited.

Further, when the sounding body 4 is provided at the outer circumference of the separating plate 2 as shown in FIG. 8, if the detecting part 3 does not overlap the sounding body 4 on the face parallel to the attachment surface as described in the third embodiment, the detecting part 3 may be provided at the center of the separating plate 2. In such a case, when the outer circumference of the separating plate 2 and the detecting part 3 are provided with enough distance, the effect of the alarm of the sounding body 4 on the detecting part 3 can be reduced.

In this embodiment, the sounding body 4 is designed to be eccentric to the center of the top panel 115 like the structure of the third embodiment, however, the sounding body 4 may be provided at the center of the top panel 115 like the second embodiment. In such a case, the opening 18 is not provided around the outer circumference of the separating plate 2 where the detecting part 3 is provided and is preferably connected to the side wall 12.

Fifth Embodiment

Figure 9:
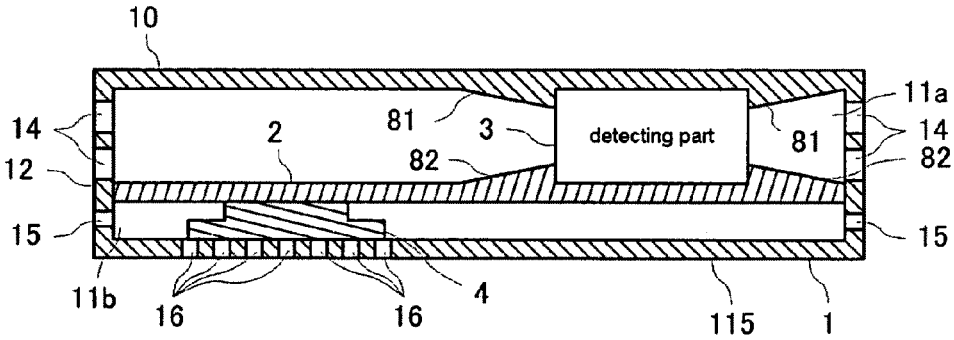
FIG. 9 is a diagrammatic sectional view showing the structure of a sensor according to the fifth embodiment of the present invention.

A sensor according to the fifth embodiment of the present invention is explained referring to the drawings. FIG. 9 is a diagrammatic sectional view showing the structure of the sensor according to this embodiment. In FIG. 9 the same members as those in FIG. 6 are allotted with the same reference numerals and their explanation is omitted.

The sensor of the present embodiment is designed such that tapered parts 81, 82 continuously elevated into the detecting part 3 are provided at the inner end face of the base part 10 opposite to the separating plate 2 and the face of the separating plate 2 where the detecting part 3 is provided, respectively, around the detecting part 3 in the first space 11*a*, as shown in FIG. 9. A flow-in part introducing the fluid flown from the opening 14 is constituted with the tapered parts 81, 82 and the fluid can be introduced in a highly sensitive area in the detecting part 3. Other structures are same as those in the third embodiment, and their explanation is to be referred to that of the first embodiment or the third embodiment and is omitted here.

The tapered part 81, constituting a flow-in part, provided for the base part 10 is elevated such that the distance to the attachment surface of the detecting part 3 from the separating plate 2 is continuously reduced into the setting area of the detecting part 3 from the area around the detecting part 3 and is outer circumference than the setting area of the detecting part 3. On the other hand, the tapered part 82 provided for the separating plate 2 is elevated such that the distance to the end face of the base part 10 is continuously reduced into the setting area of the detecting part 3 from the area which is around the detecting part 3 and is outer circumference than the setting area of the detecting part 3.

Accordingly, the height of the side wall 12 side of the first space 11*a* apart from the detecting part 3 in a perpendicular direction relative to the attachment surface can be increased, so that the opening 14 is widely opened. Namely, the flow path in the first space 11*a* can be wide on the side wall 12 side and the fluid from the outer environment is easily flown in the first space 11*a*. Then, the height of the first space 11*a* is reduced into the detecting part 3. Namely, the flow path of the fluid is narrowed into the detecting part 3 from the opening 14 and finally is limited to a highly sensitive area in the height direction of the detecting part 3. Therefore, the fluid flown into the first space 11*a* from the opening 14 can be introduced into the highly sensitive area in the detecting part 3.

The restriction to the flow path by the tapered parts 81, 82 becomes resistance relative to the fluid flow in the first space 11*a*, so that the tapered parts 81, 82 may be provided in the vicinity of the detecting part 3. When they are provided from an area close to the side wall 12, the elevation of the tapered parts 81, 82 may be designed to be gradually changed so as not to increase the resistance of the fluid flown into the detecting part 3 in the first space 11*a*.

Figure 10:
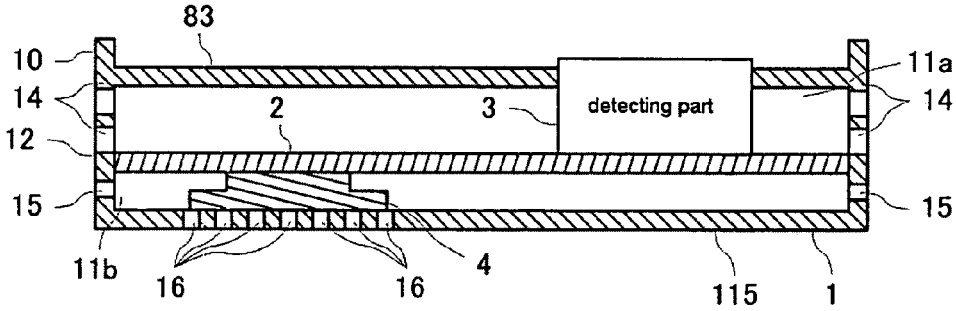
FIG. 10 is a diagrammatic sectional view showing another structure of a sensor according to the fifth embodiment of the present invention.

In other structure of the present embodiment, the fluid flown into the first space 11*a* from the opening 14 may be introduced into a highly sensitive area in the detecting part 3 as shown in the structure of FIG. 10. Namely, an end face part 83 parallel to the attachment surface of the base part 10 is concaved into the separating plate 2 from the connecting part with the attachment surface and the height, which is vertical to the attachment surface, of the entire first space 11*a* becomes the height of the highly sensitive area in the detecting part 3.

Further, when the first space 11*a* is designed as shown in FIG. 9 and FIG. 11, the center in the height direction of the flow path constituted with the first space 11*a* is preferably conformed to the center in the height direction in the highly sensitive area in the detecting part 3. In such a structure, the fluid can be introduced in the highly sensitive area in the detecting part 3 in the present embodiment, thereby improving fire detection ability.

In this embodiment, the sounding body 4 is designed to be eccentric to the center of the top panel 115 like the structure of the third embodiment, however, the sounding body 4 may be provided at the center of the top panel 115 like the second embodiment. In addition, the opening 15 may not be provided for the side wall 12 like the first embodiment. Further, the opening 18 may be provided at the connecting part of the separating plate 2 and the side wall 12 instead of the opening 15 for the side wall 12 like the fourth embodiment.

Further, in the second to fifth embodiments, the second space 11*b* may be provided on the base part 10 side in the housing 1 as explained in the first embodiment referring to FIG. 2. In such a case, as already explained referring to FIG. 2, the sound aperture 16 is provided for the base part 10 and a plurality of support members 17 are provided along the end face of the base part 10 on the attachment surface side. Further, the opening 14 is provided on the top panel 115 side of the side wall 12.

When the opening 15 is provided, it is formed on the base part 10 side of the side wall 12. Further, when the flowing part is provided, it is constituted in the first space 11*a*, so that the structure of the top panel 115 and the end face of the separating plate 2 on the top panel 115 side is designed like those shown in FIG. 9 or FIG. 10.

Sixth Embodiment

Figure 11A:
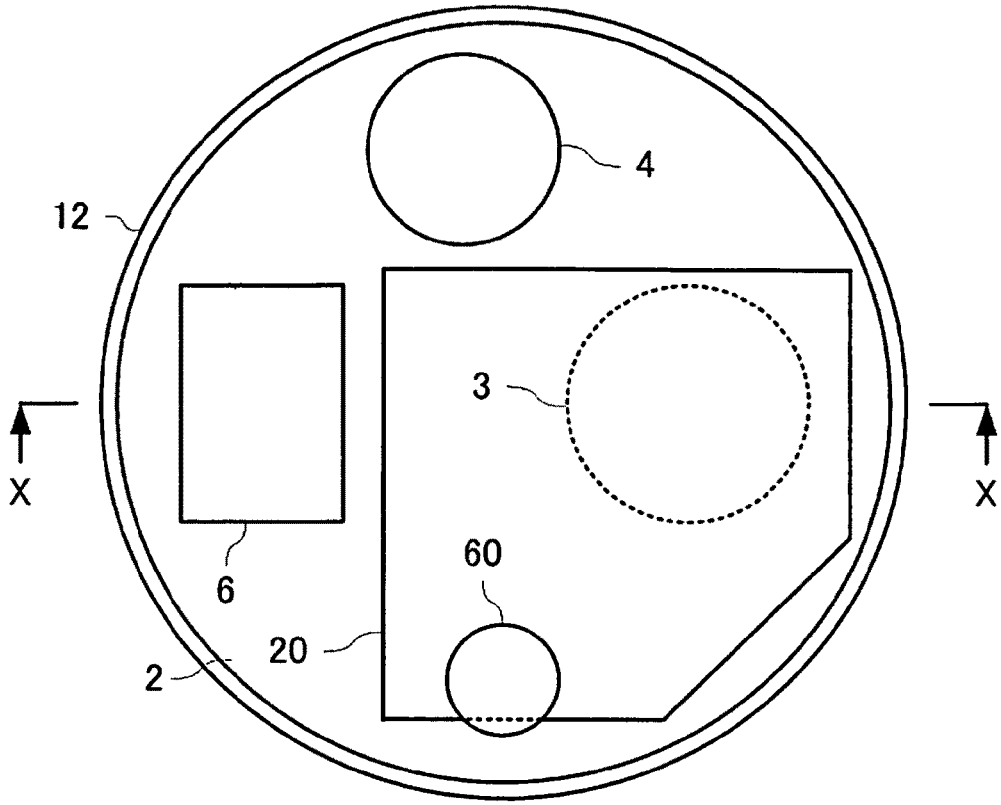
FIG. 11A is a diagrammatic plan view showing the alignment relation of each member in the housing of a sensor according to the sixth embodiment of the present invention.
Figure 11B:
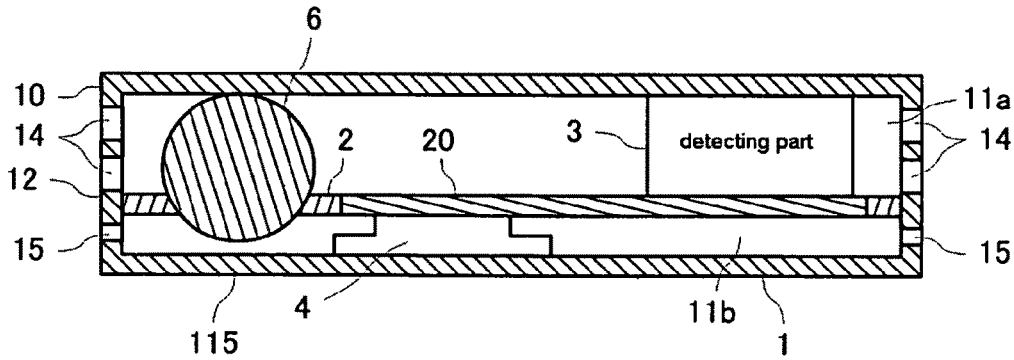
FIG. 11B is a diagrammatic sectional view along the line X-X direction in the plan view of FIG. 11A.

A sensor according to the sixth embodiment of the present invention is explained referring to the drawings. FIG. 11A is a diagrammatic plan view showing the internal structure of the sensor according to this embodiment and FIG. 11B is a diagrammatic sectional view along the line X-X direction in the plan view of FIG. 11A. The same members in this embodiment as those in the second embodiment are allotted with the same reference numerals and their explanation is omitted.

The sensor of this embodiment is designed such that a battery 6 which is a power source having a relatively large setting area in the apparatus, the detecting part 3, and the sounding body 4 are provided in a position which does not interfere each other. And the sensor has a circuit board 20 mounting the detecting part 3 (shown with broken line in FIG. 11A) on the surface thereof on the first space 11*a* side and an operation button 60 which is electrically connected to the circuit board 20 for receiving specific instructions. Other structures are same as those in the second embodiment, and their explanation is to be referred to that of the second embodiment and is omitted here.

Thus designed sensor is provided with a hole on the separating plate 2 to which the battery 6 and the circuit board 20 are inserted. When the battery 6 and the circuit board 20 are fitted into the hole, the first space 11*a* and the second space 11*b* separated relative to the height direction of the housing 1 are formed as shown in FIG. 11B. Namely, the circuit board 20 functions as the separating plate 2, when the battery 6 having substantially the same height as that of the housing 1 is provided, the area around the circuit board 20 and the battery 6 is not opened.

The occupied area with the battery 6 exists in the first space 11*a* and the second space 11*b*, respectively, as shown in FIG. 11B, and the sounding body 4 and the detecting part 3 are required to be positioned so as not to overlap the occupied area with the battery 6, respectively. Further, the battery 6 becomes an obstacle of the fluid flown into the first space 11*a* from the opening 14 into the detecting part 3. Therefore, the detecting part 3 is preferably positioned apart from the battery 6 so as to reduce the prevention of the fluid flow into the detecting part 3.

Accordingly, the detecting part 3, the sounding body 4, and the battery 6 are provided in different positions along the inner circumferential face of the side wall 12, respectively, as shown in FIG. 11A. The straight line connecting the center of the detecting part 3 and the center of the battery 6 passes around the center of the housing 1 such that the detecting part 3 is positioned apart from the battery 6 on the face parallel to the attachment surface and the detecting part 3 is positioned closer to the side wall 12 than the battery 6. Namely, the detecting part 3 and the battery 6 are positioned in the right area and the left area, respectively, divided along the center line passing the center of the housing 1 vertically in FIG. 11A. Accordingly, enough space is formed between the detecting part 3 and the battery 6, thereby reducing the ratio of preventing fluid flow into the detecting part 3.

The sounding body 4 is positioned at a place which is apart from the detecting part 3 and does not overlap with the battery 6 in order to reduce the influence on the detecting part 3 when the alarm is operated. When the sounding body 4 is provided at a place closer to the side wall 12 than the straight line connecting the center of the detecting part 3 and the center of the battery 6, the sounding body 4 can be positioned apart from either of the battery 6 or the detecting part 3. The sounding body 4 may be provided at the center of the housing 1 like the second embodiment when it does not overlap with the battery 6 on the face parallel to the attachment surface and its influence on the detecting part 3 is low.

The battery 6 is provided at a position which does not overlap with the detecting part 3 and the sounding body 4 on the face parallel to the attachment surface as shown in FIG. 11A, so that the size of the housing 1 in its height direction is determined by the heights of the detecting part 3 and the sounding body 4. Therefore, the height of the housing 1 is not to be added with the height of the battery 6, thereby achieving a thinner and smaller sensor.

The sensor of the present embodiment is provided with the battery 6 as shown in FIG. 11A and FIG. 11B, however, in case of the sensor which is operated by being supplied with the commercial power source as a power source, the sensor has an AC source member 61 including an AC/DC transducer for converting the AC commercial electricity into the DC power to supply into each electronic member incorporated therein. The AC source member 61 comprises a plurality of electronic members mounted on a circuit board 22 and a housing 1 covering these electronic members. The shape of the housing 1 covering the electronic members is shown in FIG. 12A, and FIG. 12B as the AC source member 61.

Figure 12A:
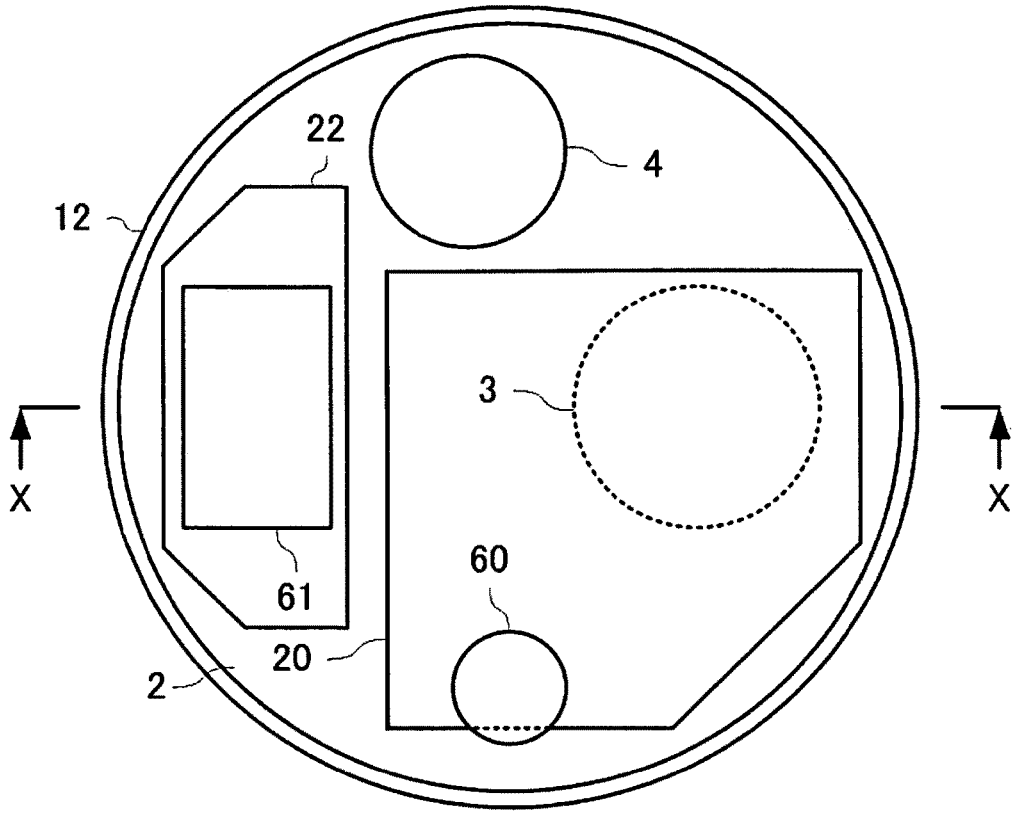
FIG. 12A is a diagrammatic plan view showing the alignment relation of each member in the housing of another structure of a sensor according to the sixth embodiment of the present invention.
Figure 12B:
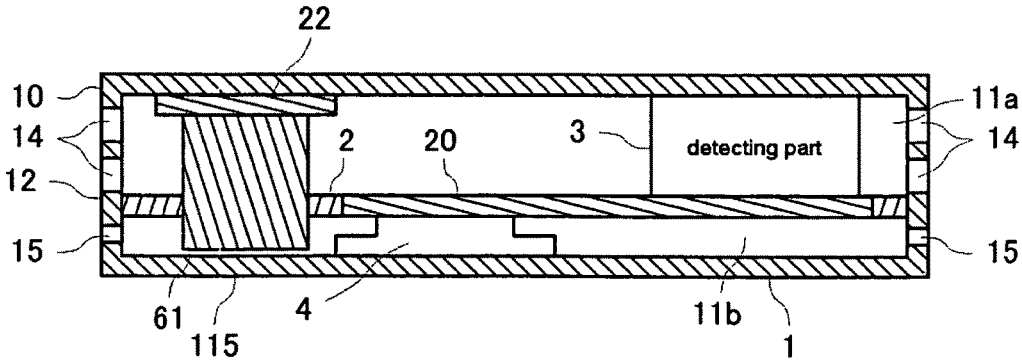
FIG. 12B is a diagrammatic sectional view along the line X-X direction of the plan view in FIG. 12A.

When the AC source member 61 is provided as shown in FIG. 12A and its setting position is same as the battery 6 in FIG. 11A, the relation of setting positions of the detecting part 3 and the sounding body 4 on the face parallel to the attachment surface is same as that of the battery 6, the detecting part 3 and the sounding body 4 in FIG. 11A. In addition the AC source member 61 mounted on the circuit board 22 provided on the base part 10 is fitted to the separating plate 2 and is projected into the second space 11*b*. Accordingly, the structure in FIG. 12A and FIG. 12B has the same effect as that in FIG. 11A and FIG. 11B.

In this embodiment, the separating plate 2 itself may be constituted with the circuit board 20. In such a case, the separating plate 2 and the circuit board 20 are not formed separately, thereby reducing the number of members and simplifying the operation procedure. Further, in the first to the fifth embodiments, the separating plate 2 may be constituted with the circuit board 20.

Seventh Embodiment

Figure 13:
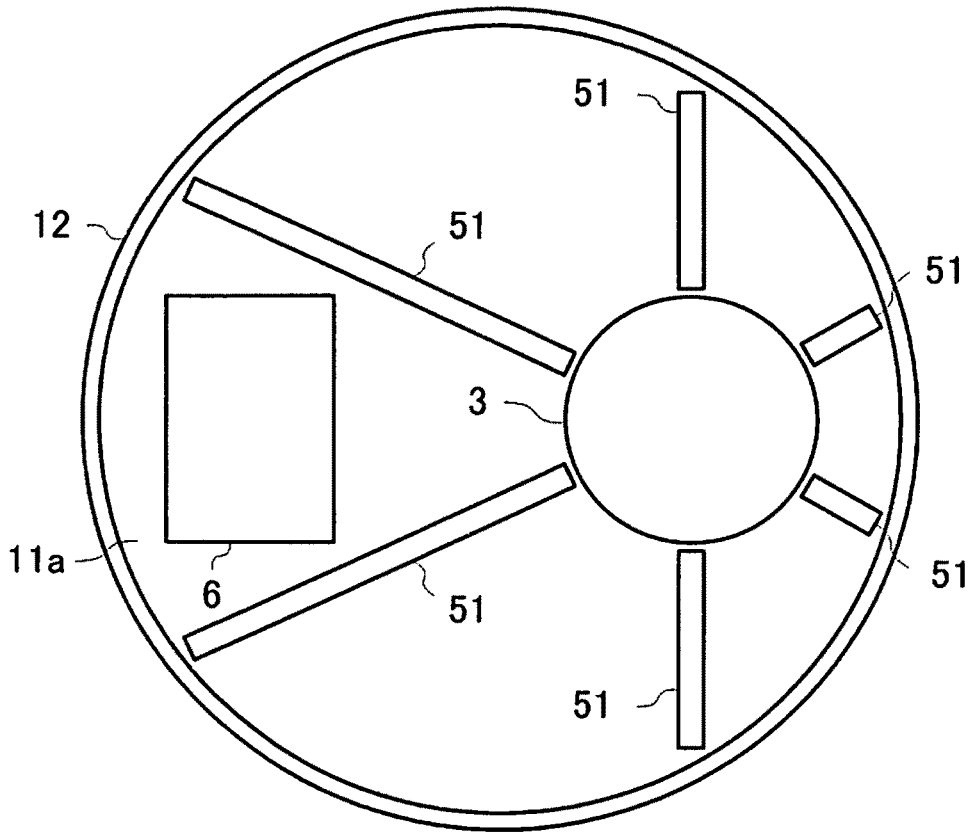
FIG. 13 is a diagrammatic plan view showing the structure of a sensor according to the seventh embodiment of the present invention.

A sensor according to the seventh embodiment of the present invention is explained referring to the drawings. FIG. 13 is a diagrammatic plan view showing the structure in the first space of the sensor according to this embodiment. In FIG. 13 the same members as those in FIG. 11A and FIG. 11B are allotted with the same reference numerals and their explanation is omitted.

The sensor of this embodiment has a guide wall 51 for guiding the fluid flown from the opening 14 of the side wall 12 into the detecting part 3 in the first space 11*a* having the detecting part 3 as shown in FIG. 13. Other structures are same as those in the sixth embodiment, their explanation is to be referred to that of the sixth embodiment and is omitted here.

The guide wall 51 is provided with a space along the outer circumference of the detecting part 3 and its longitudinal direction extends to the opening 14 of the side wall 12 from the outer circumference of the detecting part 3. A plurality of guide walls 51 are radially formed around the detecting part 3 in FIG. 13, however, the guide wall 51 may be formed otherwise as far as it forms a flow path from the opening 14 to the detecting part 3 in the first space 11*a*. For example, when the detecting part 3 is constituted as an optical smoke detecting part, the guide wall 51 may be provided in a direction extended from the base end of a labyrinth wall provided along the outer circumferential end of the detecting part 2, or may be crooked in the longitudinal direction.

Two of the guide walls 5 provided in the area from the detecting part 3 to the battery 6 in the first space 11*a* are arranged so as to interpose the battery 6 which is an obstacle of the fluid flow therebetween. When the AC source member 61 is provided instead of the battery 6 as shown in FIG. 12A and FIG. 12B of the fifth embodiment, the guide walls 51 are arranged so as to interpose the AC source member 61.

When the guide walls 51 are provided so as to interpose the battery 6 or the AC source member 61 which are obstacles, the fluid flowing from the vicinity of the battery 6 or the AC source member 61 can be guided to the detecting part 3 by the guide walls 51. Therefore, even in an area having an obstacle around the opening 14, the fluid can effectively flow into the detecting part 3 and the detection ability in the detecting part 3 can be improved.

In the sixth embodiment and the seventh embodiment, the opening 15 may not be provided on the side wall 12 as described in the first embodiment (refer to FIG. 1), or the opening 18 may be formed on the connecting part of the separating plate 20 and the side wall 12 instead of the opening 15 of the side wall 12 like the forth embodiment (refer to FIG. 8). Or the second space 11*b* may be provided on the base part 10 side of the housing 1 as explained in the first embodiment referring to FIG. 2. In addition, the section of the flow path in the height direction of the first space 11*a* may be designed to be small so as to guide the fluid to the highly sensitive area of the detecting part 3 like the fifth embodiment (refer to FIG. 9 and FIG. 10).

Eighth Embodiment

Figure 14:
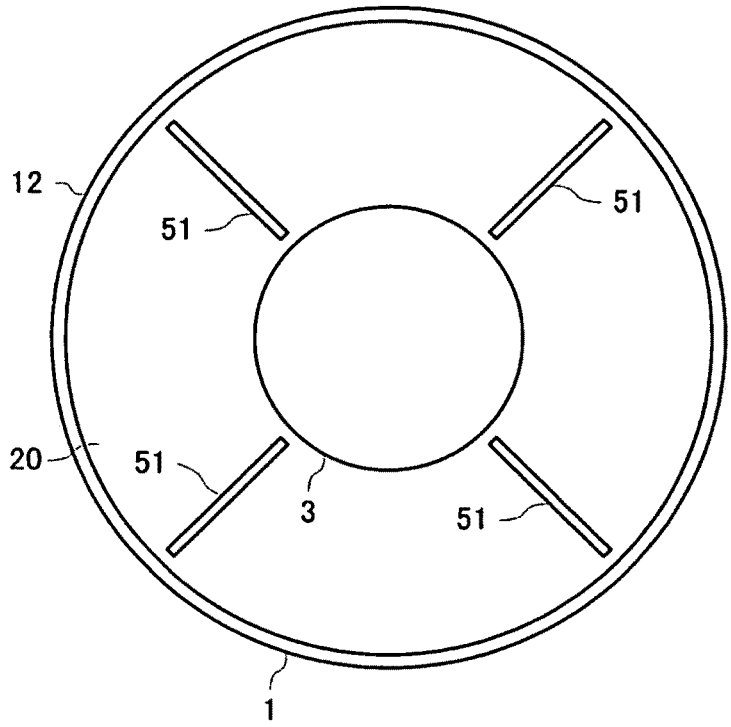
FIG. 14 is a diagrammatic plan view showing the structure of a sensor according to the eighth embodiment of the present invention.

A sensor according to the eighth embodiment of the present invention is explained referring to the drawings. FIG. 14 is a diagrammatic sectional view of the space including the detecting part in the housing, showing the structure of the sensor of this embodiment.

The sensor of this embodiment has the detecting part 3 for measuring the environmental value when the fluid in the circumference environment (outer environment) out of the housing 1 flows in and the detecting part 3 is provided at the center of the housing 1 as shown in FIG. 14. The side wall 12 surrounding the periphery of the housing 1 has the opening 14 as mentioned later referring to the structure shown in the sectional views of FIG. 16 and FIG. 17 and the fluid flowing in the outer environment at the peripheral side of the side wall 12 flows in the housing 1 from the opening 14.

When the detecting part 3 is provided at the center of the housing 1 relative to the face parallel to the attachment surface of the sensor, a plurality of guide walls 51 of which both ends are provided in the vicinity of the detecting part 3 and the side wall 12, respectively, are provided as guide members for guiding the fluid into the detecting part 3. Namely, four guide walls 51 radially formed around the detecting part 3 are provided at the peripheral side of the detecting part 3 and along the inner circumferential side of the side wall 12.

The space surrounded with the side wall 12 in the detecting part 3 is divided by these guide walls 51 and each divided space functions as a fluid path guiding the fluid from the opening 14 of the side wall 12, mentioned later, to the detecting part 3. The section of the fluid path of each space divided by the guide wall 51 along the circumferential direction of the housing 1 is narrowed into the detecting part 3 from the opening 14.

The fluid flown from the opening 14 to be mentioned later is restricted to flow into the detecting part 3, so that the fluid amount to be supplied to the detecting part 3 in the housing 1 becomes enough for measurement. Therefore, even if the detecting part 3 is provided in the housing 1, deterioration of the measuring sensitivity and the response speed of the fluid caused by the detecting part 3 can be refrained, thereby keeping the ability of sensor.

Four guide walls 51 are provided in the housing 1 for constituting the flow path for forcibly guiding the fluid into the detecting part 3 in FIG. 14, however, the number of the guide walls 51 may be more than 1 as far as the guide wall 51 constitutes a flow path having function of guiding the fluid to the detecting part 3. For example, when the sensor is mounted on the wall as a fire alarm for measuring a thermal current as an object, the thermal current becomes a flow into one direction from the floor to the ceiling along the wall. In such a case, one or two guide walls 51 may be provided at only the floor side of the detecting part 3 in such a manner that the thermal current in one direction is further concentrated into the detecting part 3 in the housing 1.

According to such a structure, the both ends of the guide wall 51 are arranged in the vicinity of the outer circumferential face of the detecting part 3 and the inner circumferential face of the side wall 12, respectively, with a space without being connected each other as shown in FIG. 14. Or only the end of the guide wall 51 at the detecting part 3 side may be connected to the outer circumferential face of the detecting part 3 as shown in FIG. 15A, or the end of the guide wall 51 on the side wall 12 side may be connected to the inner circumferential face of the side wall 12 as shown in FIG. 15B.

Figure 15A:
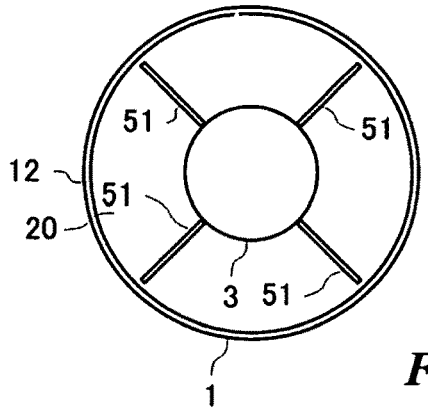
FIG. 15A is a diagrammatic plan view showing another structure of a sensor according to the eighth embodiment of the present invention.
Figure 15B:
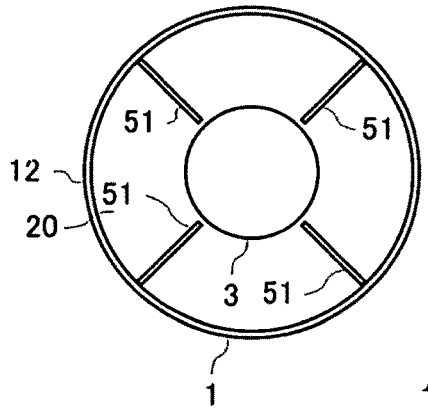
FIG. 15B is a diagrammatic plan view showing another structure of a sensor according to the eighth embodiment of the present invention.
Figure 15C:
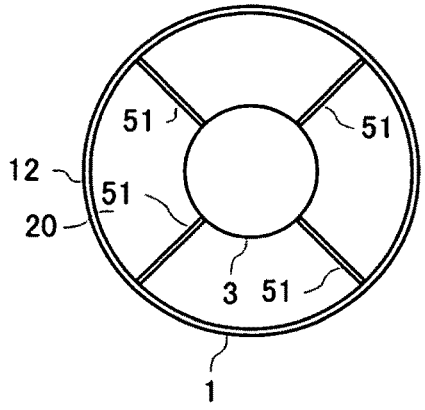
FIG. 15C is a diagrammatic plan view showing another structure of a sensor according to the eighth embodiment of the present invention.

When the end of the guide wall 51 is connected to the outer circumferential face of the detecting part 3 or the inner circumferential face of the side wall 12 as shown in FIG. 15A or FIG. 15B, the fluid guided by the flow path formed with the guide wall 51 is prevented from leaking out of the flow path. Further, the both ends of the guide wall 51 may be connected to the outer circumferential face of the detecting part 3 and the inner circumferential face of the side wall 12, respectively, in order to ensure guiding of the fluid with the guide wall 51 as shown in FIG. 15C.

1. Application Example to Smoke Detecting Type Fire Alarm

Figure 16:
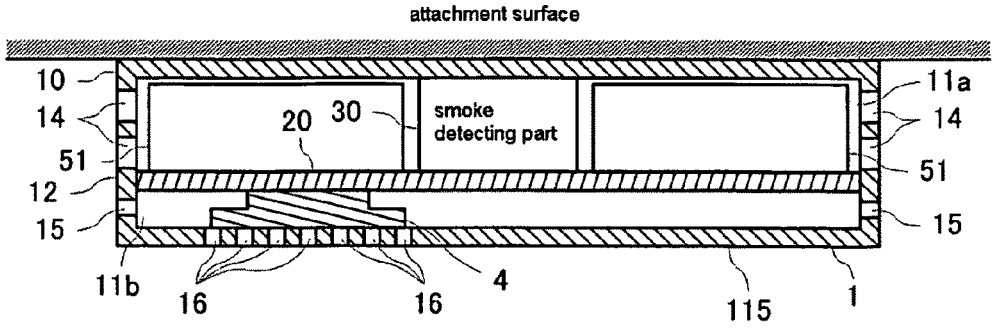
FIG. 16 is a diagrammatic sectional view showing the structure of a smoke detecting type fire alarm applied with the sensor according to the eighth embodiment of the present invention.
Figure 17:
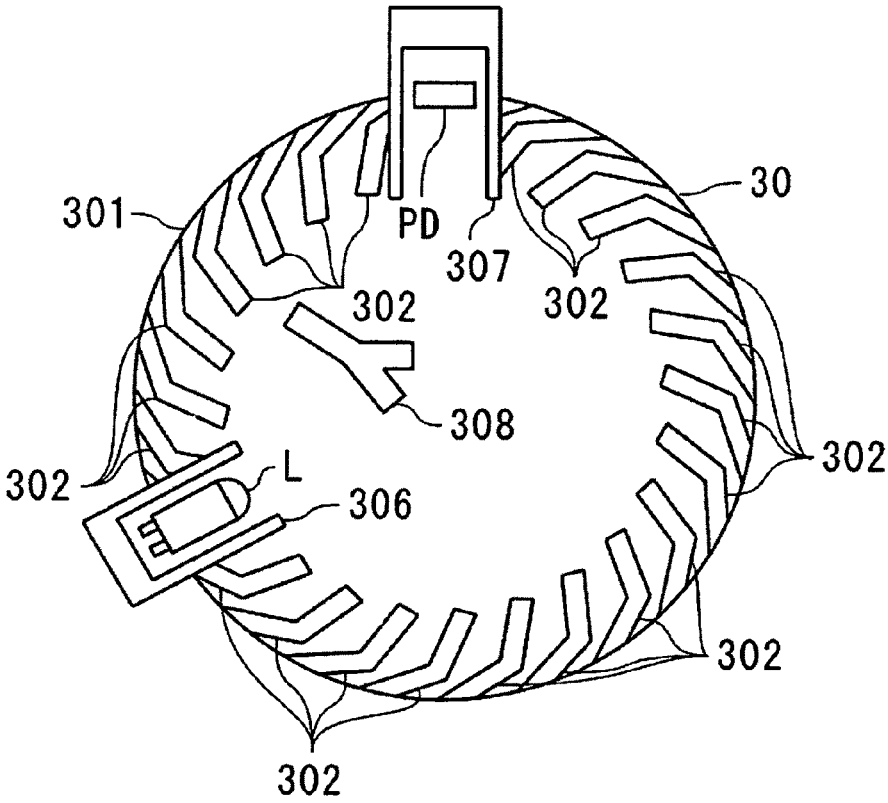
FIG. 17 is a diagrammatic plan view showing the structure of the smoke detecting part provided with the fire alarm of FIG. 16.

The detailed structure when the sensor shown in FIG. 14 is used for a smoke detecting type fire alarm including an optical smoke detecting part as the detecting part 3 is explained referring to FIG. 16 and FIG. 17. FIG. 16 is a diagrammatic sectional view showing the structure of the fire alarm of this embodiment and FIG. 17 is a diagrammatic plan view showing the structure of the smoke detecting part mounted for the fire alarm of FIG. 16.

The fire alarm in FIG. 16 has the base part 10 by which the housing 1 is provided on the attachment surface, the ring-like side wall 12 projected into a direction apart from the attachment surface from the outer circumference of the base part 10 and the top panel 115 like a disk covering the end opposite to the end of the side wall 12 covered with the base part 10. The circuit board 20 is mounted with a smoke detecting part 30 and is electrically connected to the sounding body 4. When the outer circumferential end of the base board 20 is connected to the inner circumferential face of the side wall 12, the first space 11*a* and the second space 11*b* are formed in the housing 1. Circuit element members including a controller are mounted other than the smoke detecting part 30 and the sounding body 4 and a circuit for controlling the function as a fire alarm is constituted.

The smoke detecting part 30 is provided in the first space 11*a* and the sounding body 4 is provided in the second space 11*b*, namely the smoke detecting part 30 and the sounding body 4 are provided in a separate space divided in the housing 1. The first space 11*a* is constituted as a detection space in which the fluid to be measured in the smoke detecting part 30, namely a smoke flow, flows. The smoke flow flown in the first space 11*a* is required to be guided into the smoke detecting part 30 in the first space 11*a*, so that the guide wall 51 explained referring to FIG. 14 is provided in the first space 11*a*.

Further, the smoke detecting part 30 is positioned at the center of the base part 10 on the face parallel to the attachment surface in the first space 11*a*, so that the sounding body 4 is preferably set close to the side wall 12 than the smoke detecting part 30 in the second space 11*b* as shown in FIG. 16. Namely, when the smoke detecting part 30 and the sounding body 4 are positioned so as not to be overlapped relative to the face parallel to the attachment surface, the effect of the vibration on the smoke detecting part 30 when the sounding body 4 is operated can be inhibited.

The side wall 12 has the opening 14 in the area covering the first space 11*a* and has the opening 15 in the area covering the second space 11*b*. Further, a plurality of sound apertures 16 are provided on the top panel 115 corresponding to the area provided with the sounding body 4. Namely, the first space 11*a* is opened to the outer environment out of the housing 1 by the opening 14, on the other hand, the second space 11*b* is opened to the outer environment out of the housing 1 by the opening 15 and the sound apertures 16.

Accordingly, the fluid can be introduced in the housing 1 from the outer environment via the opening 14 to be supplied to the smoke detecting part 30. The guide wall 51 is provided between the opening 14 and the smoke detecting part 30, so that a plurality of flow paths are formed in the area between the smoke detecting part 30 and the side wall 12 in the first space 11*a*. According to such a structure, the smoke flow flown in the first space 11*a* from the opening 14 flows in the flow path constituted with the guide wall 51 and is guided to the smoke detecting part 30.

On the other hand, the air resistance in the rear air chamber having the sounding body 4 can be reduced by the opening 15 and the sound apertures 16. Namely, the resistance to the front face of the sounding body 4 (face opposite to the top panel 115) is reduced by the sounding apertures 16, on the other hand, the air resistance in the second space 11*b* is reduced by the opening 15 when the air other than the front face of the sounding body 4 in the second space 11*b* is vibrated. Therefore, the reduction of alarm volume of the sounding body 4 can be prevented.

The openings 14, 15 may be provided all around the side wall 12 or may be partially provided in the circumferential direction of the side wall 12. When they are partially provided and the opening 14 is positioned where the side wall 12 blocks the fluid flowing in the outer environment, the fluid can be supplied in the housing 1 without interrupting the flow in the outer environment.

Further, when the second space 11*b* has an enough volume, the opening 15 is not required to be formed in the side wall 12 and the side wall 12 has only the opening 14. In addition, the side wall 12 may have only the opening 14, a space may be provided between the circuit board 20 and the side wall 12, thus the second space 11*b* is opened to the outer environment as will be explained in the embodiment of heat detecting type fire alarm shown in FIG. 18.

The structure of the smoke detecting part 30 incorporated in a smoke detection type fire alarm as shown in FIG. 16 is briefly explained referring to FIG. 17. The smoke detecting part 30 has an optical chamber constituted with a plurality of labyrinth walls 302 provided along the external circumference of the bottom plate 301 being an optical base as shown in FIG. 17. The optical chamber thus constituted with the labyrinth walls 302 has containing parts 306, 307 for a light emitting diode L and a photo diode PD, respectively, which are electrically connected to the circuit board 20 and a light shielding wall 308 for preventing the light radiated from the light emitting diode L from directly entering into the photodiode PD.

The labyrinth wall 302 is bent like the letter "L" of which section parallel to the base plate 301 is extended in a vertical direction relative to the base plate 301 as shown in the plan view in FIG. 17. Thus the light from the outside of the base end of the labyrinth wall 302 is prevented from entering and the space formed such that the inner tip ends of the labyrinth walls 302 are intermittently arranged can be constituted as the optical chamber for smoke detection. The labyrinth walls 302 adjacent in the circumferential direction are provided with a space therebetween, so that the smoke from the outside passes through the path formed by the space between the labyrinth walls 302 to be guided into the optical chamber at the tip end of the labyrinth walls 302.

The containing parts 306, 307 arranged in substantially concentric manner with the labyrinth walls 302 are opened to the inner optical chamber, respectively, and the section parallel to the bottom plate 301 is formed like the letter "U". Namely, the light emitting diode L is arranged so as to face its light emitting part to the inside of the optical chamber and the opening of the containing part 306 is positioned inside of the light emitting part of the light emitting diode L, so that the light from the light emitting diode L is emitted into the light chamber. Also the photo diode PD is arranged so as to face its light receiving part to the inside of the optical chamber and the opening of the containing part 307 is positioned inside of the light receiving part of the photo diode PD, so that the incident light caused by the scattered light in the optical chamber enters in the photo diode PD.

The light emitting diode L and the photo diode PD are positioned in such a manner that each optical axis crosses, without being parallel, on the plane parallel to the bottom plate 301. Each of the light emitting diode L and the photo diode PD is covered with the containing parts 306, 307 without its light emitting part and its light receiving part, respectively and a light shielding wall 308 like the letter "Y" diverged into the inside of the optical chamber is provided on the straight line connecting the light emitting diode L and the photo diode PD.

According to such constituted smoke detecting part 30, the smoke flow in the flow path formed by the guide wall 51 reaches the external circumference of the smoke detecting part 30, then it flows into the gap between the labyrinth walls 302. Therefore, when the smoke flow is guided in the smoke detecting part 30 via the flow path formed between the labyrinth walls 302, the optical chamber surrounded with the inner ends of the labyrinth walls 13 is filled with the smoke flow. The external circumferential face of the smoke detecting part 30 may be covered with insect screen constituted with an annular porous plate in order to prevent entering of insect and dust into the optical chamber surrounded with the labyrinth walls 302.

When the light from the light emitting diode L is radiated to the smoke flow filled in the optical chamber, the scattered light by the smoke flow to be measured is generated. When the photo diode PD receives thus generated scattered light, the electric signal depending on the received light amount relative to the scattered light is produced in the photo diode PD. Thus, the electric signal depending on the smoke amount entered in the smoke detecting chamber 30 is outputted and the smoke amount generated in the outer environment is measured. When the electric signal is supplied to a controlling part, not shown, mounted on the circuit board 20 and the smoke amount is determined to exceed a predetermined amount, an alarm is started from the sounding body 4 assuming fire is broken out.

2. Application Example to Heat Detecting Type Fire Alarm

Figure 18:
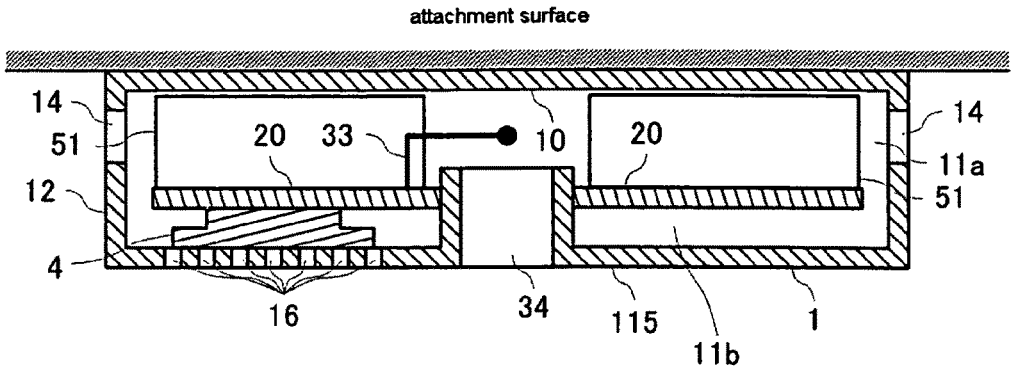
FIG. 18 is a diagrammatic sectional view showing the structure of a heat detecting type fire alarm applied with the sensor according to the eighth embodiment of the present invention.

Further, the detailed structure when the sensor shown in FIG. 14 is used for a heat detecting type fire alarm including a heat detecting element like a thermistor and a thermocouple as the detecting part 3 is explained referring to FIG. 18. FIG. 18 is a diagrammatic sectional view showing the structure of the fire alarm of this embodiment and the same members as those in FIG. 16 are allotted with the same reference numerals and their explanation is omitted.

In the fire alarm in FIG. 18, the space in the housing 1 constituted with the base part 10, the side wall 12 and the top panel 115 is divided by the circuit board 20 arranged so as to be parallel to the attachment surface, like the smoke detecting type fire alarm in FIG. 16. Namely, the first space 11*a* to have the thermistor 33 being a heat detecting element working as the detecting part 3 is formed at the base part 10 side and the second space 11*b* to have the sounding body 4 is formed at the top panel 115 side. Further, a flow path is formed from the opening 14 to the vicinity of the thermistor 33 in the first space 11*a* when the guide wall 51 is provided at the outer circumference side of the thermistor 33.

When only the opening 14 is provided for the side wall 12 and a gap is formed between the inner circumferential face of the side wall 12 and the outer circumferential edge of the circuit board 20, which is different from FIG. 16, the second space 11*b* is opened to the outer environment by the gap between the side wall 12 and the circuit board 20 and the opening 14. Thus, the air resistance in the second space 11*b* when the sounding body 4 is operated can be reduced.

If the effect on measurement of the thermistor 33 is not large, the opening may be provided at other place of the circuit board 20 instead of the gap between the circuit board 20 and the side wall 12 to open the second space 11*b*. Further, the gap between the circuit board 20 and the side wall 12 may be provided all around the side wall 12 or may be provided at a part in the circumferential direction of the side wall 12 like the embodiment in FIG. 16.

In addition, the circuit board 20 and the side wall 12 may be connected so as not to have a gap therebetween like the embodiment in FIG. 16. When the second space 11*b* has an enough volume, only the opening 14 may be provided for the side wall 12. Or when the opening 15 is provided for the side wall 12 where corresponding to the second space 11*b* like the embodiment in FIG. 16, the second space 11*b* may be opened to the outer environment so as to further reduce the air resistance.

The opening for detection 34 is provided at the center of the top panel 115 parallel to the attachment surface in order to inflow a thermal current from the vertical direction relative to the attachment surface. The opening for detection 34 forms a flow path extending in the vertical direction with respect to the attachment surface into the tip end of the thermistor 33 and the side wall forming the flow path penetrates a hole formed at the center of the circuit board 20. According to such a structure, the second space 11*b* is prevented from being opened to the first space 11*a* and to the external environment by the opening for detection 34.

Sound apertures 16 are provided for a part of the top panel 115 opposite to the sounding body 4 at the external circumferential side of the opening for detection 34. Namely, the sounding body 4 is provided at the external circumferential side of the side wall forming the flow path of the opening for detection 34 in the second space 11*b*. Thus, the sounding body 4 can be provided apart from the thermistor 33, so that the vibration effect of the operated sounding body 4 to the thermistor 33 in the first space 11*a* can be refrained.

The terminal of the thermistor 33 is electrically connected in the area outside of the opening for detection 34 of the circuit board 20 by means of solder and is formed like the letter "L" extending from the circuit board 20 to the attachment surface and then bending into the opening for detection 34. According to such a structure, the bent part of the thermistor 33 is positioned at the center of the opening 14 in the vertical direction relative to the attachment surface and the tip end of the thermistor 33 is positioned at the center of the opening for detection 34.

Thus, the tip end of the thermistor 33 being a sensing part for temperature measurement is positioned so as to be directly exposed to the thermal current from the opening 14 and the opening for detection 34, respectively. The side wall constituting the flow path of the opening for detection 34 is designed such that the tip end projected from the circuit board 20 into the vertical direction with respect to the attachment surface is positioned closer to the top panel 115 than the opening position of the opening 14 at the top panel 115. Namely, the side wall constituting the flow path of the opening 15 is formed to the position which does not interfere the thermal current from the opening 14 to the thermistor 33.

According to the fire alarm in FIG. 18, the thermal current becomes an ascending current, so that the thermal current from the floor to the ceiling flows in the housing 1 of the fire alarm from the opening for detection 34 when the attachment surface is the ceiling. When the thermal current is supplied in the first space 11*a* through the flow path formed by the opening for detection 34, the tip part of the thermistor 33 at the center of the opening 34 is exposed to the thermal current. Accordingly, the control circuit detects the temperature of the thermal current based on the electric signal of the thermistor 33, when the temperature is higher than a predetermined value, fire is detected and alarm operation of the sounding body 4 is started.

When the attachment surface of the fire alarm is a wall, the thermal current flows along the wall, namely the attachment surface, from the floor to the ceiling. The thermal current directly flows in the first space 11*a* in the housing 1 of the fire alarm from the opening 14. Then, the thermal current entered in the first space 11*a* is guided to the tip end of the thermistor 33 through the flow path constituted with the guide wall 51, thereby measuring the temperature of the thermal current by the thermistor 33.

A sensor constituting a smoke detection type fire alarm and a sensor constituting a heat detection type fire alarm are exemplified respectively as above, however, the fire alarm is not limited to them and can be used for a gas alarm for measuring the gas amount filled in the outer environment. In addition, unlike the above-mentioned embodiment in which the first space 11*a* including the detecting part 30 as the smoke sensor or the thermistor 33 is provided at the attachment surface side, the second space 11*b* having the sounding body 4 may be provided at the attachment surface side.

In such a case, a support member is provided at the end face of the base part 10 at the attachment surface side so as to be connected to the attachment surface with a space so as not to reduce the sound volume of the alarm from the sounding body 4. The support member is provided with a space along the external circumferential side from the sound aperture 16, so that the alarm sound reflected between the attachment surface and the base part 10 is designed to be able to be outputted to the external environment.

Ninth Embodiment

Figure 19:
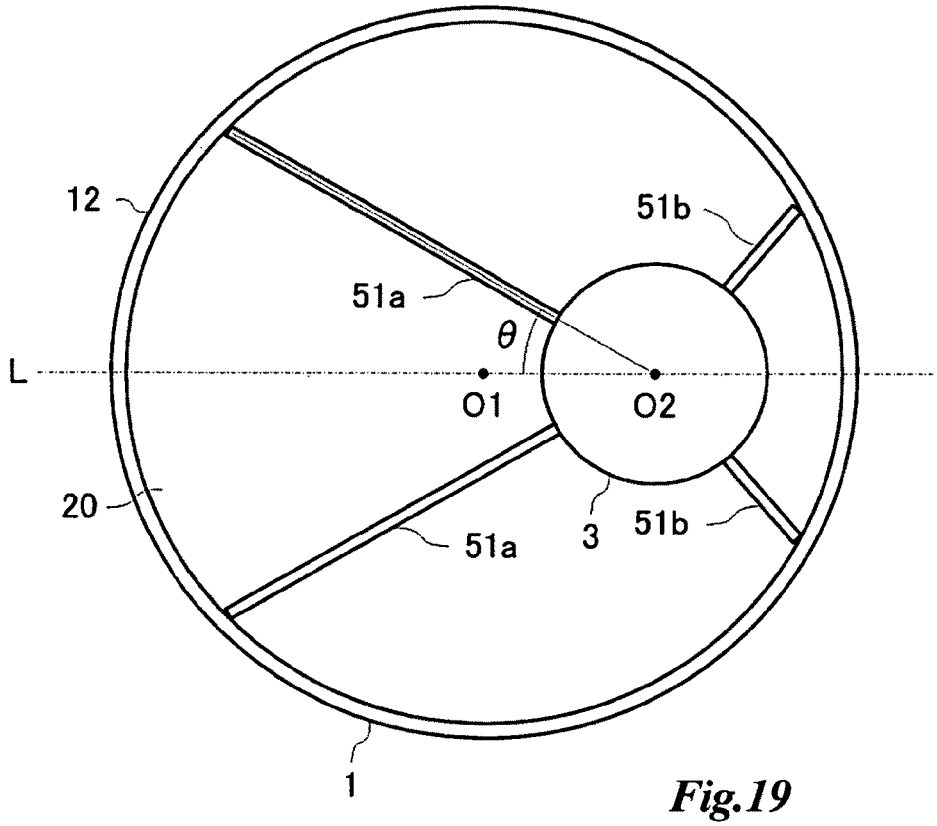
FIG. 19 is a diagrammatic plan view showing the structure of a sensor according to the ninth embodiment of the present invention.

A sensor according to the ninth embodiment of the present invention is explained referring to the drawings. FIG. 19 is a diagrammatic plan view of the space including the detecting part in the housing and shows the structure of the sensor of this embodiment. In FIG. 19 the same members as those in FIG. 14 are allotted with the same reference numerals and their detailed explanation is omitted.

According to the sensor of this embodiment, the detecting part 30 is provided at the wall 12 side and is arranged in an eccentric position from the center of the housing 1 on a plane parallel to the attachment surface. The length to the side wall 12 of the guide wall 51*a* provided close to the center of the housing 1 is larger than that of the guide wall 51*b* provided opposite to the center of the housing 1. Other structure is the same as that of the eighth embodiment, so their detailed explanation is to be referred to the eighth embodiment and is omitted here.

The structure and function of the guide walls 51*a*, 51*b*, which are characteristics of the present embodiment, are explained hereinafter. The straight line connecting the center of the housing 1 and the center of the detecting part 3 on a plane parallel to the attachment surface is shown with a dotted line "L" in each drawing including FIG. 19 and is called as the "center line L" hereinafter. The center of the housing 1 and the center of the detecting part 3 on a plane parallel to the attachment surface are called as "O1" and "O2", respectively.

The detecting part 3 is positioned in eccentric position relative to the center O1 of the housing 1, so that the area closer the center O1 than the detecting part 3 side in the housing becomes wide as shown in FIG. 19. Therefore, the area of the opening 14 of the side wall 12 which is provided close to the center O1 of the housing than the detecting part 3 (FIG. 16, FIG. 18) becomes larger and the flow amount into the housing 1 is increased.

When the fluid into the housing 1 flows from the center O1 of the housing 1 into the center O2 of the detecting part 3, the fluid from the opening 14 which is apart from the center line L is going to turn aside the detecting part 3. In such a case, when the guide wall 51*a* provided closer to the center O1 of the housing 1 than the detecting part 3 is arranged in such a manner that the crossing angle θ with the center line L in the longitudinal direction becomes smaller than 90 degrees, the fluid which is apt to turn aside the detecting part 3 can go into the guide wall 51*a*.

Accordingly, the fluid gone into the guide wall 51*a* flows in the direction where the guide wall 51*a* is provided, so that the fluid flown into the center O2 of the detecting part 3 from the center O1 of the housing 1 can be guided to the detecting part 3 by the flow path formed with the guide wall 51*a* provided close to the center O1 of the housing 1 than the detecting part 3. When such a guide wall 51*a* is provided, much fluid flown from a wide opening area formed with the opening 14 of the side wall 12 provided closer to the center O1 of the housing 1 than the detecting part 3 can be positively guided to the detecting part 3 by the flow path formed with the guide wall 51*a*.

On the other hand, when the fluid entered in the housing 1 flows into the center O1 of the housing 1 from the center O2 of the detecting part 3, the detecting part 3 is provided near the side wall 12, so that the fluid from the opening 14 of the side wall 12 flows into the detecting part 3. The guide wall 51*b* provided at opposite side to the center O1 of the housing 1 with respect to the detecting part 3 may be a plurality of guide walls 51*b* provided in an open direction around the center line L like the guide wall 51*a* as shown in FIG. 19 or may be a guide wall 51*b* whose longitudinal direction is formed along the center line L.

When the fluid flows in a vertical direction relative to the center line L, the fluid to be flown along the guide wall 51*a* after being gone into the guide wall 51*a* among the fluid from the opening 14 of the side wall 12 is apt to turn aside the detecting part 3 and flow outside of the housing 1 from the opening 14 of the side wall 12. In such a case, when the guide wall 51*b* is provided at an area opposite to the center O1 of the housing 1 relative to the detecting part 3, the flow of the fluid into the opening 14 of the side wall 12 along the guide wall 51*a* can be blocked off.

In this case, when the guide wall 51*b* is provided in an opened direction around the center line L like the guide wall 51*a*, the fluid flow gone into the guide wall 51*b* can become the flow along the guide wall 51*b*. Accordingly, the fluid flowing in the vertical direction relative to the center line L can be positively guided to the detecting part 3 by the flow path formed with the guide wall 51*a* and the guide wall 51*b*.

The fluid flowing in parallel direction to the center line L and the fluid flowing in the vertical direction relative to the center line L are exemplified, however, the guide wall 51*a* and the guide wall 51*b* can effectively work on the fluid flowing in a direction other than vertical to the center line L and the fluid can be positively guided into the detecting part 3. Specifically, when the guide wall 51*b* is provided as shown in FIG. 19, the fluid flown in parallel direction to the providing direction of the guide wall 51*a* can be positively guided into the detecting part 3 not only by the flow path by two guide walls 51*a* but also by the flow path formed with the guide wall 51*a* and the guide wall 51*b*.

Thus formed sensor of this embodiment can be used as a smoke detection type or heat detection type fire alarm having the detecting part 3 as a smoke detecting part or a heat detecting element or a gas alarm for measuring gas amount as shown in the eighth embodiment. In case of a fire alarm in FIG. 16 or FIG. 18, the smoke detecting part 30 (refer to FIG. 16) or the thermistor 33 (refer to FIG. 18) is provided together with the guide walls 51*a*, 51*b* in the first space 11*a* (refer to FIG. 16 and FIG. 18). This embodiment is different from the eighth embodiment in that the smoke detecting part 30 (refer to FIG. 16) or the thermistor 33 (refer to FIG. 5) is positioned eccentric to the center of the base part 10 (refer to FIG. 16 and FIG. 18) parallel to the attachment surface.

In addition, the sounding body 4 (refer to FIG. 16 and FIG. 18) provided in the second space 11*b* (refer to FIG. 16 and FIG. 18) is provided so as not to overlap with the smoke detecting part 30 (refer to FIG. 16) or the thermistor 33 (refer to FIG. 18) on the face parallel to the attachment surface. The sounding body (refer to FIG. 16 and FIG. 18) may be provided at the center of the top panel 115 (refer to FIG. 16 and FIG. 18) parallel to the attachment surface or may be at eccentric to the center of the top panel 115 (refer to FIG. 16 and FIG. 18).

Tenth Embodiment

Figure 20:
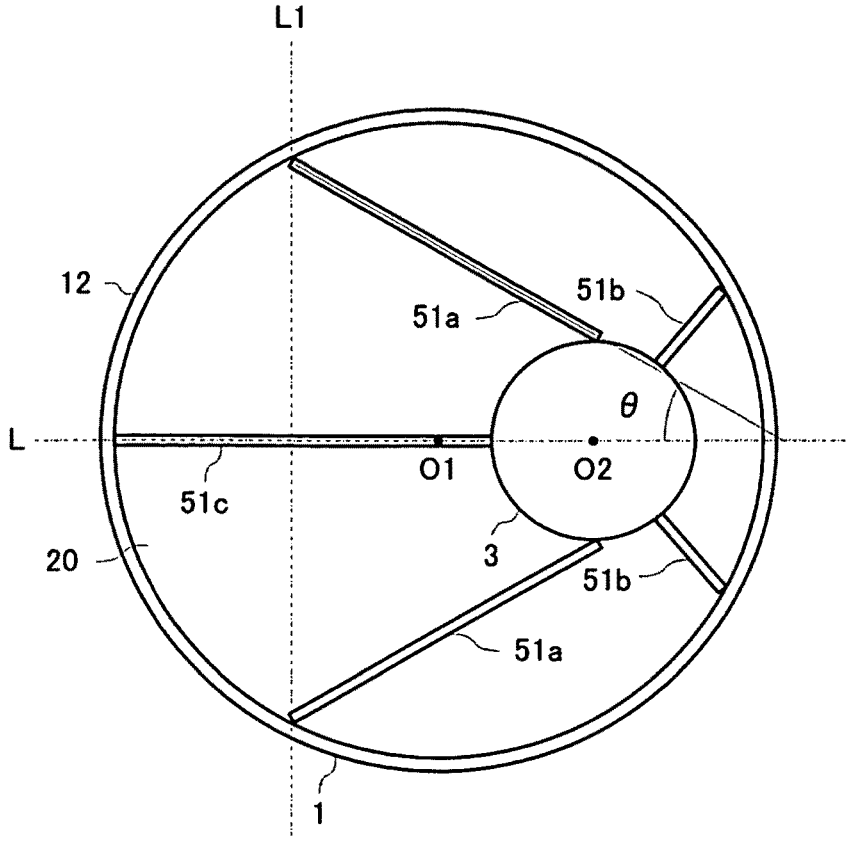
FIG. 20 is a diagrammatic plan view showing the structure of a sensor according to the tenth embodiment of the present invention.

A sensor according to the tenth embodiment of the present invention is explained referring to the drawings. FIG. 20 is a diagrammatic plan view of the space including the detecting part in the housing and shows the structure of the sensor of this embodiment. In FIG. 19 the same members as those in FIG. 20 are allotted with the same reference numerals and their detailed explanation is omitted.

The sensor of the present embodiment has a guide wall 51*c* of which longitudinal direction is along the center line L between the guide walls 51*a* in addition to the sensor of the ninth embodiment (refer to FIG. 19). Namely, the guide wall 51*c* having an angle θ formed by crossing the extended line in its longitudinal direction and the extended line in the longitudinal direction of the guide wall 51*a* is provided in the area closer to the center O1 of the housing 1 than the detecting part 3. Other structures are same as those in the ninth embodiment, their explanation is to be referred to that of the eighth embodiment and the ninth embodiment and their explanation is omitted here.

As explained in the ninth embodiment, the fluid entering in the area closer to the center O1 of the housing 1 than the detecting part 3 can be guided to the detecting part 3 when the guide wall 51*a* is provided. When the guide wall 51*c* is further provided, the guiding effect of the fluid into the detecting part 3 is improved. Namely, the guiding effect on the fluid into the detecting part 3 is given in the area which is not affected by the guide wall 51*a* in the area closer to the center O1 of the housing than the detecting part 3 when the guide wall 51*c* is provided. The function of the guide wall 51*c* on the fluid in the housing 1 is explained hereinafter including the relation to the guide wall 51*a*.

When the fluid flows in the direction having some angle relative to the center line L, the area closer to the center O1 of the housing 1 than the detecting part 30 becomes larger, so that when the fluid flows from the opening 14 of the side wall 12 (refer to FIG. 16 and FIG. 18) provided in the larger area, there exists fluid turned aside the guide wall 51*a*. Typical embodiment is that when the fluid flows in the vertical direction to the center line L, if the fluid enters from the opening 14 of the side wall 12 in the area opposite to the detecting part 3 relative to the straight line L1 connecting the connected parts of the guide walls 51*a* with the side walls 12, the fluid does not go into the guide wall 51*a*.

Accordingly, in the structure of the ninth embodiment (refer to FIG. 19), the fluid flown from the vertical direction relative to the center line L in the area opposite to the detecting part 3 relative to the center line L1 is not guided to the detecting part 3 by the guide wall 51*a*. Accordingly, such a fluid flows into the outer environment from the opening 14 of the side wall 12 again. In contrast, because the guide wall 51*c* is provided, the fluid which is going to turn aside the guide wall 51*a* to be flown goes into the guide wall 51*c* in the present invention. Therefore, the guide wall 51*c* functions to block the fluid flow into the outer environment from the opening 14 of the side wall 12 while turning aside the guide wall 51*a*, as the result, the blocked fluid flows into the detecting part 3 along the guide wall 51*c*.

The area opposite to the center O1 of the housing 1 relative to the detecting part 3 becomes smaller than the area around the center O1 of the housing 1 relative to the detecting part 3, so that it may only include the guide wall 51*b* like the ninth embodiment or may include the guide wall 51*b* which has the relation with the guide walls 51*a*, 51*c* like this embodiment. In addition, in the present embodiment, the sensor can be used as a smoke detection type or heat detection type fire alarm having the detecting part 3 as a smoke detecting part or a heat detecting element or a gas alarm for measuring gas amount as shown in the eighth embodiment. Therefore, when it is used for the fire alarm in FIG. 16 or FIG. 18, the guide walls 51*a*-51*c* are provided in the first space 11*a* (refer to FIG. 16 and FIG. 18).

Eleventh Embodiment

Figure 21:
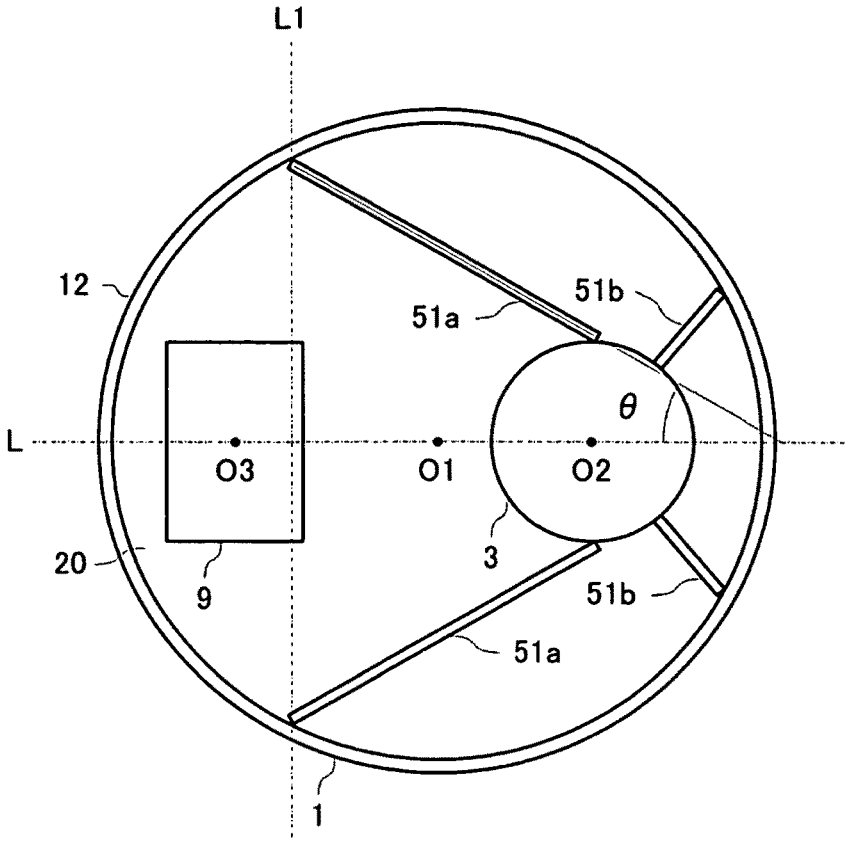
FIG. 21 is a diagrammatic plan view showing the structure of a sensor according to the eleventh embodiment of the present invention.

A sensor according to the eleventh embodiment of the present invention is explained referring to the drawings. FIG. 21 is a diagrammatic plan view of the space including the detecting part in the housing and shows the structure of the sensor of this embodiment. In FIG. 21 the same members as those in FIG. 19 are allotted with the same reference numerals and their detailed explanation is omitted.

As shown in FIG. 21, the sensor in this embodiment is designed such that a structure 9 being an obstacle for blocking the fluid flow in the housing 1 is further provided between the guide walls 51*a* in the sensor of the ninth embodiment (refer to FIG. 19). Other structures are same as those in the ninth embodiment, their explanation is to be referred to that of the eighth embodiment and the ninth embodiment and their explanation is omitted here.

The structure 9 constituted with a battery, an A/C source circuit, and the like is large in the height direction of the housing 1, so that it is provided in the space where the detecting part 30 is provided (the first space 11*a* in FIG. 16 and FIG. 18). In this case, the structure 9 is provided in the housing 1 in such a manner that its center is positioned on the center line L with respect to the face parallel to the attachment surface in order to reduce the effect of the structure 9.

In this embodiment, the structure 9 and the guide wall 51*a* are positioned in such a manner that the crossing angle of the straight line connecting the center O2 of the detecting part 3 and the center O3 of the structure 9 (it conforms with the center line L in FIG. 21, however, it is not limited to such line) and the extended line of the guide wall 51*a* in the longitudinal direction becomes θ in the area closer to the center O1 of the housing 1 than the detecting part 3. In addition, the structure 9 is positioned such that its longitudinal direction becomes vertical to the center line L. Accordingly, the structure 9 can be set in the area opposite to the detecting part 3 relative to the straight line L1 connecting the side walls 12 of the guide walls 51*a*. Namely, the structure 9 is provided in the area where the effect of the guide wall 51*a* is not effectively functioned.

As explained in the tenth embodiment, when the fluid flows in a direction having an angle relative to the center line L, the area closer to the center of the housing 1 than the detecting part 3 becomes large, so that when the fluid enters from the opening 14 of the side wall 12 (refer to FIG. 16 and FIG. 18) in such an area, there exists fluid flow turned aside the guide wall 51*a*. Therefore, the area opposite to the detecting part 3 relative to the straight line L1 becomes an area which has a little effect on the fluid flow efficiency into the detecting part 3 in the ninth embodiment (refer to FIG. 19). Therefore, if the structure 9 is provided in such an area, the blocking amount of fluid flowing into the detecting part 3 is relatively reduced.

The structure 9 is functioned as an obstacle for the fluid directing into the detecting part 3 from the opening 14 (refer to FIG. 16 and FIG. 18) of the side wall 12 which is opposite to the detecting part 3 relative to the structure 9. However, the structure 9 becomes an obstacle for the fluid flow to the detecting part 3. The fluid gown into the structure 9 is going around the structure, so that the fluid flow along the periphery of the structure 9 is formed. Therefore the fluid along the periphery of the structure 9 flows into the guide wall 51*a* after going around the structure 9. As the result, the fluid flowing into the detecting part 3, wherein the structure 9 becomes an obstacle, goes around the structure 9, goes into the guide wall 51*a*, then is guided to flow along the guide wall 51*a* into the detecting part 3. Thus, according to this embodiment, the fluid can be guided to the detecting part 3 by the guide wall 51*a* even if the structure 9 is provided.

This embodiment can be used as a smoke detection type or heat detection type fire alarm having the detecting part 3 as a smoke detecting part or a heat detecting element or a gas alarm for measuring gas amount like the eighth embodiment. The example wherein the sensor of this embodiment is applied to a smoke detecting type or a heat detecting type fire alarm is briefly explained referring to the attached drawings.

1. Application Example to Smoke Detecting Type Fire Alarm

Figure 22A:
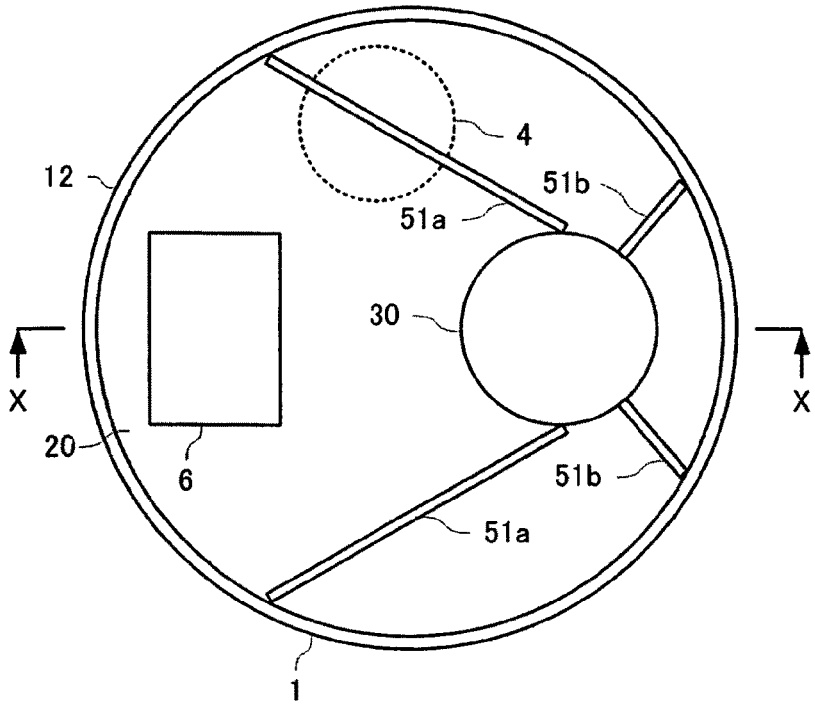
FIG. 22A is a diagrammatic plan view showing the alignment relation of each member in the housing according to a smoke detecting type fire alarm applied with a sensor of the eleventh embodiment of the present invention.
Figure 22B:
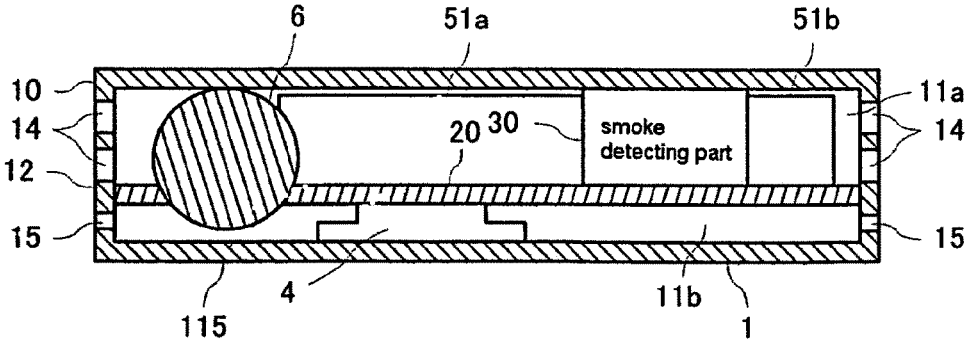
FIG. 22B is a diagrammatic sectional view along the line X-X direction in the plan view of FIG. 22A.

FIG. 22A is a diagrammatic plan view of the fire alarm of this embodiment and seen from the top panel side, FIG. 22B is a diagrammatic sectional view along the line X-X direction in the plan view of FIG. 22A. In the fire alarm in FIG. 16 the same members as those in the eighth embodiment are allotted with the same reference numerals and their explanation is omitted.

As shown in FIG. 22A, the battery 6 corresponding to the above-mentioned structure 9, the smoke detecting part 30, and the sounding body 4 are positioned so as not to be interfered each other. Namely, the sounding body 4 is provided on the face parallel to the attachment surface in the second space 11*b* which does not overlap with the smoke detecting part 30 and the battery 6 and is apart from the smoke detecting part 30 in order to reduce the influence on the detecting part 30. The battery 6, the smoke detecting part 30, and the guide walls 51*a*, 51*b* are provided in the first space 11*a* in an arrangement shown in FIG. 21.

According to such a fire alarm, the circuit board 20 has a hole to which the battery 6 is inserted and the first space 11*a* and the second space 11*b* apart in the height direction of the housing 1 are formed as shown in FIG. 22B when the battery 6 is fitted in the hole. Namely, when the battery 6 having the substantially same height as that of the housing 1, the periphery around the battery 6 is not opened.

The area occupied with the battery 6 exists in the first space 11*a* and the second space 11*b* as shown in FIG. 22B. When the sounding body 4 and the smoke detecting part 30 are positioned respectively as shown in FIG. 22A, they are positioned in order not to overlap the area occupied with the battery 6. Accordingly, the size of the housing 1 in the height direction can be determined by the height of the smoke detecting part 30 and the sounding body 4, so that the fire alarm can be made slim and small.

The guide wall 51*a* is provided between the battery 6 and the smoke detecting part 30 when the housing 1 is seen in the direction of the arrow in the figure from the center line L as shown in the sectional view of FIG. 22B. Accordingly, the smoke flow from the direction with an angle relative to the center line L goes into the guide wall 51*a* or the battery 6 in the area closer to the center O1 than the smoke detecting part 30. The smoke flow gone into the guide wall 51*a* flows along the guide wall 51*a* to be guided into the smoke detecting part 30. On the other hand, the smoke flow gone into the battery 6 turns around the battery 6, flows between the smoke detecting part 30 and the battery 6, then enters in the smoke detecting part 30. In addition, the battery 6 is provided between the guide walls 51*a* having a sharp crossing angle of the extended line in the longitudinal direction with the center line L as shown in the plan view of FIG. 22A. Accordingly, the smoke flow from the battery 6 to the smoke detecting part 30 is guided to the smoke detecting part 30 by the guide wall 51*a*.

2. Application Example to Heat. Detecting Type Fire Alarm

Figure 23:
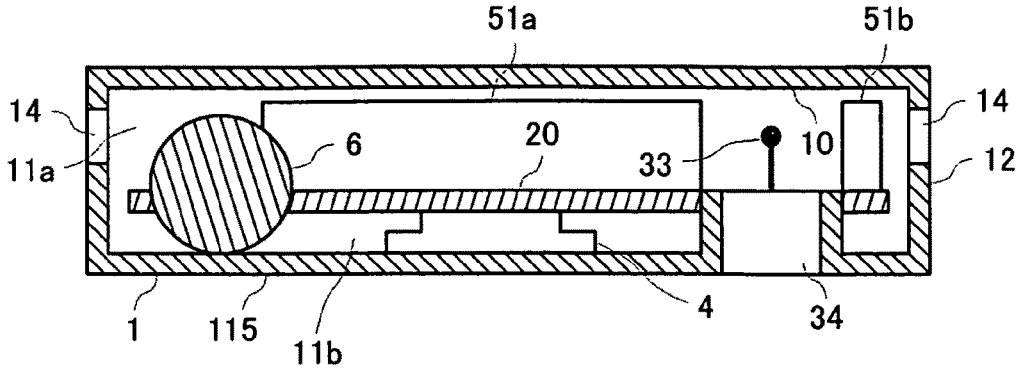
FIG. 23 is a diagrammatic sectional view showing the structure of a heat detecting type fire alarm applied with a sensor of the eleventh embodiment of the present invention.
Figure 29:
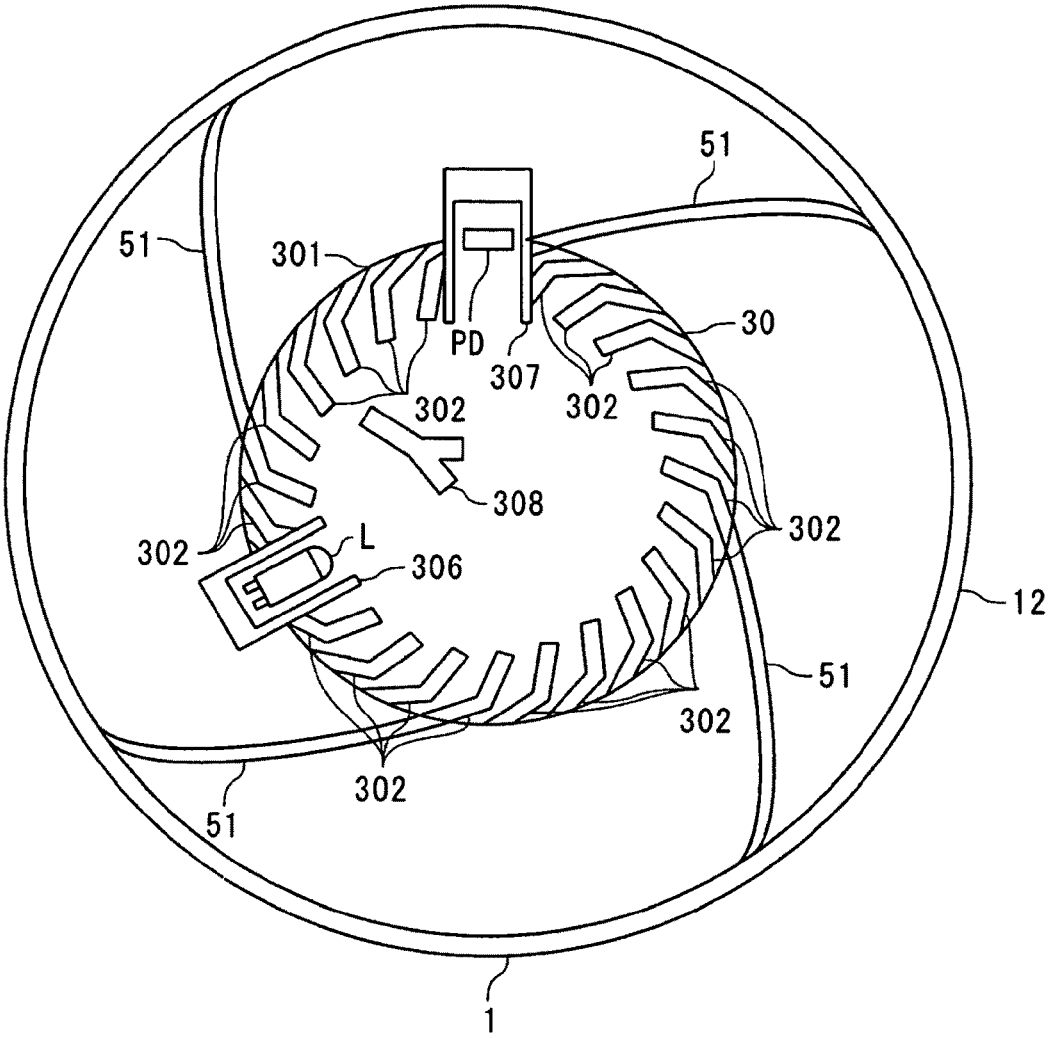
FIG. 29 is a diagrammatic plan view showing the structure of a smoke detecting type fire alarm applied with a sensor of the fifteenth embodiment of the present invention.

FIG. 23 is a diagrammatic sectional view showing the structure of a fire alarm applied to this example. In the fire alarm of FIG. 29 the same members as those in the fire alarm in FIG. 18 in the eighth embodiment are allotted with the same reference numerals and their explanation is omitted. Also in this example the battery 6 is provided as the structure 9 like the above-mentioned application example to the smoke detecting type fire alarm.

The fire alarm in FIG. 23 has an area occupied with the battery 6 in the first space 11*a* and the second space 11*b* which are separated by the circuit board 20 like the smoke detecting type fire alarm as shown in FIG. 22A and FIG. 22B. Accordingly, the thermistor 33, the sounding body 4, and the battery 6 are positioned in such a manner that the thermistor 33 and the battery 6 do not overlap in the first space 11*a* and the sounding body 4, the opening for detection 34 and the battery 6 do not overlap in the second space 11*b*.

Positioning the thermistor 33, the sounding body 4, and the battery 6 in such a manner that they do not overlap with the face parallel to the attachment surface, the fire alarm in this example can be made thinner and smaller. In addition, the guide wall 51*a*, the thermistor 33 and the battery 6 are positioned in the first space 11*a* as shown in FIG. 21, thereby improving the detection ability of the thermistor 33.

Twelfth Embodiment

Figure 24:
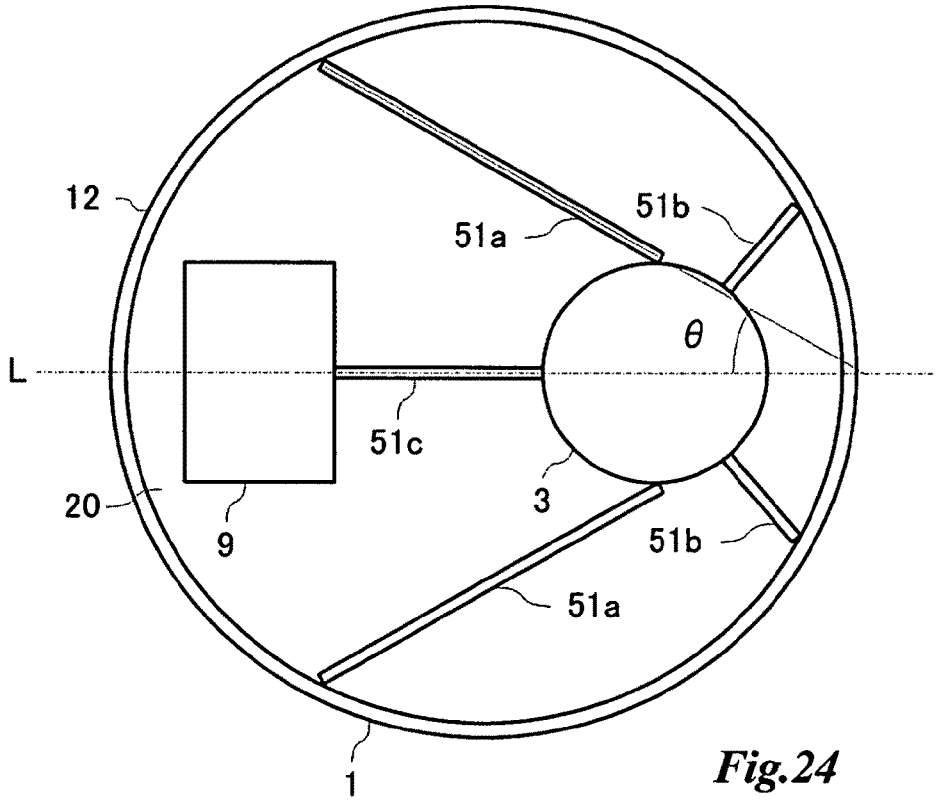
FIG. 24 is a diagrammatic plan view showing the structure of a sensor according to the twelfth embodiment of the present invention.

A sensor according to the twelfth embodiment of the present invention is explained referring to the attached drawings. FIG. 24 is a diagrammatic plan view of the space including the detecting part in the housing and shows the structure of the sensor of this embodiment. In FIG. 24 the same members as those in FIG. 21 are allotted with the same reference numerals and their detailed explanation is omitted.

The sensor of this embodiment further includes the guide wall 51*c* between the structure 9 being an obstacle for a part of the fluid flowing in the housing 1 and the detector 3 in addition to the sensor in the eleventh embodiment (refer to FIG. 21) as shown in FIG. 24. When the fluid flow is blocked between the structure 9 and the detecting part 3 by the guide wall 51*c*, the guide wall 51*c* functions as a guide member for guiding the fluid into the detecting part 3. Other structures are same as those in the eleventh embodiment, and their explanation is to be referred to that of the eighth to eleventh embodiments and is omitted here.

The fluid which directs parallel or with some angles relative to the center line L goes into the structure 9 being the obstacle of flow to the detecting part 3 and flows along the periphery of the structure 9. When the fluid enters in the area between the structure 9 and the detecting part 3, it sometimes flows in the longitudinal direction of the structure 9 by keeping the flow along the periphery of the structure 9.

As the result, when the guide wall 51*c* is not provided in the structure of the eleventh embodiment (refer to FIG. 21), the fluid entered in the area between the structure 9 and the detecting part 3 flows into the side wall 12 and is discharged out of the housing 1 from the opening 14 of the side wall 12 (refer to FIG. 22A, FIG. 22B, and FIG. 23). On the other hand, in this embodiment having the guide wall 51*c*, when the fluid entered in the area between the structure 9 and the detecting part 3 flows along the longitudinal direction of the structure 9, the fluid goes into the guide wall 51*c* to block the flow into the side wall 12.

Namely, when the fluid entered in the structure 9 and the detecting part 3 flows along the longitudinal direction of the structure 9, it goes into the guide wall 51*c* and flows along the guide wall 51*c*. In this case, the periphery of the guide wall 51*c* becomes an area extended into the detecting part 3 than to the structure 9, so that the fluid gone into the guide wall 51*c* flows into the detecting part 30 along the guide wall 51*c*. Accordingly, the fluid entered between the structure 9 and the detecting part 3 can be guided to the detecting part 3 by the guide wall 51*c*, thereby improving the flowing effect of the fluid into the detecting part 3.

Other structure different from the structure 9 may be provided between the structure 9 and the detecting part 3 instead of the guide wall 51*c* in this embodiment and the same effect as that of the guide wall 51*c* can be obtained. In such a case, when the width relative to the vertical direction to the center line L of another structure instead of the guide wall 51*c* is smaller than the width of the structure 9, the same effect as that of the guide wall 51*c* can be obtained.

Figure 25:
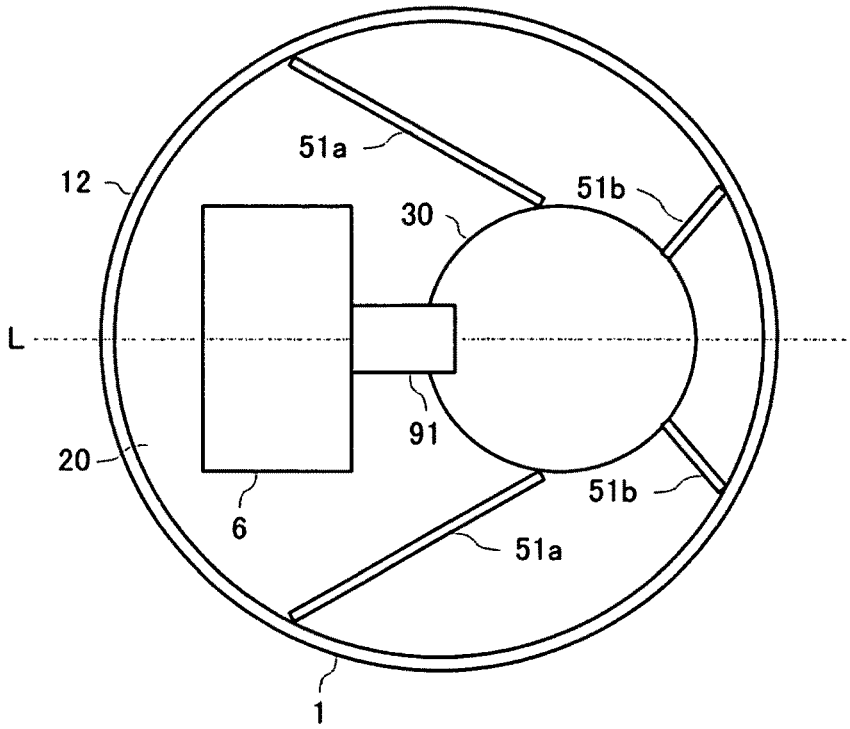
FIG. 25 is a diagrammatic plan view showing the structure of a smoke detecting type fire alarm applied with a sensor of the twelfth embodiment of the present invention.

When the sensor of this embodiment is applied to the smoke detecting type fire alarm, another structure instead of the guide wall 51*c* may be the containing parts 306, 307 for containing the light emitting diode L and the photo diode PD, respectively. Namely, smoke does not flow from the position where the containing parts 306, 307 are provided in the smoke detecting part 30, so that the containing parts 306, 307 can be substituted with the guide wall 51*c*. Accordingly, a containing part 91 corresponding to either of the containing parts 306, 307 is provided between the battery 6, being the structure 9, and the smoke detecting part 30 in such a manner that the center is positioned on the center line L as shown in FIG. 25. According to such a structure, the containing part 91 gives the same effect as the guide wall 51*c* in FIG. 24 to the smoke flow entered in the area between the battery 6 and the smoke detecting part 30, thereby guiding the smoke flow into the smoke detecting part 30.

The sensor of this embodiment is not limited to be applied to the smoke detecting type fire alarm and may be applied to a heat detecting type fire alarm having a heat detecting element as the detecting part 3 like the embodiment in the eleventh embodiment or a gas alarm for measuring the gas amount.

Thirteenth Embodiment

Figure 26:
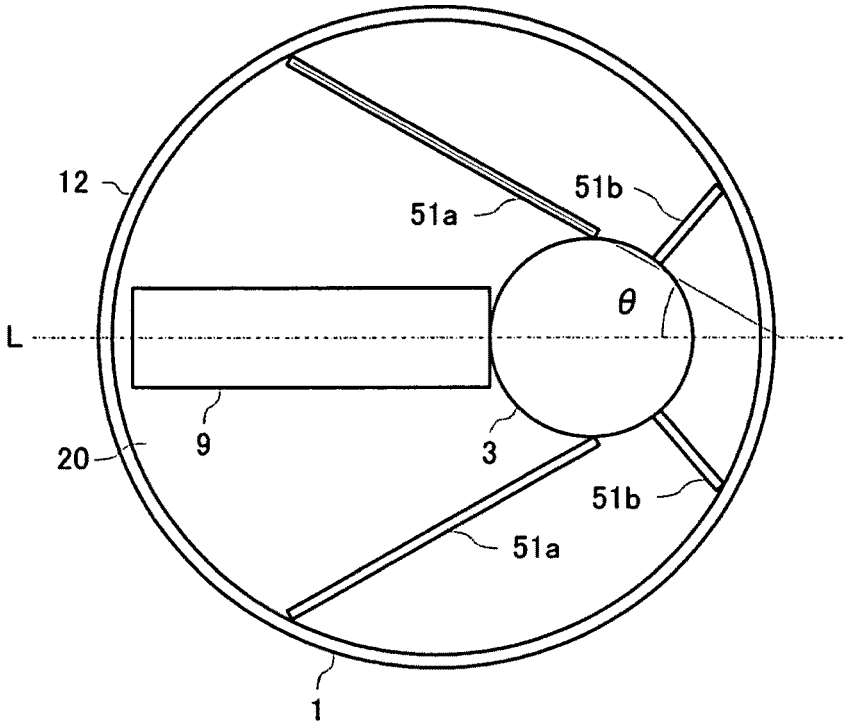
FIG. 26 is a diagrammatic plan view showing the structure of a sensor according to the thirteenth embodiment of the present invention.

A sensor according to the thirteenth embodiment of the present invention is explained referring to the attached drawings. FIG. 26 is a diagrammatic plan view of the space in the housing including a detecting part showing the structure of a sensor according to the embodiment of the present invention. In FIG. 26 the same members as those in FIG. 21 are allotted with the same reference numerals and their detailed explanation is omitted.

According to the sensor of this embodiment, as shown in FIG. 26, the structure 9 being an obstacle for a part of the fluid flowing in the housing 1 is designed in such a manner that the longitudinal direction directs to the detecting part 3 from the side wall 12 in the eleventh embodiment (refer to FIG. 21). Namely, the structure 9 itself works as a guide member for guiding the fluid in its longitudinal direction. Other structures are same as those in the eleventh embodiment, and their explanation is to be referred to that of the eighth to eleventh embodiments and is omitted here.

As explained in the twelfth embodiment, when the longitudinal direction of the structure 9 is perpendicular to the center line L and the fluid enters in the area between the structure 9 and the detecting part 3, the fluid flows in the longitudinal direction of the structure 9 and is discharged out of the housing 1 from the opening 14 of the side wall 12 (refer to FIG. 22A, FIG. 22B and FIG. 23). The fluid flowing perpendicular to the longitudinal direction of the structure 9 causes the guiding efficiency of the fluid into the detecting part 3 because the area with the width in the longitudinal direction of the structure 9 becomes an obstacle of its flow.

On the other hand, the longitudinal direction of the structure 9 is in the direction along the center line L as shown in FIG. 26, the structure 9 has the same function as the guide wall 51*c* in the tenth embodiment (refer to FIG. 20). Namely, the width of the structure 9 can be narrow with respect to the flow along the center line L, so that the area blocking the flow can be made small, thereby improving the flow efficiency of the fluid into the housing 1. In addition, when the longitudinal direction of the structure 9 is in the direction into the side wall 12 from the detecting part 3, the fluid goes into the outer circumferential face which is in the longitudinal direction of the structure 9 and flows along the outer circumferential face into the detecting part 3.

This embodiment has the structure 9 together with the guide walls 51*a*, 51*b* so as to be functioned like the guide walls 51*c*, however, other structure may be substituted with the guide walls 51*a*, 51*b* in addition to the structure 9. Further, a plurality of structures are provided between the side wall 12 and the detecting part 3 like the twelfth embodiment and they may be used as substitute of the above-mentioned guide walls 51*a* to 51*c*.

The sensor of this embodiment can be constituted as a smoke detecting type or a heat detecting type fire alarm in which the detecting part 3 is a smoke detecting part or a heat detecting part like the eleventh embodiment or constituted as a gas alarm for measuring the gas amount. When the sensor is used for the fire alarm shown in FIG. 22A, FIG. 22B or the fire alarm in FIG. 25, the structure instead of the guide walls 51*a* to 51*c* is provided in the first space 11*a* (refer to FIGS. 22A, 22B, and FIG. 25).

Fourteenth Embodiment

Figure 27:
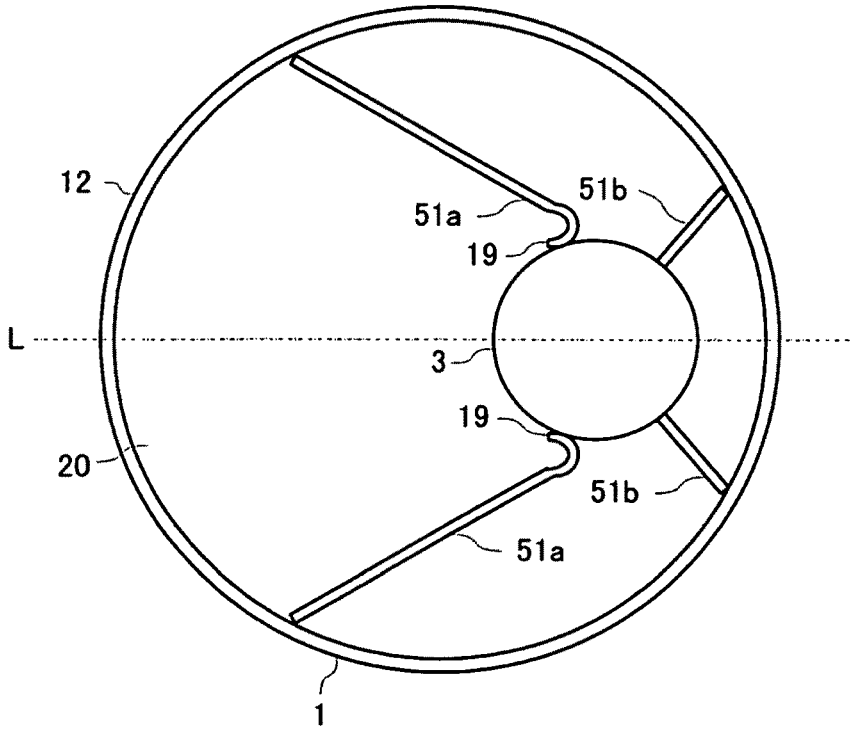
FIG. 27 is a diagrammatic plan view showing the structure of a sensor according to the fourteenth embodiment of the present invention.

The fourteenth embodiment of the present invention is explained referring to the attached drawings. FIG. 27 is a diagrammatic plan view of the space in the housing including a detecting part, showing the structure of a sensor according to the fourteenth embodiment of the present invention. In FIG. 27 the same members as those in FIG. 19 are allotted with the same reference numerals and their detailed explanation is omitted.

As shown in FIG. 27, the sensor of this embodiment has a groove member 19 at the end of the guide wall 51*a* on the detecting part 3 side in the sensor of the ninth embodiment (refer to FIG. 19). The groove recess of the groove member 19 is continuously formed in the vertical direction relative to the attachment surface. Other structures are same as those in the eighth embodiment, their explanation is to be referred to that of the eighth embodiment and their explanation is omitted here.

According to such a sensor, dust entering together with the fluid along the guide wall 51*a* can be stopped by the groove recess of the groove member 19. Accordingly, the dust is prevented from entering in the detection part, so that the stray light caused by dust can be prevented when the detecting part 3 is constituted with an optical smoke detecting part 30 (refer to FIG. 16). When the sensor is attached on the wall in such a manner that the bottom of the groove recess of the groove member 19 is provided on the floor side, the groove recess is facilitated to block dust.

The groove member 19 is provided for the guide wall 51*a* of the sensor of the ninth embodiment according to the present invention, however, it may be incorporated with the sensor in the eighth to thirteenth embodiments. Namely, when the ends of the guide walls 51, 51*a* to 51*c* of the sensors of the eighth to thirteenth embodiments are provided with the groove member 19 at the detecting part 3 side, the same effect as mentioned above can be obtained. Also in this embodiment, the sensor may be used for a smoke detecting type or a heat detecting type fire alarm constituting the detecting part 3 as the smoke detecting part or the heat detecting element like the ninth embodiment or for a gas alarm for measuring the gas amount.

Fifteenth Embodiment

Figure 28:
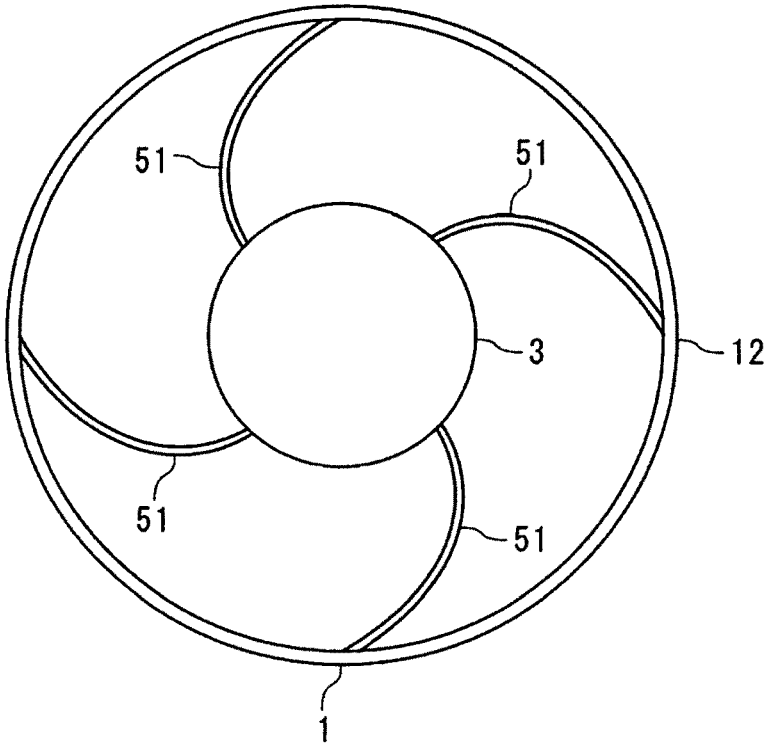
FIG. 28 is a diagrammatic plan view showing the structure of a sensor according to the fifteenth embodiment of the present invention.

The fifteenth embodiment of the present invention is explained referring to the attached drawings. FIG. 28 is a diagrammatic plan view of the space in the housing including a detecting part, showing the structure of a sensor according to the fourteenth embodiment of the present invention. In FIG. 28 the same members as those in FIG. 14 are allotted with the same reference numerals and their detailed explanation is omitted.

According to the sensor of this embodiment, the guide wall 51 in the eighth embodiment (refer to FIG. 14) has a curved section in the direction parallel to the attachment surface as shown in FIG. 28. Other structures except for the shape of the guide wall 51 are same as those in the eighth embodiment, and their explanation is to be referred to that of the eighth embodiment and is omitted here. FIG. 28 shows the sensor in which each guide wall 51 is formed to be spiral into the side wall 12 at the external circumference around the detecting part 3. When the guide wall 51 is spirally arranged, the fluid into the tangential direction of the side wall 12 can be guided to the detecting part 3.

The structure of the guide wall 51 of the sensor in FIG. 28 is specifically effective to the fire alarm having the smoke detecting part 30 with the labyrinth wall 302 as shown in FIG. 17. Namely, when the guide wall 51 is formed in the extended direction from the bent part to the base end of the labyrinth wall 302, the fluid along the guide wall 51 is easily entered in the gap between the labyrinth walls 302. Further, when the guide wall 51 is formed directing from the base end of the labyrinth wall 302 to the side wall 12, the smoke flow can be actively guided in the flow path formed with the gap of the labyrinth walls 302.

Here explained is the embodiment applied to the guide wall 51 in the eighth embodiment, however, the guide walls 51, 51*a* to 51*c* in the ninth to the fourteenth embodiments may be applied to this embodiment. The example in which this embodiment is applied to the smoke detecting type fire alarm is explained, however, it can be applied to the heat detecting type fire alarm constituting the detecting part 3 as the heat detecting element like the eighth embodiment and a gas alarm for measuring the gas amount.

Sixteenth Embodiment

Figure 30:
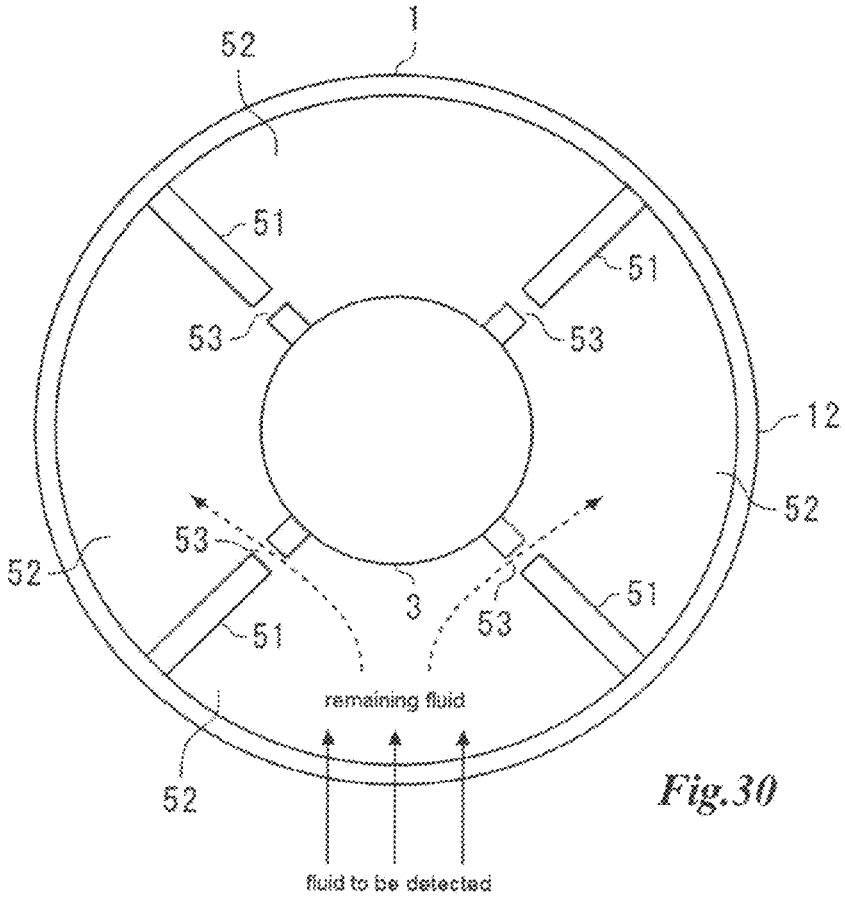
FIG. 30 is a diagrammatic plan view showing the structure of a sensor according to the sixteenth embodiment of the present invention.
Figure 31:
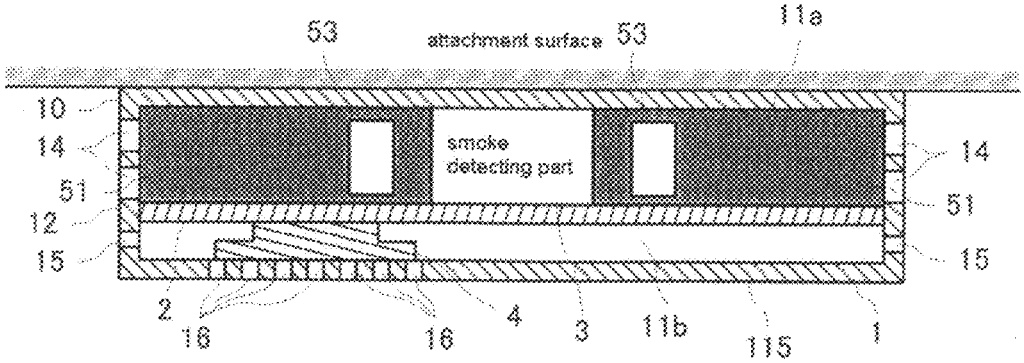
FIG. 31 is a diagrammatic sectional view showing the structure of the sensor in FIG. 30.

The sixteenth embodiment of the present invention is explained referring to the attached drawings. FIG. 30 is a diagrammatic plan view of the space in the housing including a detecting part, showing the structure of a sensor according to the sixteenth embodiment of the present invention. FIG. 31 is a diagrammatic sectional view showing the structure of the sensor in FIG. 30.

The sensor of this embodiment has a detecting part 3 for measuring the environmental value (smoke amount) when the fluid (smoke) flowing in the circumference environment (outer environment) out of the housing 1 and the detecting part 3 is provided at the center in the housing 1 as shown in FIG. 30. The opening 14 is provided for the side wall 12 covering the periphery of the housing 1 as shown in FIG. 31, and the fluid flowing in the outer environment out of the side wall 12 flows into the housing 1 from the opening 14. When the detecting part 3 is thus provided at the center of the housing 1 with respect to the face parallel to the attachment surface of the sensor, a plurality of guide walls 51 are provided and each end thereof is connected to the outer circumferential face of the detecting part 3 and the inner circumferential face of the side wall 12 respectively. Namely, in the embodiment of FIG. 30, four guide walls 51 are radially formed around the detecting part 3 and are circumferentially provided in the space between the outer circumferential face of the detecting part 3 and the inner circumferential face of the side wall 12

Accordingly, the space surrounded with side wall 12 including the detecting part 3 is divided by the guide walls 51 and each space divided by the guide walls 51 functions as a guide path 52 for guiding the fluid from the opening 14 of the side wall 12 to the detecting part 3. Namely, the section parallel to the circumference of the housing 1 of the guide path 52 formed with each space divided by the guide wall 51 is narrowed from the side wall 12 to the detecting part 3. Accordingly, the fluid flow from the opening 14 is regulated into the direction to the detecting part 3, so that the flow amount supplied to the detecting part 3 in the housing 1 can be enough for measuring. Therefore, if the detecting part 3 is provided in the housing 1, deterioration of measuring sensitivity and response speed of the detecting part 3 to the fluid can be reduced by providing the guide wall 51, thereby keeping the ability as a sensor.

Further, the guide wall 51 is provided with a cutout part 53 formed by cutting out a part thereof as shown in FIG. 30 and FIG. 31 and the cutout 53 functions as a bypass between the two guide paths 52 divided by the guide wall 51. The opening 14 provided at the side wall 12 of the housing 1 is wide and the flow inlet to the detecting part 3 is narrow, so that the flow resistance of fluid in the guide path 52 becomes larger into the detecting part 3. Therefore, the cutout 53 constituting a bypass is preferably provided in the area closer to the outer circumferential side of the detecting part 3 rather than the inner circumferential face of the side wall 12. Namely, the bypass constituted with the cutout 53 is provided in the area of the guide path 52 which has larger resistance, thereby remarkably reducing the resistance to the fluid in the guide path 52.

The bypass function of the cutout 53 is explained referring to FIG. 30. When the fluid to be detected in the detecting part 3 (corresponds to smoke and referred as "fluid to be detected" hereinafter) enters in the housing 1 via the opening 14 of the side wall 12 as shown with solid lines in FIG. 30, the fluid remained in the housing 1 (corresponding to air other than smoke and referred as "remained fluid" hereinafter) is going to be discharged by being pushed by the flow of the fluid to be detected. The remained fluid in the guide path 52 to which the fluid to be detected enters along the flow of the fluid to be detected, so that it is to be discharged out of the housing 1 from another guide path 52 via the detecting part 3.

However, the resistance to the fluid flow becomes large in the guide path 52 closer to the detecting part 3, so that it takes time for the remained fluid to be discharged into other guide path 52 through the detecting part 3. Therefore, the fluid to be detected flows in the detecting part 3 after the remained fluid, so that it takes time for the fluid to be detected to flow into the detecting part 3 and measuring of the environmental value (smoke amount) by the detecting part 3 delays. On the other hand, the cutout 53 provided for the guide wall 51 functions as a bypass between the adjacent guide paths 52 via the guide wall 51 in the structure of FIG. 30.

A part of the remained fluid which is going to flow into the detecting part 3 by the fluid to be detected flows into the adjacent guide path 52 via the cutout 53 of the guide wall 51 as shown in solid lines in FIG. 30. Namely, the resistance in the guide path 52 to the flow of the remained fluid which is going out of the housing 1 is reduced by the cutout 53 functioning as a bypass. The remained fluid flowing in the cutout 53 being the bypass flows into the guide path 52 adjacent to another guide path 52 to which the fluid to be detected flows, then is discharged out of the housing 1 from the opening 14 of the side wall 12. Accordingly, the remained fluid in the guide path 52 to which the fluid to be detected is flown from the opening 14 is rapidly discharged out of the housing 1, so that the time until the fluid to be detected flows into the detecting part 3 can be reduced, deterioration of measuring sensitivity and response speed of fluid by the detecting part 3 can be further reduced, thereby keeping the performance as a detector.

When the area of the cutout 53 becomes larger, the flow amount of the remained fluid to the adjacent guide pat 52 is increased, so that the time before the fluid to be detected flows into the detecting part 3 is further reduced. Accordingly, in the structure of FIG. 31, the width of the cutout 53 along the height direction of the guide wall 51 is narrower comparing to the height of the guide wall 51, however, the width may be the same as the height of the guide wall 51. In addition, when the width of the cutout 53 along the longitudinal direction of the guide wall 51 is made larger, the fluid to be detected flown in the guide path 52 is also discharged into the adjacent guide path 52, as the result, the flow amount of the fluid to be detected which is to be flown in the detecting part 3 is reduced. Accordingly, the width of the cutout 53 along the longitudinal direction of the guide wall 51 is limited as far as it does not deteriorate the response speed of the detecting part 3.

According to such a sensor having the guide wall 51 with cutout 53, the housing 1 is constituted with the base part 10 projected from the outer circumference of the ring-like side wall 12 and the disc-like top panel 115 covering the end of the side wall 12 opposite to the end covered with the base part 10. In addition the sensor has a separating board 2 including the circuit board on which the detecting part 3 is mounted and which is electrically connected to the sounding body 4. When the separating plate 2 is connected in the inner circumferential face of the side wall 12, two spaces are formed in the height direction in the housing 1. A circuit element member including a control part is mounted on the circuit board constituting a part of the separating plate 2 other than the detecting part 3 and the sounding body 4, thereby constituting a circuit for controlling the function as an alarm.

The first space 11*a* covered with the base part 10, the side wall 12 and the separating plate 2 is opened to the outside of the housing 1 via the opening 14 for opening the circumferential face of the side wall 12 and is separated by the guide wall 51 having the cutout 53, thereby forming the guide path 52 shown in FIG. 30. Further the first space 11*a* is provided with the detecting part 3 for measuring the environmental value (smoke amount) of the fluid guided by the guide path 52 after entering into the housing 1 from the opening 14. On the other hand, the second space 11*b* covered with the side wall, the top panel 115 and the separating plate 2 is opened out of the housing 1 by the opening 15 for opening the circumferential face of the side wall 12 and the plurality of sound apertures 16 provided on the top panel 115. In addition, the second space 11*b* is provided with the sounding body 4 for outputting sound by transmitting vibration to the outer environment via the opening 15 and the sound apertures 16.

When the detecting part 3 is provided at the center of the base part 10 parallel to the attachment surface in the first space 11*a* as shown in FIG. 30, the sounding body 4 is preferably provided closer to the side wall 12 than the detecting part 3 in the second space 11*b* as shown in FIG. 31. Namely, when the detecting part 3 and the sounding body 4 are provided so as not to be overlapped on the face parallel to the attachment surface, the effect of the vibration caused by operation of the sounding body 4 on the detecting part 3 can be reduced.

On the other hand, the air resistance in the rear air chamber having the sounding body 4 can be reduced by the opening 15 and the sounding apertures 16, so that the sound volume of the alarm by the sounding body 4 cannot be reduced. Further, if the second space 11*b* has enough volume, the side wall 12 may not be provided with the opening 15 and may be provided with only the opening 14. In addition, the side wall 12 may be provided with only the opening 14, a gap may be provided between the separating plate 2 and the side wall 12, and the second space 11*b* may be opened to the outer environment by the gap and the opening 14.

Seventeenth Embodiment

Figure 32:
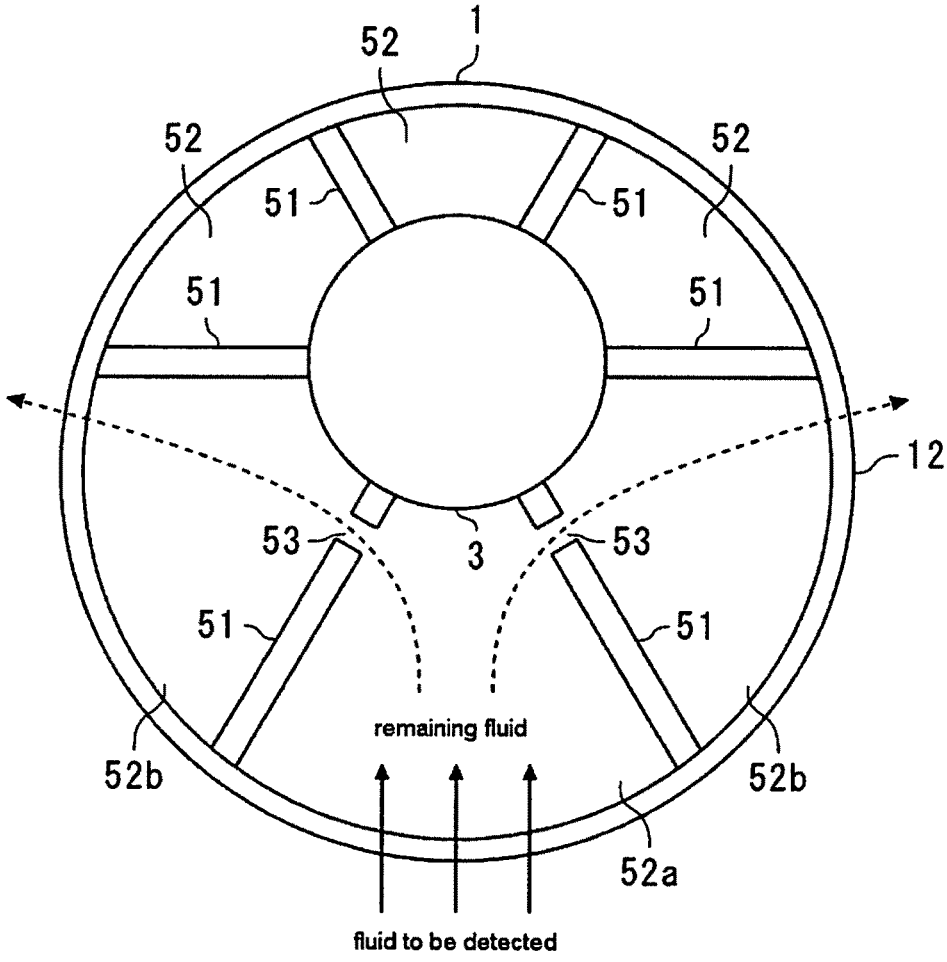
FIG. 32 is a diagrammatic plan view showing the structure of a sensor according to the seventeenth embodiment of the present invention.

The seventeenth embodiment of the present invention is explained referring to the attached drawings. FIG. 32 is a diagrammatic sectional view of the space in the housing including a detecting part, showing the structure of a sensor according to the seventeenth embodiment of the present invention. In FIG. 32 the same members as those in FIG. 30 are allotted with the same reference numerals and their detailed explanation is omitted.

According to the sensor of the present embodiment as shown in FIG. 32, the detecting part 3 is positioned closer to the side wall 12 in such a manner that the detecting part 3 is positioned at an eccentric position of the center of the housing 1 on the face parallel to the attachment surface. Therefore, when the center of the detecting part 3 is considered as standard, the length of the guide wall 51, provided closer to the center of the housing 1, to the side wall 12 is larger than the length of the guide wall 51 provided apart from the center of the housing 1. In addition, a guide path 52*a* which is the longest flow path is formed at the center side of the housing 1 seen from the center of the detecting part 3 and the cutout 53 is provided for the two guide walls 51 forming the guide paths 52*a* at the area closer to the detecting part 3.

A guide path 52*b* which is shorter than the guide path 52*a* is provided at both sides of the guide path 52*a*. Comparing to the guide path 52 which is apart from the center of the housing considering the center of the detecting part 3 as a standard, the guide path 52*b* forms a long flow path. The cutout 53 is not provided for the four guide walls 51 forming the guide path 52 unlike the sensor in the sixteenth embodiment (refer to FIG. 30). Other structures are same as those in the sixteenth embodiment, and their explanation is to be referred to that of the sixteenth embodiment and is omitted here.

The guide wall 51 forming the guide path 52*a* with the longest flow path is provided with the cutout 53 in this embodiment. Namely, the amount of remained fluid in the guide path 52 with a short guide path is small and further the distance between the opening 14 and the detecting part 3 is short. Therefore, when the fluid to be detected enters in the guide path 52 from the opening 14, the responsiveness of the detecting part 3 is not affected by the time when the fluid to be detected reaches the detecting part 3.

On the other hand, the guide paths 52*a*, 52*b* with long flow path include much remained fluid and in addition the distance between the opening 14 to the detecting part 3 is long. Therefore, when the cutout 53 is not provided and the fluid to be detected enters in the guide paths 52*a*, 52*b* from the opening 14, the time before the fluid to be detected reaches the detecting part 3 becomes long, thereby deteriorating the responsiveness of the detecting part 3. Therefore, the cutout 53 is provided for the guide wall 51 positioned between the guide paths 52*a*, 52*b* with long flow path and the cutout 53 functions as a bypass between the adjacent guide paths 52*a*, 52*b*, thereby preventing deterioration of the measurement sensitivity and the response speed of the detecting part 3.

When the fluid to be detected enters in the guide path 52*a* from the opening 14 as shown in the solid lines in FIG. 32, a part of the remained fluid in the guide path 52*a* flows into the adjacent two guide paths 52*b* via the guide wall 51 at both sides of the guide path 52*a* via the cutout 53 as shown in dotted lines in FIG. 32. Finally, the remained fluid in the guide path 52*a* is discharged out of the housing 1 from the opening 14 via the guide path 52*b*. Thus, the remained fluid in the guide path 52*a* is rapidly discharged outside and the time until the fluid to be detected which entered in the flow path 52*a* flows into the detecting part 3 is reduced. Also, when the fluid to be detected enters in the guide path 52*b* from the opening 14, a part of the remained fluid in the guide path 52*b* is discharged out of the housing 1 from the opening 14 via the cutout 53 and the guide path 52*a*. Thus, the remained fluid in the guide path 52*b* is rapidly discharged outside and the time until the fluid to be detected which has entered in the guide path 52*b* flows in the detecting part 3 is reduced.

According to such an embodiment, the detecting part 3 is provided at a position eccentric to the housing 1, when the length of the guide paths 52, 52*a*, 52*b* formed by the guide wall 51 is different, the cutout part 53 constituting as a bypass is provided for the guide wall 51 forming the guide paths 52*a*, 52*b* with long flow path. Thus, when the fluid to be detected flows in the long guide paths 52*a*, 52*b*, the remained fluid can be discharged out of the housing 1 via the flow path via the detecting part 3 and the flow path via the cutout 53, so that the reaching time of the fluid to be detected to the detecting part 3 can be reduced. Accordingly, the measuring sensitivity and the response speed are avoided in the detecting part 3 of the sensor of this embodiment.

Also in this embodiment, the sounding body 4 (refer to FIG. 31) in the second space 11*b* (refer to FIG. 31) is provided so as not to be overlapped with the detecting part 3 on the face parallel to the attachment surface. In such a case, the sounding body 4 may be provided at the center of the top panel 115 (refer to FIG. 31) parallel to the attachment surface or may be provided at an eccentric position relative to the center of the top pane 115.

Eighteenth Embodiment

Figure 33:
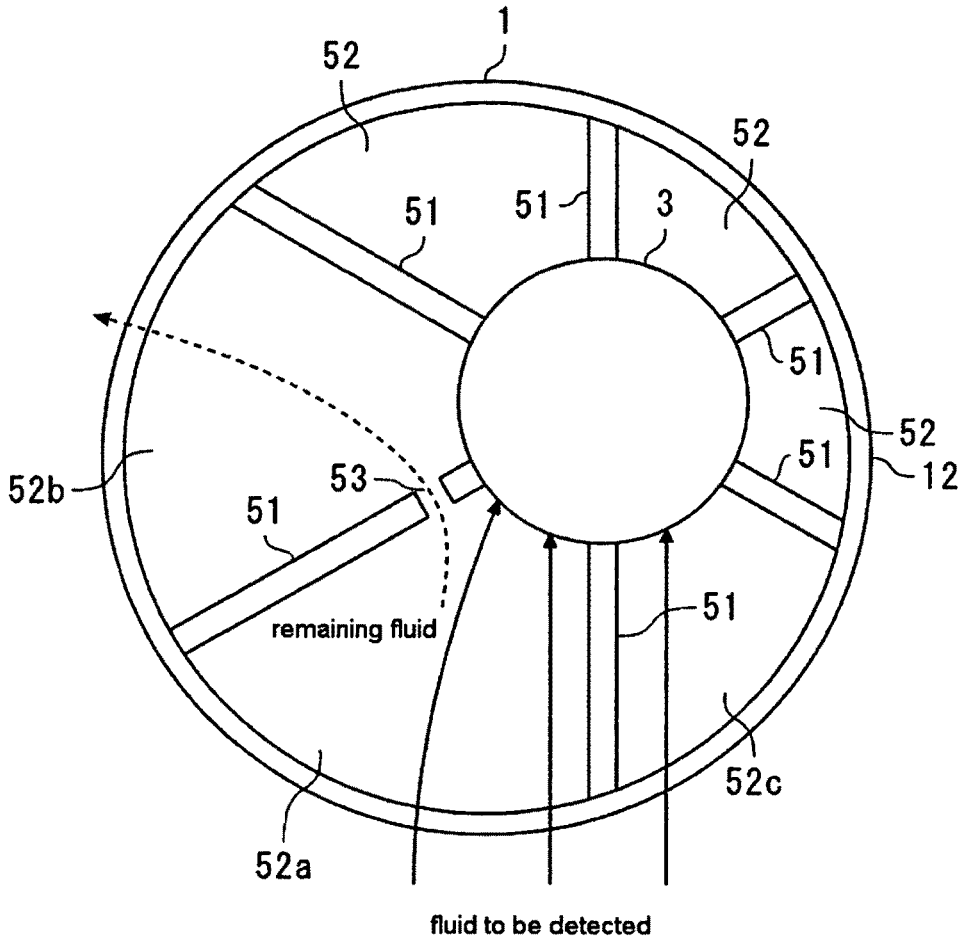
FIG. 33 is a diagrammatic plan view showing the structure of a sensor according to the eighteenth embodiment of the present invention.

The eighteenth embodiment of the present invention is explained referring to the attached drawings. FIG. 33 is a diagrammatic sectional view of the space in the housing including a detecting part, showing the structure of a sensor according to the eighteenth embodiment of the present invention. In FIG. 33 the same members as those in FIG. 32 are allotted with the same reference numerals and their detailed explanation is omitted.

The sensor of this embodiment is constructed such that the detecting part 3 is provided eccentric to the center of the housing 1 like the seventeenth embodiment (refer to FIG. 32) and the guide path 52*a* with a long flow path and a guide path 52*c* with a short flow path are adjacent via the guide wall 51 as shown in FIG. 33. The guide path 52*b* having a longer flow path than that of the guide path 52*c* is adjacent to the guide path 52*a* opposite to the guide path 52*c* and the cutout 53 functioning as a bypass is provided for the guide wall 51 which is a boundary of the guide paths 52*a*, 52*b*. Other structures are same as those in the seventeenth embodiment, and their explanation is to be referred to those of the sixteenth embodiment and the seventeenth embodiment and is omitted here.

According to the sensor of the present embodiment, the guide paths 52, 52*a* to 52*c* are constituted in the housing 1 in such a manner that the guide path 52*a* with a long flow path is adjacent to the guide path 52*c* with a short guide path and the guide wall 51 which is a boundary of the guide path 52*a* and its adjacent guide path 52*b* opposite to the guide path 52*c* is provided with the cutout 53. Namely, a bypass constituted by the cutout 53 is provided between the guide path 52*a* with a long flow path and the guide path 52*b* having a large opening area by the opening 14. The area of the guide path 52*b* becomes larger into the opening 14, so that the resistance to the flow directing to the opening 14 is small and the remained fluid in the housing 1 is easily discharged from the opening 14.

Figure 34:
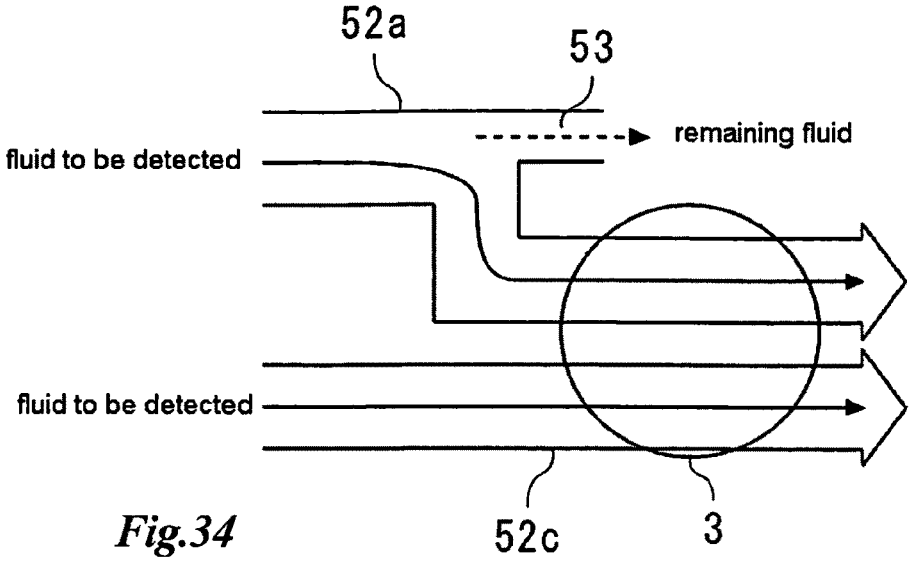
FIG. 34 is a block diagram showing the diagrammatic structure of a fluid path of the sensor in FIG. 33.

When the fluid to be detected enters in each guide path 52*a*, 52*c* as shown in solid lines in FIG. 33, the remained fluid in the guide paths 52*a*, 52*c* is pushed by the fluid to be detected to flow into the detecting part 3. The guide path 52*c* has a smaller special volume and shorter flow path comparing to those of the guide path 52*a*, so that the remained fluid in the guide path 52*c* rapidly flows in the detecting part 3 by being pushed by the fluid to be detected. The remained fluid is discharged out of the housing 1 from the opening 14 via the guide path 52 opposite to the guide path 52*c*. Therefore, the fluid to be detected which flows in the guide path 52*c* rapidly flows into the detecting part 3 as shown in FIG. 34.

On the other hand, the guide path 52*a* has a larger special volume and contains much remained fluid, so that it takes time to discharge all the remained fluid only via the detecting part 3. The guide path 52*a* has a long flow path into the detecting part 3 and the discharge of remained fluid via the detecting part 3 takes further time. In comparison, according to the present embodiment, the cutout 53 is provided at the boundary of the guide paths 52*a*, 52*b* and is functioned as a bypass to the guide path 52*b*. Accordingly, a part of the remained fluid in the guide path 52*a* flows into the guide path 52*b* and is discharged out of the housing 1 via the opening 14 as shown in dotted lines in FIG. 33, so that the remained fluid in the guide path 52*a* is rapidly discharged from the guide path 52*a*. Therefore, as shown in FIG. 34, the fluid to be detected which is to be entered in the guide path 52*a* can rapidly flow in the detecting part 3 like the fluid to be detected which is to be entered in the guide path 52*c*.

Namely, when the cutout 53 is not provided, just after the fluid to be detected is generated, only the fluid to be detected with small flow amount enters into the detecting part 3 only from the guide path 52*c*, so that much fluid to be detected does not enter in the detecting area at the center of the detecting part 3. Therefore, the responsiveness of the detecting part 3 just after generation of the fluid to be detected is bad and the measuring sensitivity and the response speed of the detecting part are deteriorated. However, when the cutout 53 is provided so as to rapidly discharge the remained fluid in the guide path 52*a* as shown in FIG. 33, the fluid to be detected rapidly flows through the guide path 52*c* and further through the guide path 52*a* as shown in FIG. 34. Therefore, even just after generation of the fluid to be detected, the fluid to be detected can adequately flow in the detecting area at the center of the detecting part 3 and the deterioration of the measuring sensitivity and the response ability of the detecting part 3 can be prevented.

Nineteenth Embodiment

Figure 35:
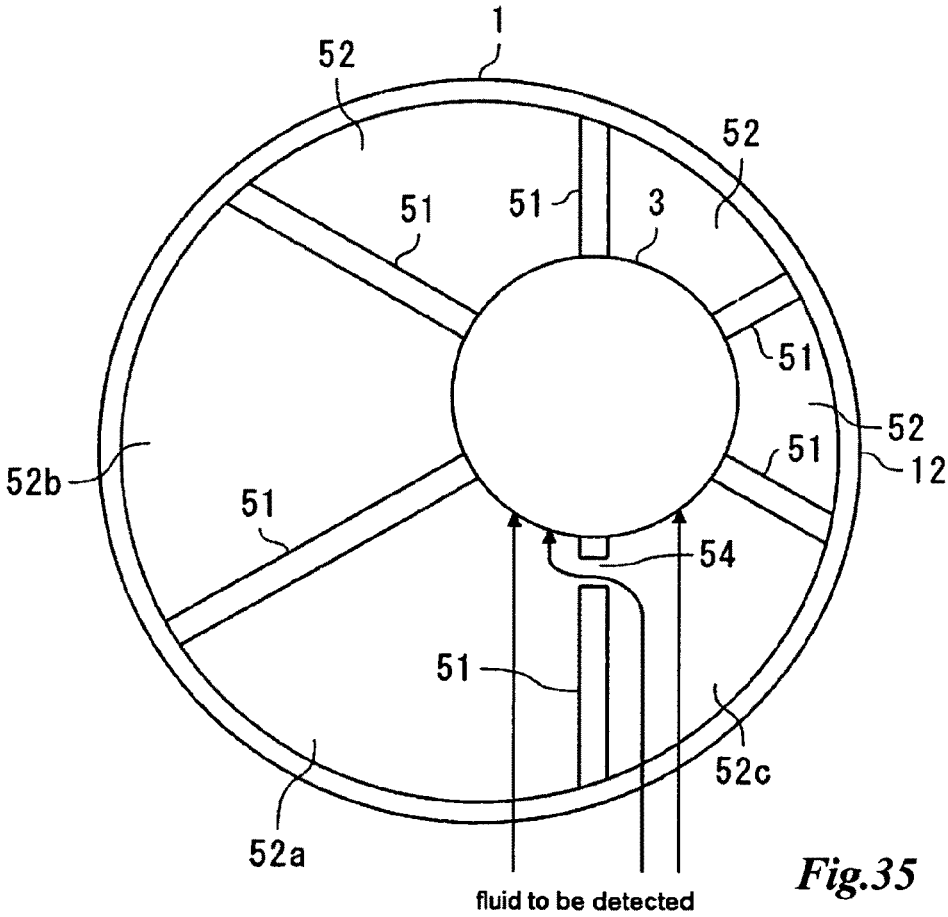
FIG. 35 is a diagrammatic plan view showing the structure of a sensor according to the nineteenth embodiment of the present invention.

The nineteenth embodiment of the present invention is explained referring to the attached drawing. FIG. 35 is a diagrammatic sectional view of the space in the housing including a detecting part, showing the structure of a sensor according to the nineteenth embodiment of the present invention. In FIG. 35 the same members as those in FIG. 33 are allotted with the same reference numerals and their detailed explanation is omitted.

According to the sensor of this embodiment, the detecting part 3 is positioned eccentric to the center of the housing 1 and the guide paths 52, 52*a* to 52*c* with flow paths of different length are formed like the eighteenth embodiment (refer to FIG. 33) as shown in FIG. 35. The present embodiment is different from the eighteenth embodiment in that the guide wall 51 being the boundary of the guide paths 52*a*, 52*b* is not provided with the cutout 53, but a cutout 54 is provided for the guide wall 51 which is the boundary between the guide paths 52*a*, 52*c*. Other structures are same as those in the eighteenth embodiment, and, their explanation is to be referred to those of the sixteenth embodiment to the eighteenth embodiment and is omitted here.

Figure 36:
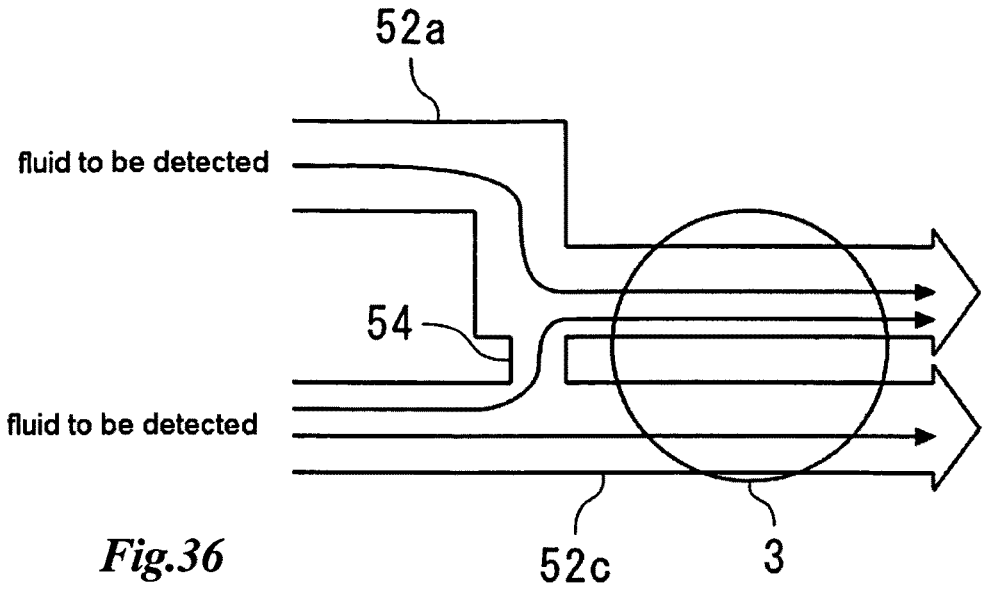
FIG. 36 is a block diagram showing the diagrammatic structure of a fluid path of the sensor in FIG. 35.

When the sensor of this embodiment is provided with guide paths 52, 52*a* to 52*c* in the housing 1 in such a manner that the guide path 52*a* with a long flow path is adjacent to the guide path 52*c* of short flow path, the cutout 54 is provided for the guide wall 51*a* between the guide paths 52*a*, 52*c*. Namely, the bypass constituted with the cutout 54 is provided between the guide path 52*a* with a long flow path and the guide path 52*c* with a short guide path. The guide path 52*c* has small special volume and its flow path is short as explained in the eighteenth embodiment, so that when the fluid to be detected flows in the guide path 52*c* from the opening 14, the remained fluid is rapidly discharged. As the result, the fluid to be detected which flows in the guide path 52*c* rapidly flows in the detecting part as shown in FIG. 36.

On the other hand, the guide path 52*a* has a large special volume and contains much remained fluid, so that it takes time to discharge the remained fluid and it needs time to flow the fluid to be detected into the detecting part 3 via the guide path 52*a*. In comparison, in the present embodiment, the cutout 54 is provided at the boundary between the guide paths 52*a*, 52*c* and functions as a bypass from the guide path 52*c* to the guide path 52*a*. Accordingly, a part of the fluid to be detected which flows in the guide path 52*c* flows in the guide path 52*a* and the fluid to be detected flows in the detecting part 3 also from the guide path 52*a*.

Namely, when the cutout 54 is not provided, just after the fluid to be detected is generated, small amount of the fluid to be detected flows in the detecting part 3 only from the guide path 52*c*, so that the fluid to be detected does not adequately flow in the detecting area at the center of the detecting part 3. Therefore, the responsiveness of the detecting part 3 just after generation of the fluid to be detected becomes worse and the measuring sensitivity and the response speed of the detecting part 3 are deteriorated. On the other hand, the cutout 54 is provided in such a manner that a part of the fluid to be detected flown in the guide path 52*c* enters in the guide path 52*a* as shown in FIG. 35, the fluid to be detected rapidly flows in the detecting part 3 via the guide path 52*a* in addition to the guide path 52*c* as shown in FIG. 36. Therefore, even just after generation of the fluid to be detected, adequate amount of fluid to be detected flows in the detection area at the center of the detecting part 3 and deterioration of the measuring sensitivity and the response speed can be prevented.

Twentieth Embodiment

Figure 37:
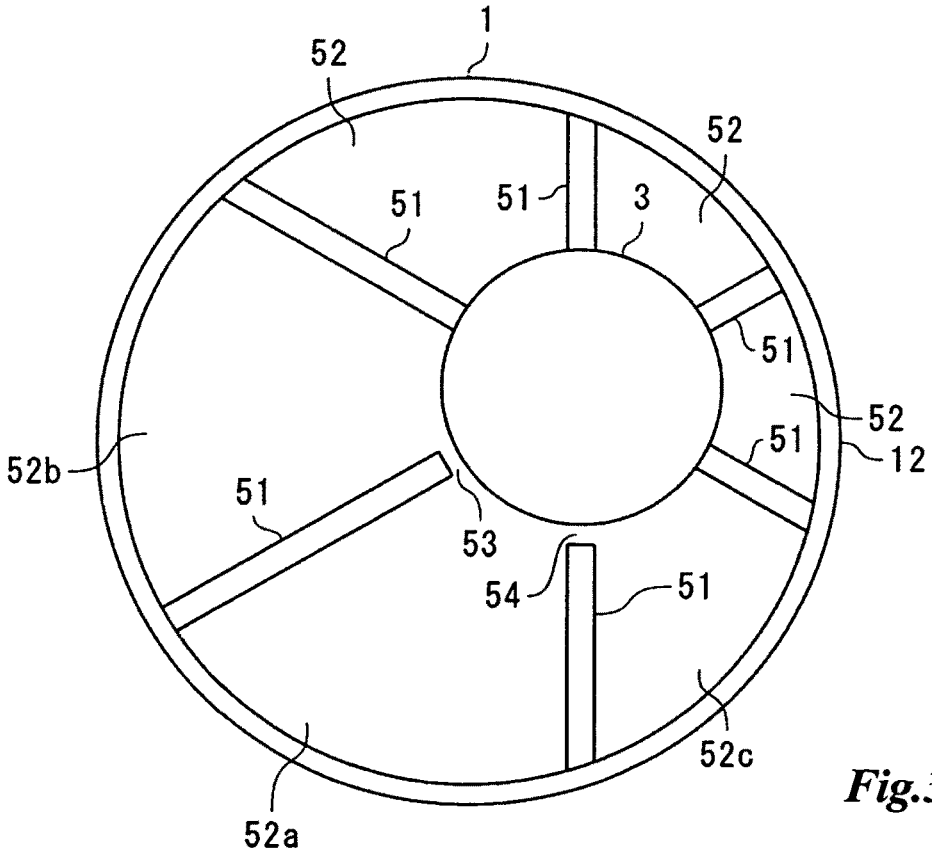
FIG. 37 is a diagrammatic plan view showing the structure of a sensor according to the twentieth embodiment of the present invention.

The twentieth embodiment of the present invention is explained referring to the attached drawings. FIG. 37 is a diagrammatic sectional view of the space in the housing including a detecting part, showing the structure of a sensor according to the twentieth embodiment of the present invention. In FIG. 37 the same members as those in FIG. 33 and FIG. 35 are allotted with the same reference numerals and their detailed explanation is omitted.

According to the sensor of this embodiment, the detecting part 3 is positioned eccentric to the center of the housing 1 and the guide paths 52, 52*a* to 52*c* with different flow path length are formed like the eighteenth embodiment and the nineteenth embodiment (refer to FIG. 33 and FIG. 35) as shown in FIG. 37. The end of the guide wall 51 on the detecting part 3 side being the boundary of the guide paths 52*a*, 52*b* is positioned apart from the detecting part 3 and the cutout 53 is formed, and the end of the guide wall 51 on the detecting part 3 side being the boundary of the guide paths 52*a*, 52*c* is positioned apart from the detecting part 3 and the cutout 54 is formed. Other structures are same as those in the eighteenth embodiment and the nineteenth embodiment, and their explanation is to be referred to those of the sixteenth embodiment to the nineteenth embodiment and is omitted here.

Namely, the cutout 53 is formed on the detecting part 3 side of the guide wall 51 being a boundary of the guide paths 52*a*, 52*b*, so that when the fluid to be detected enters in the guide path 52*a*, a part of the remained fluid in the guide path 52*a* is discharged into the guide path 52*b* using the cutout 53 as a bypass like the sensor in the eighteenth embodiment. On the other hand, the cutout 54 is formed on the detecting part 3 side of the guide wall 51 being a boundary of the guide paths 52*a*, 52*c*, so that when the fluid to be detected enters in the guide path 52*c*, a part of the remained fluid entered in the guide path 52*c* flows into the guide path 52*a* using the cutout 54 as a bypass like the sensor in the nineteenth embodiment.

According to the sensor of this embodiment, a part of the remained fluid in the guide path 52*a* with a long flow path is discharged into the guide path 52*b* with small flow resistance into the opening 14, and in addition, a part of the fluid to be detected which is flown into the guide path 52*c* with a short flow path enters in the guide path 52*a*. Therefore, not only that the remained fluid in the guide path 52*a* is rapidly discharged, but also the fluid to be detected flows in the guide path 52*a* via the guide path 52*c*, so that the time until the fluid to be detected reaches the detecting part 3 via the guide path 52*a* is reduced and further the flow amount of the fluid to be detected which flows into the detecting part 3 is increased. Namely, the sensor of the present embodiment has both structures of the eighteenth embodiment and the nineteenth embodiment, thereby obtaining synergetic effect on the responsiveness of the detecting part 3.

Twenty-First Embodiment

Figure 38:
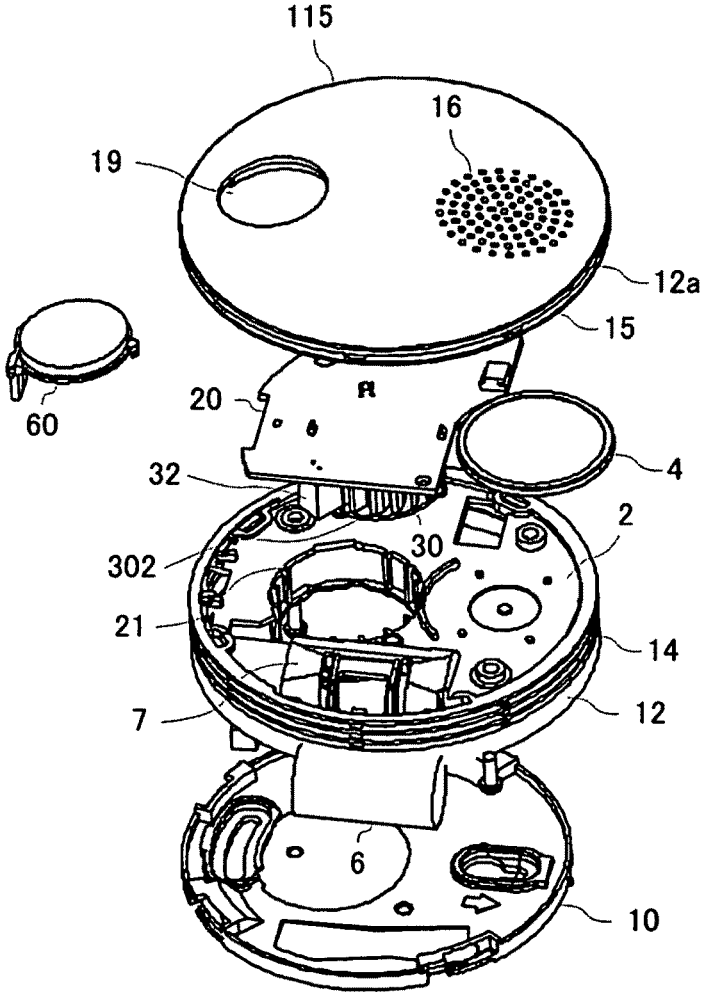
FIG. 38 is an exploded perspective view showing the structure of a smoke detecting type fire alarm according to the twenty-first embodiment of the present invention.
Figure 39A:
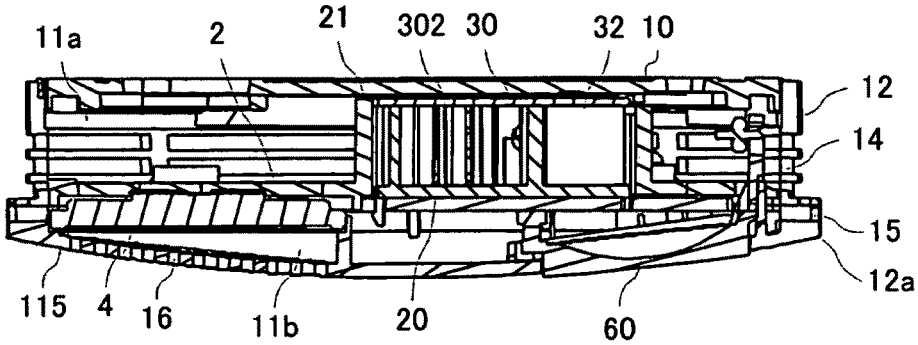
FIG. 39A is a sectional view showing the structure of the fire alarm in FIG. 38.
Figure 39B:
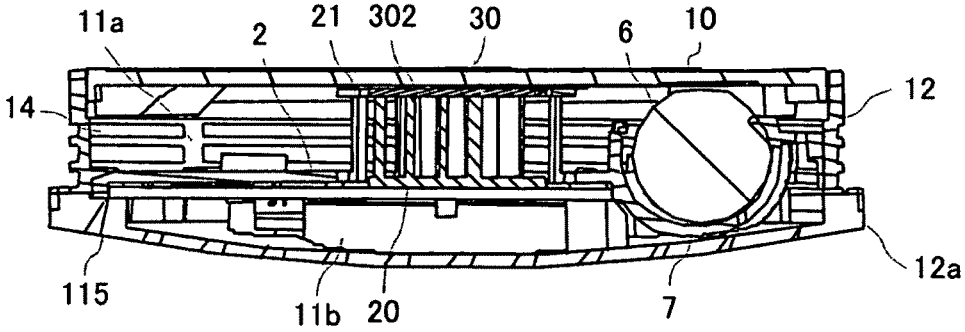
FIG. 39B is a sectional view showing the structure of the fire alarm in FIG. 38.

The sensor of the twenty-first embodiment of the present invention is explained exemplifying the example applied to a smoke detecting type fire alarm referring to the attached drawings. FIG. 38 is an exploded perspective view showing the structure of the fire alarm according to this embodiment of the present invention. FIG. 39A and FIG. 39B are sectional views of the fire alarm in FIG. 38, FIG. 39A is a sectional view including the setting area of the sounding body, and FIG. 39B is a sectional view showing the setting area of the battery.

The smoke detecting type fire alarm of this embodiment has the base part 10 to be attached to the attachment surface, the side wall 12 engaged to the external circumference of the base part 10 to be fixed thereon, the top panel 115 having a setting hole 19 to which an operation button 60 is inserted from the back and having a plurality of sound apertures 16, the circuit board 20 mounting the optical smoke detecting part 30 as the detecting part 3, and the sounding body 4 positioned corresponding to the position of the sounding apertures 16 of the top panel 115.

The opening 14 is provided on the outer circumferential face of the side wall 12 so as to flow smoke into the optical type smoke detecting part 30 and the separating plate 2 covering the inside of the periphery of the side wall 12 is provided at the end opposite to the top panel 115. The separating plate 2 has a holding member 21 into which the optical detecting part 30 is fitted to be held and a battery case 7 for containing the battery 6 which projects into the top panel 115 and is provided with a recessed part on the base part 10 side.

A ring-like side wall part 12*a* extending into the base part 10 is provided on the outer circumference of the top panel 115 and is connected to the side wall 12 so as to be constituted as a part of the side wall 12. The opening 15 for restricting the air resistance to the air vibration caused when the sounding body 4 is operated is provided on the side wall part 12*a*. Namely, as shown in the sectional views in FIG. 39A and FIG. 39B, the second space 11*b* is formed by the separating plate 2 provided for the side wall 12 and the circuit board 20 and the sounding body 4 is provided in the second space 11*b*.

Further, the first space 11*a* is provided on the base part 10 side of the separating plate 2 at the side wall 12 and the optical type smoke detecting part 30 is mounted on the face on the base part 10 side of the circuit board 20. Accordingly, the optical smoke detecting part 30 is fitted into the holding member 21 provided for the separating plate 2 and the optical type smoke detecting part 30 is provided in the first space 11*a*. The periphery of the optical type smoke detecting part 30 is covered with the holding member 21 as shown in FIG. 39A and FIG. 39B, however, the smoke (fluid) flown in the first space 11*a* can enter in the optical type smoke detecting part 30 because the opening is provided for the holding member.

A bent labyrinth wall 302 is provided along the peripheral side of the optical type smoke detecting part 30, so that the outside light is prevented from entering in the detection chamber of the optical type smoke detecting part 30. The photo diode, not shown, contained in a photo diode block 32 constituting the light emitting part 303 receives the scattered light by the illumination of the light emitting diode, not shown, so that the smoke amount is detected by the optical type smoke detecting part 30. When the battery 6 is contained in the battery case 7 which is a part of the separating plate 2, the battery 6 is arranged in the first space 11*a* and the first space 11*a* and the second space 11*b* are also separated by the battery case 7.

Twenty-Second Embodiment

Figure 40:
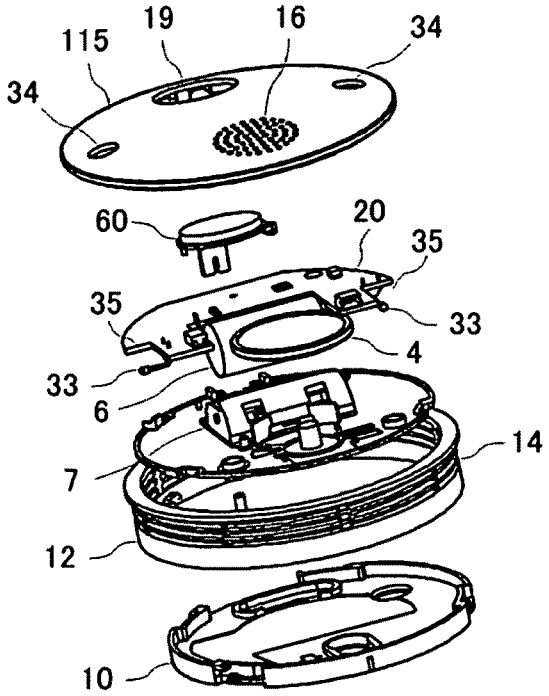
FIG. 40 is an exploded perspective view showing the structure of a heat detecting type fire alarm according to the twenty-second embodiment of the present invention.

The sensor of the twenty-second embodiment of the present invention is explained exemplifying the example applied to a heat-detecting type fire alarm referring to the attached drawings. FIG. 40 is an exploded perspective view showing the structure of the fire alarm in this embodiment.

The heat detecting type fire alarm of this embodiment is different from the smoke detecting type fire alarm explained in the twenty-first embodiment in that the top panel 115 does not have the side wall part 12*a* (refer to FIG. 38). In addition, a plurality of thermistors 33 connected on the base part 10 side of the circuit board 20 are provided as the detecting part 3 and the thermistors 33 are provided close to the side wall 12 therearound so as to be arranged in a position directly exposed to the thermal current (fluid) flown from the opening 14.

The circuit board 20 functions as the separating plate 2, the second space 11*b* is provided in an area covered with the circuit board 20 and the top panel 115, and the sounding body 4 is provided in the second space 11*b*. When the circuit board 20 is formed to be connected to a part of the side wall 12, the heat detecting type fire alarm of this embodiment has the opening 18 as explained in the fourth embodiment. In addition, the top panel 115 is provided with the opening for detection 34 in such a manner that the thermal current perpendicular to the top panel 115 reaches the heat detecting part of the thermistor 33 and the circuit board 20 is provided with the cutout 35 at a position corresponding to the opening for detection 34.

According to this embodiment, the first space 11*a* and the second space 11*b* are separated by the circuit board 20 and the second space 11*b* is opened to the outer environment via the circuit 14 when an opening is provided between the circuit board 20 and the side wall 12. Thus, the air resistance in the second space 11*b* is reduced when the sounding body 4 is operated, thereby preventing deterioration of sound volume of the sounding body 4.

Twenty-Third Embodiment

Figure 41:
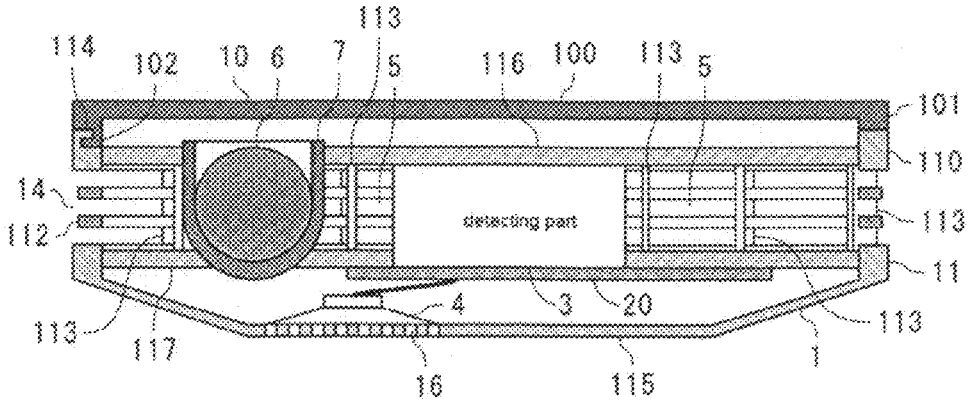
FIG. 41 is a diagrammatic sectional view showing the structure of a fire alarm according to the twenty-third embodiment of the present invention.
Figure 42:
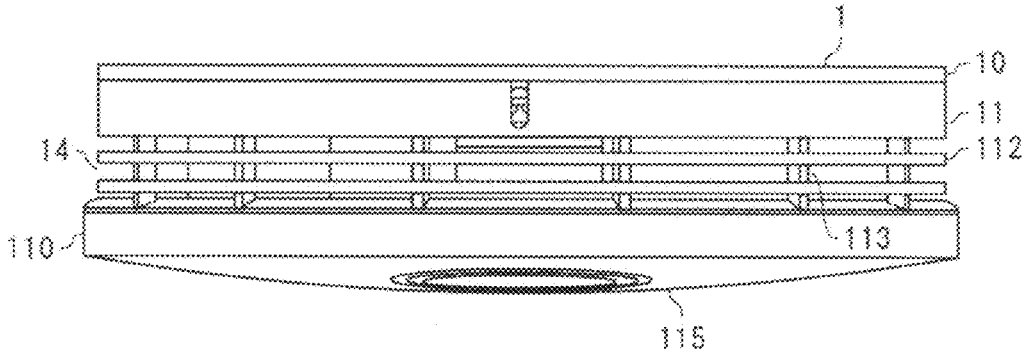
FIG. 42 is a side view showing the external structure of the fire alarm in FIG. 41.

The sensor of the twenty-third embodiment of the present invention is explained exemplifying the example applied to a smoke detecting type fire alarm referring to the attached drawings. FIG. 41 is a diagrammatic sectional view showing the structure of the fire alarm in this embodiment. FIG. 42 is a side view showing the external structure of the fire alarm of this embodiment.

According to the fire alarm of this embodiment shown in FIG. 41, the housing 1 covering the entire fire alarm includes the circuit board 20 mounting circuit members constituting a controlling part, not shown, for controlling each operation of the alarm, the detecting part 3 for measuring the environmental value when the fluid flows in the circumference environment (outer environment) of the housing 1, and the sounding body 4 for triggering an alarm to outside. The detecting part 3 and the sounding body 4 are electrically connected to the circuit board 20, so that the environmental value measured in the detecting part 3 is given as the electric signal to the controlling part, not shown, on the circuit board 20 and requirement of an alarm by the sounding body 4 is determined. When the controlling part, not shown, on the circuit board 20 determines the alarm is necessary, the alarming operation of the sounding body 4 electrically connected to the circuit board 20 is controlled, thereby triggering an alarm by the sounding body 4.

According to such a fire alarm, the housing 1 comprises the substantially disc-like base part 10 provided and fixed on the attachment surface like a ceiling and a wall and the main body 11 to be engaged to the base part 10. The base part 10 has a bottom plate 100 of which edge face comes into contact with the attachment surface, a side wall 101 constituting a peripheral wall erected opposite to the attachment surface from the periphery of the bottom plate 100, and an engaging part 102 of which section is like a claw convexed at the tip end of the side wall 101. Namely, the base part 10 is formed such that one end face of the ring-like side wall 101 is covered with the base plate 100 and another end face is opened. The main body 11 is engaged in an engaging part 102 provided at the end at open face side of the side wall 101 and the main body 11 is fixed to the base part 10.

The main body 11 has a ring-like side wall 110 forming the peripheral wall continued with the side wall 101 when the main body 11 is engaged into the base part 10, the opening 14 formed along the circumferential direction of the circumferential face of the side wall 110, a horizontal bar 112 dividing the opening 14 along the axial direction of the side wall 110, a longitudinal bar 113 dividing the opening 14 into a plurality of areas along the circumferential direction of the side wall 110, a claw-like engaging part 114 projected at the end of the base part 10 side of the side wall 110, and the substantially disc-like top panel 115 covering the end face opposite to the base part 10 of the side wall 110.

Namely, the main body 11 is provided with the side wall 110 erected on the base part 10 side from the periphery of the top panel 115 and is formed in the form of tube of which base part 10 side is opened. The side wall 110 is provided with the opening 14 opened in its circumferential direction as shown in FIG. 42, so that the fluid flowing outside of the housing 1 can flow therein via the opening 14 and the fluid in the housing 1 is discharged outside via the opening 14.

In addition, the ring-like horizontal bar 112 and a columnar vertical bar 113 cross where the opening 14 is provided on the side wall 110. The vertical bar 113 is formed so as to bridge from the base part 10 side to the top panel 115 side relative to the opening 14 of the side wall 110 so as to compensate the strength of the opening 14 of the side wall 110 of the main body 11 as shown in FIG. 42. A plurality of such vertical bars 113 are provided along the circumferential direction of the horizontal bar 112 and divides the opening 14 along the circumferential direction.

In the structure of FIG. 41 and FIG. 42, two horizontal bars 112 are provided along the axial direction of the side wall 110 where the opening 14 is provided and the opening 14 is divided into three areas along the axial direction. However, the number of the horizontal bars 112 is not limited to two and the horizontal bar may not be provided when the housing 1 has enough strength. Also the number of the vertical bars 113 is not limited as far as the strength of the housing 1 is adequately given. Further, the horizontal bar 112 and the vertical bar 113 prevent fluid flow into the housing 1 via the opening 14, so that the number is preferably small. In addition, a plurality of sound apertures 16 are provided for transmitting the vibration caused by the sound from the sounding body 4 constituting with a buzzer or a speaker into the outside air.

The main body 11 has a shielding cover 117 (corresponding to the separating plate 2) and a shielding cover 116 dividing the space relative to the axial direction of the main body 11 and the detecting part 3 is provided in the first space 11*a* covered with the covers 116, 117. The control part for the fire alarm, the circuit board 20 electrically connected to the detecting part 3, and the sounding body 4 electrically connected to the circuit board 20 for triggering alarm are provided in the second space 11*b* covered with the shielding cover 117 and the top panel 115.

Namely, the shielding covers 116, 117 are provided so as to be substantially parallel to the bottom plate 100 and the top panel 115, the shielding cover 116 is provided on the base part 10 side in the main body 11 and the shielding cover 117 is provided at the top panel 115 side in the main body 11. The shielding cover 117 has a penetrating hole on the face where the detecting part 3 is provided and the detecting part 3 connected to the circuit board 20 is inserted through the penetrating hole. The second space 11*b* constituted with the top panel 115, the shielding cover 117 and the side wall 110 becomes a resonance space resonating with the sound vibration from the sounding body 4 provided in the second space 11*b*. A guide part for guiding the fluid flown from the opening 14 of the side wall 110 into the detecting part 3 is formed in the area outside the detecting part 3 in the first space 11*a* covered with the shielding covers 116, 117.

The guiding part 5 in the first space 11*a* is separated from either the space in the base part 10 side and the second space 11*b* at the top panel 115 side when the shielding covers 116, 117 are provided, so that the guiding part 5 becomes a space opened by the opening 14. Therefore, dust is prevented from entering in the guiding part 5 from the space on the base part 10 side and the second space 11*b* on the top panel 115 side by the shielding covers 116, 117. The current from the space on the base part 10 side and the second space 11*b* on the top panel 115 side into the guiding part 5 is blocked by the shielding covers 116, 117 and the current in the guiding part 5 is limited into the flow from the opening 14. In addition, an operator is refrained from touching the guiding part 5 by the shielding covers 116, 117 during setting operation of a fire alarm or exchanging operation of battery.

The battery case 7 holing the battery 6 for supplying power to a fire alarm is erected so as to connect the shielding covers 116, 117 in a part of the first space 11*a* including the guiding part 5 and covered with the shielding covers 116, 117. The battery case 7 is provided between the opening 14 and the detecting part 3 in the first space 11*a* covered with the shielding cover 116, 117, so that it becomes a structure blocking the fluid flow from the opening 14 to the detecting part 3.

The battery case 7 may be designed to be integrated with either of the shielding covers 116, 117 or may be designed to be a separate body from either of them. The opening of the battery case 7 to be inserted with the battery 6 is positioned on the base part 10 side of the shielding cover 116. Accordingly, in case of exchanging the battery 6 of the fire alarm, the battery 6 can be exchanged without removing the shielding cover 116 when the main body 11 is removed from the base part 10, so that the detecting part 3 and the guiding part 5 are protected by the shielding cover 116. When the battery case 7 is integrated with either of the shielding covers 116, 117, the opening of the battery case 7 is positioned on the base part 10 side, so that it is preferably integrated with the shielding cover 116 as shown in FIG. 41.

The base part 10 is screwed with a fixing means such as screws with the bottom plate 100 contacted with the attachment surface and the fire alarm mentioned above is fixed to the base such as a ceiling and a wall. When the engaging part 114 provided for the side wall 110 of the base body 11 is engaged to the engaging part 102 provided for the side wall 101 of the base part 10, the main body 11 is connected and fixed to the base part 10. The main body 11 is provided with the shielding cover 116 as mentioned above and the shielding cover 116 covers the base part 10 side of the space provided on the same plane where the detecting part 3 and the guiding part 5 are provided. Therefore, when an operator attaches the main body 11 to the base part 10 fixed on the attachment surface, dust caused by operation is prevented from entering in the space forming the detecting part 3 and the guiding part 5 in the main body 11.

Twenty-Fourth Embodiment

Figure 43:
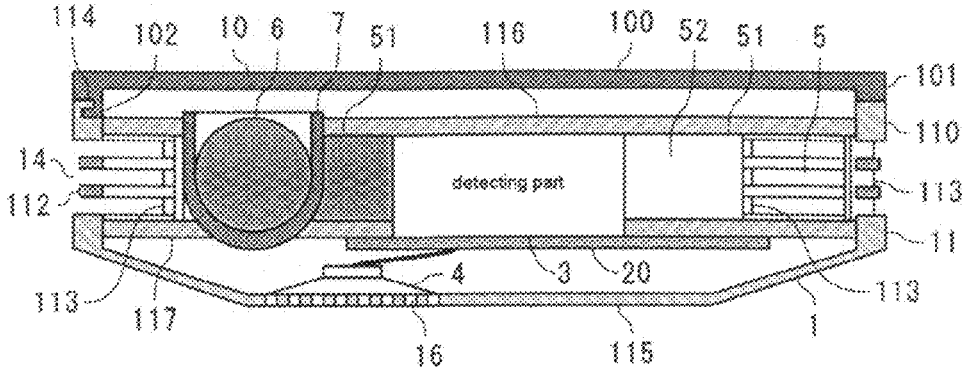
FIG. 43 is a diagrammatic sectional view showing the structure of a fire alarm according to the twenty-fourth embodiment of the present invention.
Figure 44:
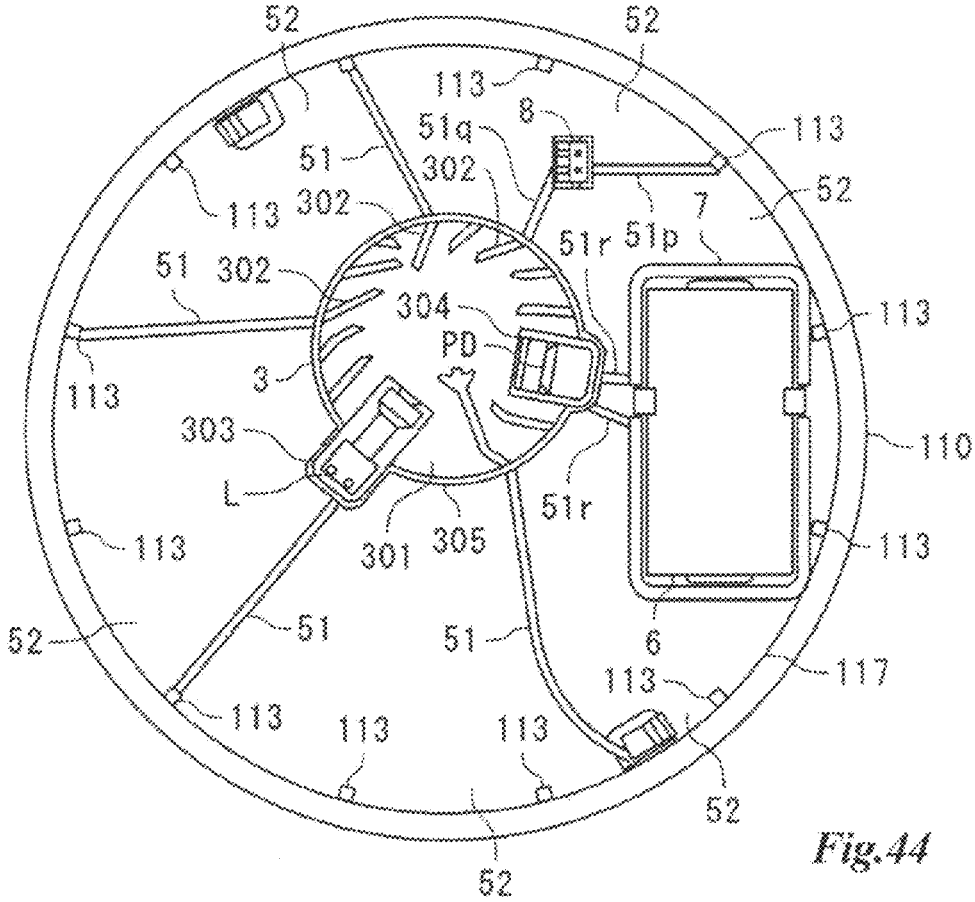
FIG. 44 is a plan view showing the internal structure of the main body of the fire alarm in FIG. 43.

The sensor of the twenty-fourth embodiment of the present invention is explained exemplifying the example applied to a smoke detecting type fire alarm referring to the attached drawings. FIG. 43 is a diagrammatic sectional view showing the structure of the fire alarm in this embodiment. FIG. 44 is a plan view showing the internal structure of the fire alarm of this embodiment. In this embodiment the same members as those in the fire alarm in the twenty-third embodiment are allotted with the same reference numerals and their detailed explanation is omitted. The fire alarm of this embodiment is also explained under the condition that the external view is shown in the side view of FIG. 42 like the twenty-third embodiment.

The fire alarm of this embodiment further includes the guide wall 51 for dividing the guiding part 5 in the main body 11 into a plurality of areas in addition to the fire alarm in the twenty-third embodiment (refer to FIG. 41) as shown in FIG. 43. Namely, a plurality of guide walls 51 extended from the opening 14 of the side wall 110 to the detecting part 3 are provided in the first space 11*a* covered with the shielding covers 116, 117. Other structures than the guide wall 51 are same as those in the twenty-third embodiment, and their explanation is to be referred to those of the twenty-third embodiment and is omitted here.

The fire, alarm in FIG. 43 is provided with the above-mentioned plurality of guide walls 51 connected to either of the shielding covers 116, 117 and the guiding part 5 formed between the shielding covers 116, 117 is divided into a plurality of areas. Namely, a plurality of guide walls 51 erect in a substantially radial manner around the detecting part 3 with, respect to the facial direction of the shielding cover 117 and the adjacent areas divided by the guide wall 51 function as the guide path 52. In addition, the guide wall 51 is provided between the outer circumferential wall of the battery case 7 being a projection and the outer circumferential wall of the detecting part 3 and the battery case 7 can become a part (guiding member) of the guide wall 51. The vertical bar 113 is directly connected to the outer circumferential wall on the opening 14 side of the battery case 7.

The guide wall 51 erected with respect to the shielding covers 116, 117 may be integrated either of the shielding covers 116, 117 or may be separately formed from either of them. In addition, in the structure of FIG. 43, when the battery case 7 is integrated with the shielding cover 116 together with the guide wall 51, the guide wall 51 is directly connected to a projection such as the battery case 7 with respect to the guiding part 5, so that the projection like the battery case 7 may be a part of the guide wall 51. When the guide wall 51 is integrated with either of the shielding covers 116, 117, the number of members of a fire alarm can be reduced and its production procedure can be simplified.

When the guide wall 51 is connected to the shielding covers 116, 117, there remain no gap between the covers, so that dust is further prevented from entering in the guide path 52 and in addition fluid is prevented from flowing between the adjacent guide paths 52 via the guide wall 51. The guide path 52 constituted with the guide wall 51 is separated from each of the space on the base part 10 side and the second space 11*b* on the top panel 115 side when the shielding covers 116, 117 are provided, so that the guiding part 5 becomes a space opened by the opening 14 like the twenty-third embodiment. Therefore, dust and current are prevented from entering in the guide path 52 from other spaces in the housing 1 and an operator is prevented from coming into contact with the guide path 52 by, the shielding covers 116, 117. In addition, the guide wall 51 is protected by the shielding cover 116. The main body 11 is provided with the shielding cover 116 on the base part 10 side in this embodiment, however, the shielding cover 116 may be removed.

The guide wall 51 of this fire alarm is detailed exemplifying the structure wherein the detecting part 3 is a photoelectric type smoke detecting part referring to the plan view in FIG. 44. The detecting part 3 constituting the smoke detecting part is arranged eccentric to the center on the facial direction of the shielding cover 117. The guide wall 51 is provided so as to connect the vertical bar 113 of the opening 14 provided at the outer circumference of the shielding cover 117 to the outer circumferential wall of the detecting part 3.

The detecting part 3 is provided with a plurality of labyrinth walls 302, the light emitting part 303 having a light emitting diode L, and the light receiving part 304 having a photo diode PD around the peripheral side of a bottom plate 301 being a photoelectric base. The end part of the guide wall 51 on the detecting part 3 side is connected to the outer circumferential wall of the guide wall 51 at each setting position of the labyrinth wall 302, the light emitting part 303 and the light receiving part 304. Namely, the guide wall 51 is provided so as to be extended from each one of the labyrinth wall 302, the light emitting part 303 and the light receiving part 304 which become obstacles for the fluid (smoke) flow to be entered in the detecting part 3. Accordingly, the obstacle caused by the structure in the detecting part 3 can be reduced relative to the fluid flow guided by the guide path 52 formed with the guide wall 51.

The number of guide walls 51 is small with respect to the vertical bar 113 in FIG. 44, however, the relation of the number of the guide wall 51 and the vertical bar 113 is not limited to the example in FIG. 44. The number of the vertical bar 113 and the guide wall 51 is same or the number of the guide walls 51 is larger than that of the vertical bars 113. When the outer circumferential side of the detecting part 3 is covered with an insect screen 305, insects and dust are prevented from entering in the detecting part.

Some of the guide walls 51 are designed such that a part of them is constituted with the battery case 7 or a connector 8 penetrating from the shielding cover 117 to the shielding cover 116. Namely, a projection formed with the shielding covers 116, 117 in the first space 11*a* may be used as a part of the guide wall 51. The guide wall 51 of which one part is the connector 8 is constituted with a guide wall 51*p* extended between the vertical bar 113 and the connector 8, the connector 8, and a guide wall 51*q* extended between the connector 8 and the detecting part 3. On the other hand, the guide wall 51 of which one part is the battery case 7 is constituted with the battery case 7 directly connected to two vertical bars 113 and two guide walls 51*r* extended between the battery case 7 and the detecting part 3.

According to such a structure, either of the battery case 7 or the connector 8 being a projection can be functioned as a guide wall. The connector 8 is electrically connected to the control part, not shown, on the circuit board 20 and penetrates from the shielding cover 117 to the shielding cover 116. Thus, the connector 8 projects from the surface on the base part 10 side of the shielding cover 116. When the main body 11 is removed from the base part 10, the electric signal is sent to the connector 8 from outside to operate the control part, not shown, on the circuit board 20, thereby executing operation test of a fire alarm.

When the connector 8 penetrates from the shielding cover 117 to the shielding cover 116, a columnar connector insertion member connecting between the covers 116, 117 is provided. When the section of the connector insertion member is formed tubular having a hole to be inserted with the connector 8, the tip end of the connector 8 connected to the circuit board 20 is guided to the surface on the base part 10 side of the shielding cover 116 via the connector insertion member. The connector insertion member may be integrated with the above-mentioned guide walls 51*p*, 51*q* or may be integrated with either of the shielding covers 116, 117 like the battery case 7.

Twenty-Fifth Embodiment

Figure 45:
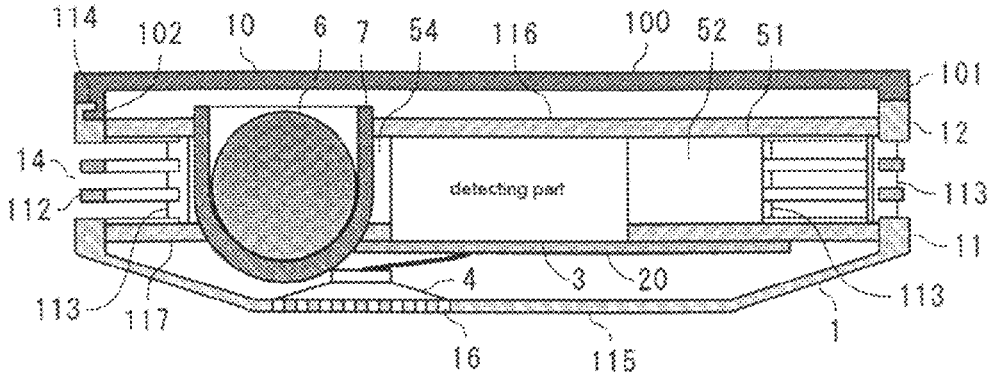
FIG. 45 is a diagrammatic sectional view showing the structure of a fire alarm according to the twenty-fifth embodiment of the present invention.
Figure 46:
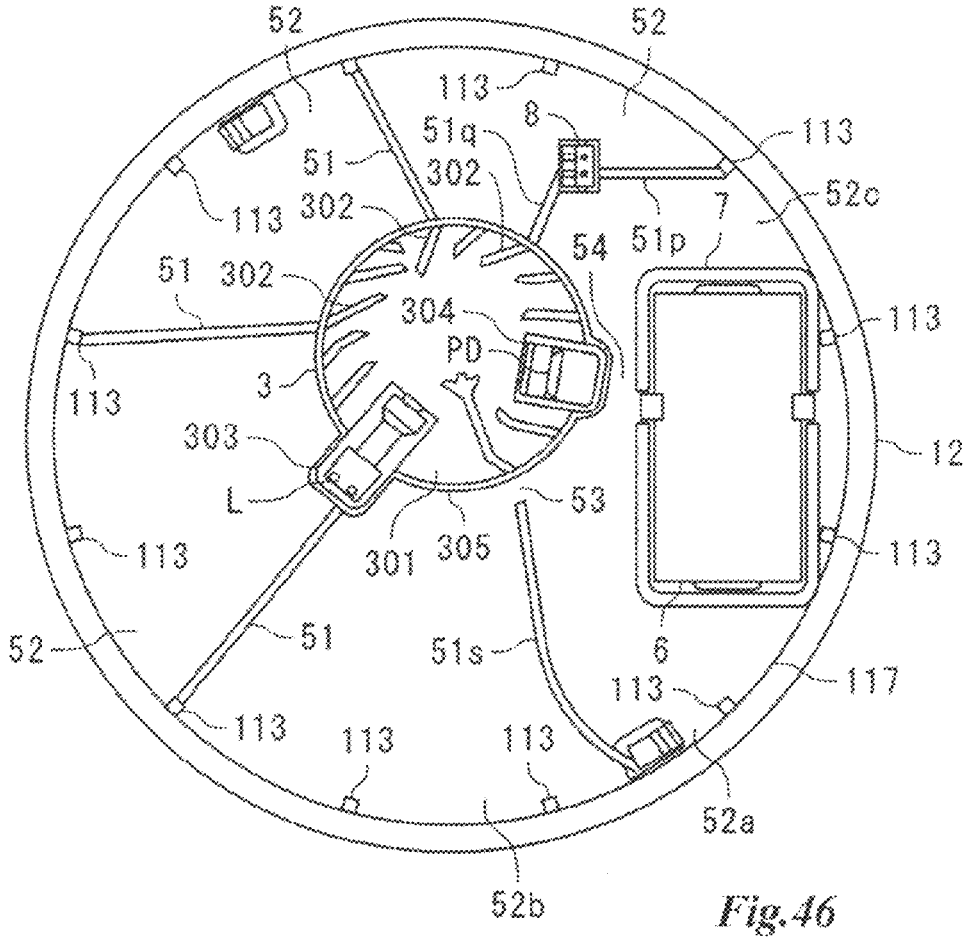
FIG. 46 is a plan view showing the internal structure of the main body of the fire alarm in FIG. 45.
Figure 47:
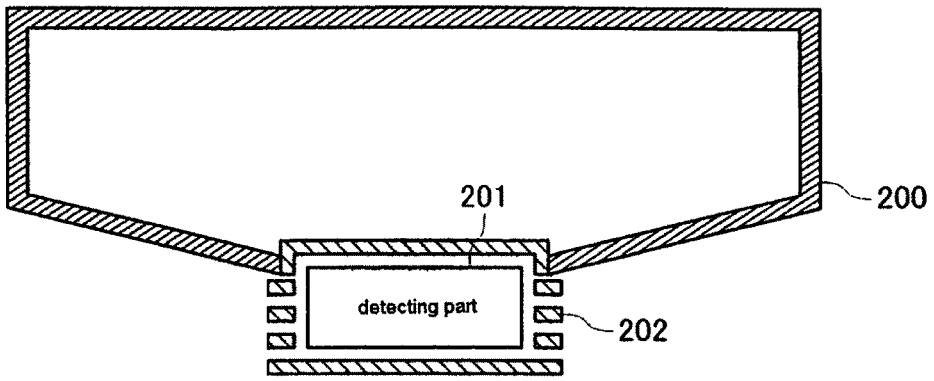
FIG. 47 is a diagrammatic sectional view showing the structure of a conventional sensor.

The sensor of the twenty-fifth embodiment of the present invention is explained exemplifying the sensor applied to a smoke detecting type fire alarm referring to the attached drawings. FIG. 45 is a diagrammatic sectional view showing the structure of the fire alarm in this embodiment. FIG. 46 is a plan view of the inside of the housing showing the structure of the fire alarm of this embodiment. The members in the fire alarm of this embodiment same as those in the twenty-fourth embodiment are allotted with the same reference numerals and their detailed explanation is omitted. The fire alarm of this embodiment is also explained under the condition that the external view is shown in the side view of FIG. 42 like the twenty-fourth embodiment.

The fire alarm of this embodiment has the guide wall 51 which forms the cutout 53 with the detecting part 3 in addition to the fire alarm of the twenty-fourth embodiment (refer to FIG. 43 and FIG. 44) as shown in FIG. 45 and FIG. 46. Namely, some guide walls 51 are provided so as to connect from the vertical bar 113 of the opening 14 to the outer circumferential wall of the detecting part 3 and other guide walls 51 are formed such that only one end is connected to the vertical bar 113 so as to form the cutout 53. The guide wall 51 with the cutout 53 is designed such that another end is not connected to the outer circumferential wall of the detecting part 3 and the gap formed between another end and the detecting part 3 forms the cutout 53. Structures other than the guide wall 51 are same as those in the twenty-fourth embodiment, and their explanation is to be referred to those of the twenty-fourth embodiment and is omitted here.

The battery case 7 holding the battery 6 for supplying power to the fire alarm is erected at a part of the first space 11*a* formed with the shielding covers 116, 117 so as to be connected with the shielding covers 116, 117. The battery case 7 is provided between the opening 14 and the detecting part 3 in the first space 11*a* formed with the shielding covers 116, 117 and has the same function as the guide wall 51 by the outer circumferential wall. The guide wall 51*r* is removed from the structure of the twenty-forth embodiment, so that a gap is formed between the battery case 7 functioning as the guide wall and the detecting part 3. The cutout 54 being a bypass is formed with the gap between the battery case 7 and the detecting part 3.

The relation of the guide wall 51 and the cutouts 53, 54 of thus constructed fire alarm is detailed referring to the plan view in FIG. 46. The guide wall 51 of which end on the opening 14 side is connected to the vertical bar 113 extends to the outer circumferential wall of the detecting part 3 where either of the labyrinth wall 302, the light emitting part 303 or the light receiving part 304 is provided. The end of the guide wall 51 without having the cutout 53 comes into contact with the outer circumferential wall of the detecting part 3. Namely, one end of the guide wall 51 forming the guide path 52 is connected to the vertical bar 113 and another end is connected to the outer circumferential wall of the detecting part 3.

One end of a guide wall 51*s* (corresponding to the guide wall 51 in FIG. 45) being the boundary of the guide paths 52*a*, 52*b* with a long flow path comes into contact with the inner circumferential face of the side wall 12. Another end of the guide wall 51*s* does not come into contact with the outer circumferential wall of the detecting part 3 and is provided adjacent to the outer circumferential wall of the detecting part 3. Accordingly, the cut out 53 being a bypass between the guide paths 52*a*, 52*b* is formed between another end of the guide wall 51*s* and the outer circumferential wall of the detecting part 3. The guide walls 51*p*, 51*q* being the boundary of the guide paths 52, 52*c* form one guide wall interposing the connector 8 and penetrating from the shielding cover 117 to the shielding cover 116. Namely, the end of the guide wall 51*q* of which another end is connected to the vertical bar 113 and the end of the guide wall 51*q* of which another end comes into contact with the outer circumferential wall of the detecting part 3 are connected to the connector 8, thereby forming one guide wall.

The battery case 7 penetrating from the shielding cover 117 to the shielding cover 116 is provided so as to come into contact with the inner circumferential face of the side wall 12 and to have a gap with the outer circumferential wall of the detecting part 3. Thus formed battery case 7 functions as the guide wall between the guide paths 52*a*, 52*c* and the cutout 54 being a bypass between the guide paths 52*a*, 52*c* is formed with the gap with the detecting part 3. Accordingly, th□guide path 52*a* with a long flow path is formed with the battery case 7 and the guide wall 51*s* and the guide path 52*c* with a short flow path is formed with the battery case 7, the guide walls 51*p*, 51*q* and the connector 8 in this embodiment. Then, the guide paths 52*a*, 52*c* are arranged so as to be adjacent to each other via the battery case 7.

According to such a structure, when the fluid to be detected flows in the guide path 52*a*, the cutout 53 provided for the guide wall 51*s* functions as a bypass, the remained fluid in the guide path 52*a* flows in the guide path 52*b* via the cutout 53 and is finally discharged from the opening 14. When the fluid to be detected flows in each guide paths 52*a*, 52*c*, the cutout 54 provided between the battery case 7 and the detecting part 3 functions as a bypass, and a part of the fluid to be detected flown in the guide path 52*c* enters in the guide path 52*a* via the cutout 54, thereby increasing the amount of the fluid to be detected which flows from the guide path 52*a* to the detecting part 3.

INDUSTRIAL APPLICABILITY

This invention is applicable to a sensor having a detecting part in which the environmental value is obtained from the fluid. Specifically, the present invention can be applied to a sensor constituting a fire alarm having a photoelectric type smoke detecting part or a heat sensitive element and a sensor constituting a gas alarm for measuring the gas amount.

The invention claimed is:

1. A sensor having a detecting part for detecting an environmental value representing change in physical amount of circumference environment by a fluid flowing into externally and a controlling part for discriminating abnormality in circumference environment based on the environmental value detected by the detecting part, said sensor comprising:

a housing in which said detecting part and said controlling part are disposed;

an opening formed on an outer circumferential face of said housing; and a guide member extending from said opening to said detecting part and constituting a guide path for guiding said fluid from said opening to said detecting part, wherein said opening surrounds said detecting part on a substantially coplanar surface with said detecting part.

2. The sensor as set forth in claim 1, wherein said guide member is connected to at least one of a side face of said housing and an outer circumferential side of said detecting part.

3. The sensor as set forth in claim 1, wherein said detecting part is eccentrically disposed from the center of an end face of said housing, said end face being disposed parallel to an attachment surface of said sensor.

4. The sensor as set forth in claim 3, wherein said guide member is disposed in such a manner that a connecting line from the one end of said guide member to a center of said detecting part and a connecting line from a center of said end face parallel to said attachment surface of said sensor to a center of said detecting part are intersecting at an acute angle on said end face.

5. The sensor as set forth in claim 3, wherein said sensor has a plurality of guide members as said guide member, said guide members being disposed at an area around the center side of said end face of said housing parallel to said attachment surface of said sensor on the basis of said detecting part.

6. The sensor as set forth in claim 1, wherein said sensor has a plurality of guide members as said guide member, and at least one of said guide members is disposed at an acute angle on said end face parallel to said attachment surface of said sensor so as to intersect other guide member adjacent to said one of guide members disposed along the circumference of said detecting part.

7. The sensor as set forth in claim 1, further comprising a component other than said detecting part provided between said detecting part in said housing and a part of said opening, wherein said guide member is disposed in such a manner that a connecting line from the one end of said guide member to a center of said detecting part and a connecting line from a center of said component to the center of said detecting part intersect at an acute angle on said end face parallel to said attachment surface of said sensor.

8. The sensor as set forth in claim 7, wherein said component and said detecting part are provided respectively in two divided areas by a center line passing the center of said end face of said housing on said end face parallel to said attachment surface of said sensor.

9. The sensor as set forth in claim 7, wherein a plurality of said components are disposed and arranged in array from said detecting part toward said opening.

10. The sensor as set forth in claim 7, wherein at least some of said guide members are constituted such that the longitudinal direction is from said detecting part toward said opening.

11. The sensor as set forth in claim 1, further comprising a groove member which is connected to an end of said guide member on said detecting part side and whose longitudinal direction is perpendicular to a face parallel to said attachment surface of said sensor.

12. The sensor as set forth in claim 1, wherein said guide member is shaped so as to form a curve line along its longitudinal direction parallel to said attachment surface of said sensor.

13. The sensor as set forth in claim 1, wherein said detecting part constitutes an optical smoke detecting part having a labyrinth wall preventing incident of outside light on the outer circumferential side, and the end of said guide member on said detecting part side is disposed at a base part of said labyrinth wall.

14. The sensor as set forth in claim 1, wherein a component is further provided in a space in which said opening of said housing and said detecting part are disposed on coplanar surface and is disposed around said detecting part, and said component constitutes a part of said guide member.

15. The sensor as set forth in claim 14, wherein a plurality of bars are further provided so as to surround said opening along the circumferential direction of said outer circumferential wall, and at least some of said plurality of bars constitute said component by connecting to the end of said guide member.

16. The sensor as set forth in claim 1, wherein a bypass through which fluid flows into is further provided on at least one of said guide members so as to be disposed between two guide paths, said two guide paths being defined by said guide member formed with said bypass and other two guide members adjoining to said guide members formed with said bypass, with said guide member formed with said bypass disposed as a boundary between said two guide paths.

17. The sensor as set forth in claim 16, wherein said bypass is a notched path which is formed by cutting a part of said guide member, and said notched path is disposed in said guide paths at an area closer to the outer circumferential side of said detecting part than said opening.

18. The sensor as set forth in claim 16, wherein said two guide paths are defined by a first guide path and a second guide path, and fluid remaining in said first guide path is exhausted out of said housing through said opening after flowing into said second guide path through said bypath.

19. The sensor as set forth in claim 18, wherein said first guide path has larger flow resistance larger than that of said second guide path.

20. The sensor as set forth in claim 16, wherein said two guide paths are defined by a first guide path and a second guide path, and fluid flown into said second guide path through said opening from outside of said housing flows into said detecting part after flowing into said first guide path through said bypass.

21. The sensor as set forth in claim 20, wherein said first guide path is longer than said second guide path in its flow path from said opening to said detecting part.

22. The sensor as set forth in claim 1, further comprising a shielding cover constituting an independent space by a component part comprised of said detecting part and said guide path in said housing.

23. The sensor as set forth in claim 22, wherein said guide member is projects integrally with said shielding cover.

24. The sensor as set forth in claim 1, comprising:

a separating plate by which said housing is defined as two divided spaces, of a first space and a second space, along its height direction;

a first opening for leaving open said first space, formed corresponding to said first space on the side face of said housing; and a sound aperture penetrating into said second space in an area which is parallel to the attachment surface of the sensor and is opposite to a sounding body on the end face of said housing covering said second space, wherein said detecting part is provided in said first space whereas said sounding body is provided in said second space.

25. The sensor as set forth in claim 24, further comprising a second opening formed at the side face of said housing corresponding to said second opening for said second space.

26. The sensor as set forth in claim 24, further comprising a second opening formed at said separating plate opening for said second space.

27. The sensor as set forth in claim 24, wherein a guide member is further provided in said first space, for guiding fluid to be measured from said first opening into said detecting part.

* * * * *